US010921073B2

(12) United States Patent
Grier

(10) Patent No.: US 10,921,073 B2
(45) Date of Patent: Feb. 16, 2021

(54) FIREARM SYSTEM AND METHOD

(71) Applicant: Forward Defense Munitions Co., Colorado Springs, CO (US)

(72) Inventor: Martin Grier, Tallahassee, FL (US)

(73) Assignee: Forward Defense Munitions, Co., Colorado Springs, CO (US)

( * ) Notice: Subject to any disclaimer, the term of this patent is extended or adjusted under 35 U.S.C. 154(b) by 0 days.

(21) Appl. No.: 16/115,483

(22) Filed: Aug. 28, 2018

(65) Prior Publication Data

US 2019/0003792 A1 Jan. 3, 2019

Related U.S. Application Data

(63) Continuation of application No. 14/992,713, filed on Jan. 11, 2016, now Pat. No. 10,060,689.

(51) Int. Cl.
*F41A 3/66* (2006.01)
*F41A 3/52* (2006.01)
(Continued)

(52) U.S. Cl.
CPC *F41A 3/66* (2013.01); *F41A 3/52* (2013.01); *F41A 3/60* (2013.01); *F41A 3/72* (2013.01);
(Continued)

(58) Field of Classification Search
CPC ..... F41A 3/60; F41A 9/24–25; F41A 9/35; F41A 9/68; F41A 9/83–84;
(Continued)

(56) References Cited

U.S. PATENT DOCUMENTS 1,363,608 A 12/1920 Luciani
1,660,590 A * 2/1928 Baldwin ..... F41A 9/35 89/126
(Continued)

FOREIGN PATENT DOCUMENTS

EP 2525183 A1 11/2012
FR 2754049 A1 4/1998
(Continued)

OTHER PUBLICATIONS

Korean Intellectual Property Office; PCT International Search Report, Issued in Connection to PCT/US2017/013034; dated Apr. 26, 2017; 3 pages; Korea.
(Continued)

*Primary Examiner* — Bret Hayes
*Assistant Examiner* — Benjamin S Gomberg
(74) *Attorney, Agent, or Firm* — Greenberg Traurig, LLP

(57) ABSTRACT

Embodiments of the invention include a firearm system and method of assembly of the firearm system including a receiver complex including a receiver coupled to a forward receiver. A feed port is positioned between the receiver and the forward receiver, and a striker coil assembly is positioned proximate the receiver, and includes a plurality of strikers each extending at least partially through a coil. An interchangeable barrel is coupled to the forward receiver forming a breech. In some embodiments, the firearm system includes a breech that includes a plurality of side-by-side bores of the barrel. Some embodiments include a magazine coupled to the receiver complex adjacent the feedport to simultaneously feed more than one dischargeable projectile into the feedport with a single charge block. In some embodiments, the charge block includes a plurality of chambers and a plurality of projectiles positioned within the plurality of chambers.

10 Claims, 37 Drawing Sheets

(51) Int. Cl.

| | |
|---|---|
| ***F41A 3/60*** | (2006.01) |
| ***F41A 3/72*** | (2006.01) |
| ***F41A 9/24*** | (2006.01) |
| ***F41A 9/35*** | (2006.01) |
| ***F41A 9/65*** | (2006.01) |
| ***F41A 19/59*** | (2006.01) |
| ***F41A 19/68*** | (2006.01) |
| ***F41A 21/06*** | (2006.01) |
| ***F41A 21/08*** | (2006.01) |
| ***F41A 21/28*** | (2006.01) |
| ***F41F 1/08*** | (2006.01) |
| ***F41A 9/25*** | (2006.01) |
| ***F41A 21/16*** | (2006.01) |
| ***F41C 23/06*** | (2006.01) |

(52) U.S. Cl.
CPC *F41A 9/24* (2013.01); *F41A 9/25* (2013.01); *F41A 9/35* (2013.01); *F41A 9/65* (2013.01); *F41A 19/59* (2013.01); *F41A 19/68* (2013.01); *F41A 21/06* (2013.01); *F41A 21/08* (2013.01); *F41A 21/16* (2013.01); *F41A 21/28* (2013.01); *F41C 23/06* (2013.01); *F41F 1/08* (2013.01)

(58) Field of Classification Search
CPC ..... F41A 19/18–23; F41A 19/68; F41A 21/06–08; F41F 1/08
USPC ..... 42/1.06; 89/126–127, 1.41
See application file for complete search history.

(56) References Cited

U.S. PATENT DOCUMENTS

| | | | | | |
|---|---|---|---|---|---|
| 1,723,450 | A | | 8/1929 | Tomiska | |
| 1,987,912 | A | | 1/1935 | Rady et al. | |
| 2,231,879 | A | | 2/1941 | Brightman | |
| 2,353,601 | A | * | 7/1944 | Tisdale, Sr. | F41A 9/35 89/126 |
| 2,436,175 | A | * | 2/1948 | Neal | F41A 3/26 89/127 |
| 2,926,568 | A | | 3/1960 | Neder | |
| 2,976,770 | A | | 3/1961 | Fletcher | |
| 2,981,156 | A | | 4/1961 | Fletcher | |
| 3,250,034 | A | | 5/1966 | Simmons | |
| 3,720,133 | A | * | 3/1973 | Jampy | F41A 9/35 89/126 |
| 3,745,878 | A | | 7/1973 | Jampy et al. | |
| 3,749,021 | A | * | 7/1973 | Burgess | F42B 5/30 102/467 |
| 5,165,040 | A | * | 11/1992 | Andersson | F42B 5/29 102/430 |
| 5,237,928 | A | * | 8/1993 | Redecker | F42B 5/192 102/431 |
| 5,454,325 | A | * | 10/1995 | LeBlanc | F42B 12/34 102/506 |
| 5,784,821 | A | * | 7/1998 | Gerard | F41A 9/25 42/15 |
| 7,617,758 | B2 | * | 11/2009 | Gavage | F41A 5/16 42/50 |
| 8,516,729 | B2 | | 8/2013 | Hayes et al. | |
| 8,756,843 | B1 | * | 6/2014 | Cantrell | F41A 3/10 42/49.01 |
| 8,904,690 | B1 | | 12/2014 | Cantrell | |
| 8,931,199 | B1 | | 1/2015 | Cauley, Jr. et al. | |
| 9,003,687 | B2 | | 4/2015 | Cauley, Jr. et al. | |
| 9,103,609 | B2 | * | 8/2015 | Cantrell | F41A 3/10 |
| 9,335,108 | B2 | | 5/2016 | Cauley, Jr. et al. | |
| 9,404,718 | B1 | * | 8/2016 | Shaver | F41B 9/0046 |
| 10,551,140 | B2 | * | 2/2020 | Patrick, IV | F41A 9/35 |
| 2012/0247310 | A1 | * | 10/2012 | Klasen | F41A 9/63 89/1.816 |
| 2012/0279106 | A1 | | 11/2012 | Hayes et al. | |
| 2012/0291321 | A1 | | 11/2012 | Spiro | |
| 2014/0317985 | A1 | | 10/2014 | Cauley, Jr. et al. | |
| 2015/0007479 | A1 | * | 1/2015 | Kunau | F41A 99/00 42/78 |
| 2015/0007480 | A1 | | 1/2015 | Cauley, Jr. et al. | |
| 2015/0184961 | A1 | | 7/2015 | Cantrell | |
| 2015/0219415 | A1 | | 8/2015 | Cauley, Jr. et al. | |
| 2015/0300772 | A1 | | 10/2015 | Carson | |

FOREIGN PATENT DOCUMENTS

| | | | |
|---|---|---|---|
| RO | 125923 | B1 | 11/2012 |
| WO | 2017123645 | A1 | 7/2017 |

OTHER PUBLICATIONS

Korean Intellectual Property Office; PCT Written Opinion of the International Searching Authority, Issued in Connection to PCT/US2017/013034; dated Apr. 26, 2017; 7 pages; Korea.

* cited by examiner

FIG. 18B
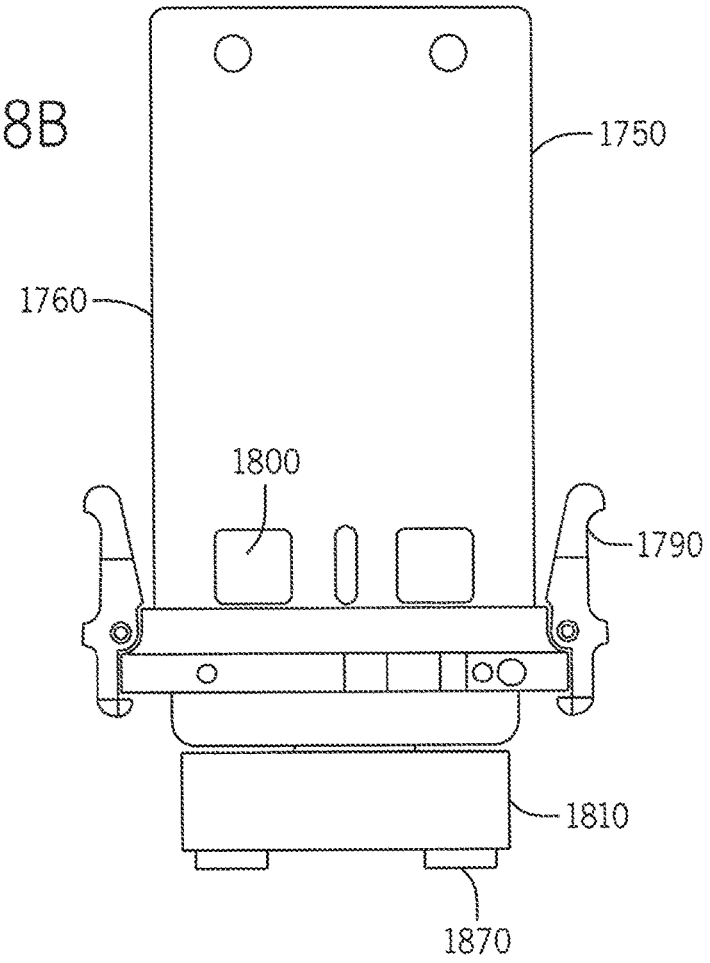
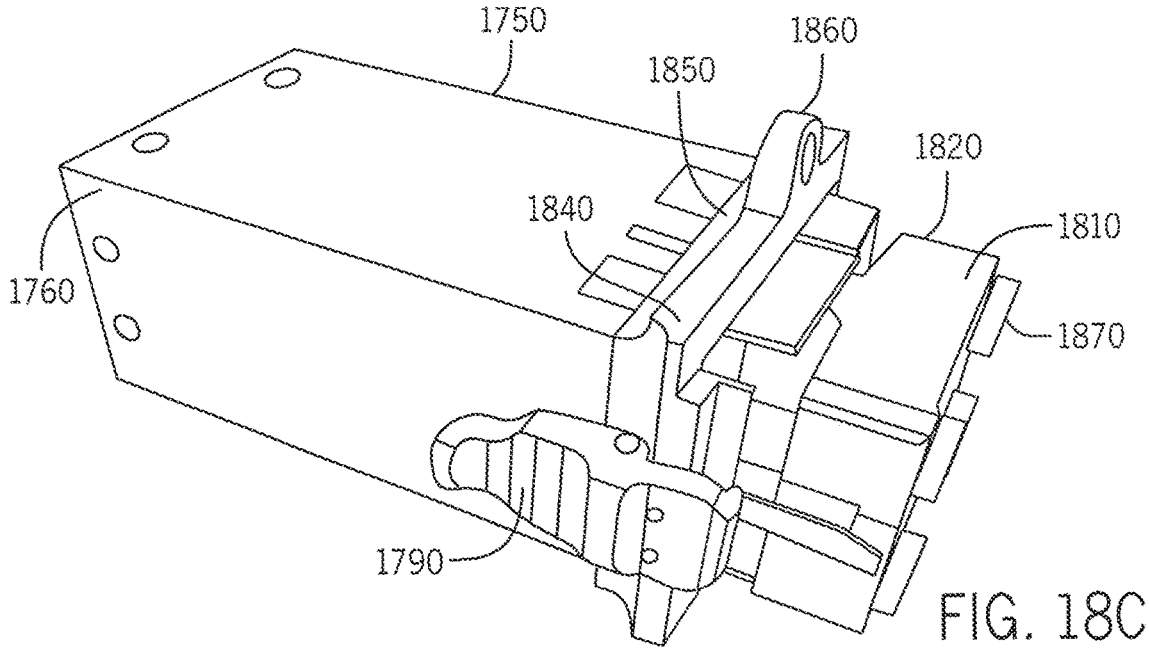
FIG. 18C

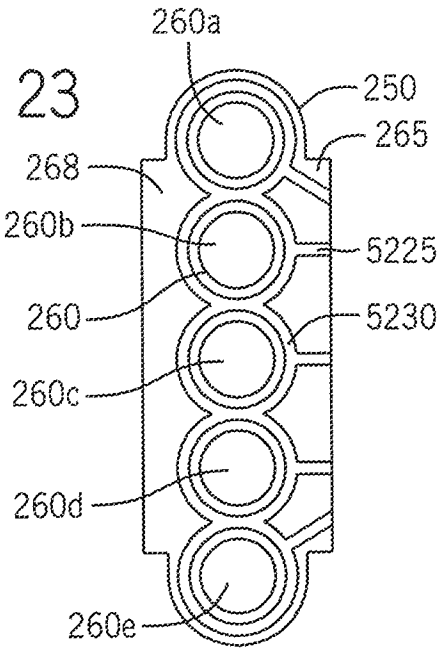
FIG. 23
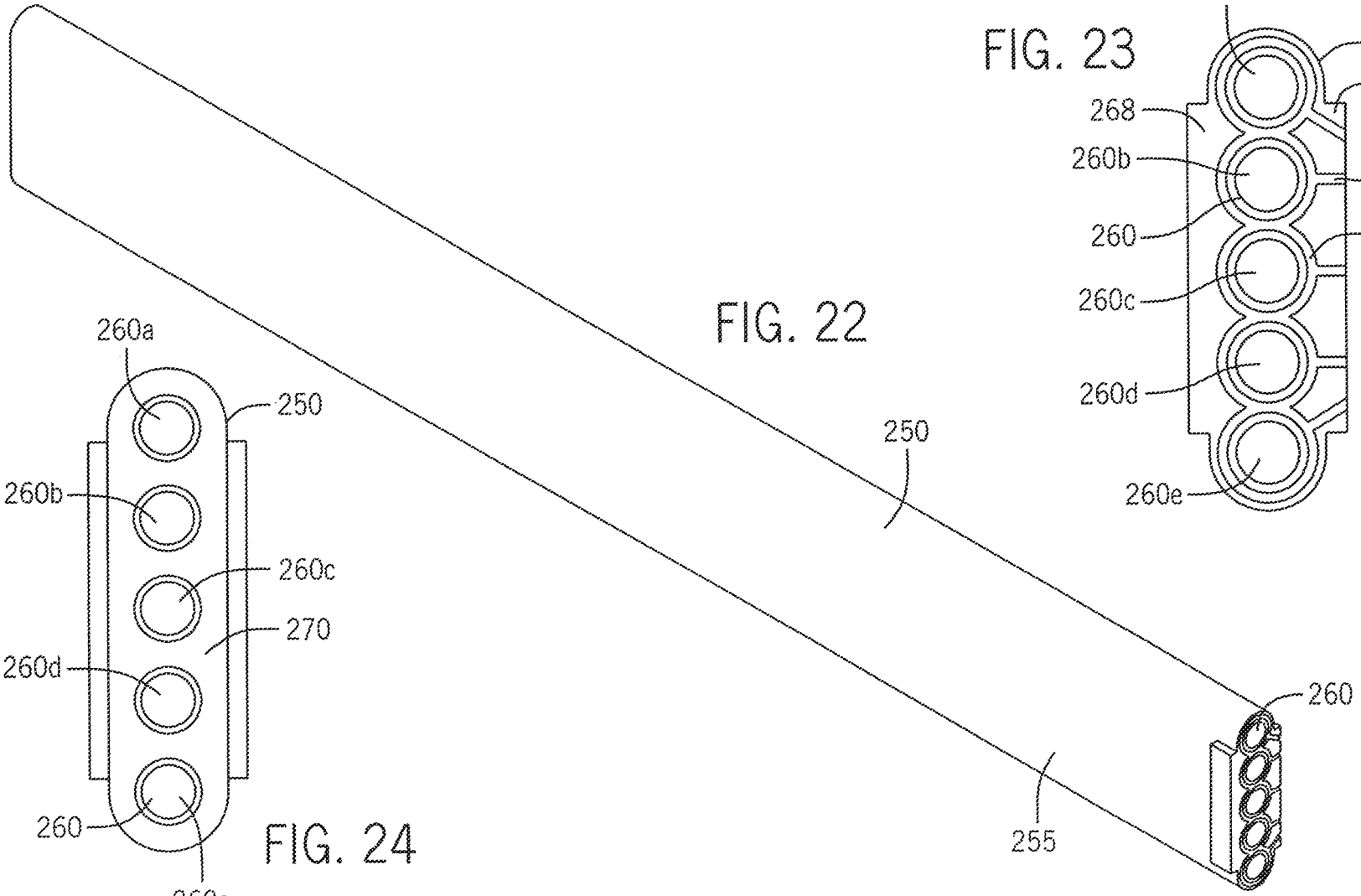
FIG. 22
FIG. 24

FIREARM SYSTEM AND METHOD

RELATED APPLICATIONS

This application is a continuation of U.S. patent application Ser. No. 14/992,713, filed on Jan. 11, 2016, and entitled "FIREARM SYSTEM AND METHOD", now issued as U.S. Pat. No. 10,060,689, the entire contents of which are incorporated herein by reference.

BACKGROUND

Firearms have historically been designed with a single-bore barrel. This has been the case due in part to technical difficulty of boring a long straight hole through a piece of hard metal, and the problem of cutting or impressing a rifling pattern on the interior of the bore without affecting the trueness of the barrel and hence its accuracy potential. The number of variables involved in those processes is so large as to render the specialized field of barrel making as much an art as a science. That situational difficulty is compounded to near impossibility in the attempt to bore a second hole in the same metal piece, if both bores are to be straight and accurately aligned. For those reasons, accurate multi-bore barrels have never been successfully manufactured.

All successful battle rifle designs, from the time of the smooth-bore matchlock until the present day, have been of the single-bore, single-barrel type. These firearms have reached a high degree of refinement after centuries of development, and share the use of cartridge ammunition, which is a useful solution to the problem of how to quickly reload a barrel for firing. Cartridge ammunition is likewise highly refined after a long development. The modern battle rifle has resulted from the combination of a single barrel designed to be loaded with cartridge ammunition from the breech, a mechanism or "action" that inserts and replaces cartridges into the barrel, and a magazine that contains numerous cartridges.

Existing rapid-fire mechanisms require considerable energy to function. A heavy steel bolt must be quickly moved against a powerful spring. Relatively long and heavy cartridges must be inserted into deep chambers, and then rapidly removed. The total motion of the bolt for each shot can be 6-8 inches or more. At the same time, a firing hammer must be cocked against its own heavy spring, and then released by another linkage. All this back and forth consumes so much energy that the modern battle rifle emerged only after the invention of the gas operating system. The gas system provides the needed energy by using high pressure gas from the bore to move a piston or other mechanism which then moves the action. While ingenious, the gas action has its own problems.

An action powered by the high pressure and extremely hot gas produced by the propellant has the force needed to power a complex action. However, that same gas is contaminated with metal vapors and particulate matter that may foul the delicate inner workings of the action. This can result in jamming and other undesirable failures that require frequent field maintenance. Furthermore, the need to clean a weapon in the heat of battle may have fatal consequences.

Cartridge ammunition requires a chamber machined into the bore at the breech end of the barrel where the interior dimensions of the chamber closely match the exterior dimensions of the cartridge type chosen for the weapon. The weapon designer must select a cartridge type with ballistic characteristics approximating the desired performance of the intended weapon design, considering both the trajectory and terminal ballistics. The weapon must then be designed to accommodate the exact physical dimensions of the cartridge, including the standardized (SAMMI) maximum pressures created by the selected cartridge. This situation in turn imposes a set of parameters under the weapon design, such as general size and weight, material selection, magazine type, action type, barrel length, firing rate and magazine capacity. These factors, and others, have led to a design convergence toward a popular basic layout of a single-bore barrel with a gas-operated action, a box magazine containing 30 cartridges or so, and .22 to .30 caliber cartridges of approximately 3,000 FPS velocity. These specifications are mostly a result of all the compromises required to achieve a practical design.

The role of cartridge ammunition in the functioning of the weapon is important in defining the limitations of a single bore design. The cartridge case not only contains propellant and other components, it also performs the critical function of sealing the breech during firing. When the propellant is ignited and pressure builds within the cartridge case, its walls are forced outward against the interior of the chamber and form an adequate seal as long as the pressure is sufficient to keep the case expanded. There is a period at the beginning and another at the end of the propellant burning cycle when the pressure is elevated but insufficient to form or maintain the seal. This results in hot gasses flowing through the action and consequent fouling. This is not a minor detail because these weapons function in a sequential progression with each step dependent upon the successful completion of the previous step. Any failure in any step brings the entire process to a halt until the cause is ascertained and corrected.

A rate of fire adequate for combat consumes significant quantities of ammunition and can quickly overheat the weapon, which can result in jamming. The effective rate of sustained fire is a very important measurement of the combat capability of a weapon in practical use. A rate of fire restricted to avoid overheating or including cooling periods may be considered to be the effective rate of fire, which over a sustained period of operation will always be less than the maximum cyclic rate of the weapon (and in most cases considerably less). Because the effective rate of sustained fire is always less than the maximum cyclic rate of the weapon, the buildup of heat is the limiting factor in combat capability. The overheating problem is an unavoidable consequence of the basic design of the single-bore cartridge ammunition weapon type, and the reasons are straightforward. Much of the intense heat produced by the combustion of the propellant passes through the cartridge case and is absorbed by the walls of the chamber. Importantly, the heat is generated on the interior of chamber and bore and must be conducted through the heavy steel walls of the chamber and barrel before it can escape. Steel is a relatively poor conductor of heat and interior surfaces can overheat before significant exterior cooling can occur.

A rapid rate of fire adds heat much more quickly than can be dissipated by conduction or convection, raising the temperature of the chamber walls. The chamber can become hot enough to ignite fresh cartridges upon entry or soon after. The pre-ignition of the cartridge (also known as "cook offs") can result in cartridge feeding problems, and unintentional discharge of the weapon. With some designs, especially high cyclic-rate types, cook-offs can occur in as few as 150 rounds.

Overheating in ordinary single bore weapons is a limiting factor and an unsolved problem. The situation remains because it is the inevitable result of the basic design. For example, friction from the projectile and hot gas flow through the bore following discharge can add more heat to the barrel. The extreme heat generated within the cartridge upon firing is absorbed by the chamber then conducted to the rest of the barrel. The faster the firing rate and the more powerful the cartridge, the worse the situation becomes. The problem is acute in the chamber where most of the heat is concentrated. The chamber walls must be extra thick to maintain integrity when hot, and active cooling is not effective when heat is added more rapidly than it can be conducted away. Further, the size, weight and complexity penalties of active cooling are not worth the results for light arms. Moreover, the high heat loads in the chamber of a single bore, sequential feeding cartridge ammunition firearm inevitably affects the functioning of the action. A chamber can become hot enough for the softer metal of a cartridge case to melt and adhere to the chamber wall, jamming the firearm.

In the attempt to improve the effective rate of sustained fire and address some of those issues, multi-barrel firearms have been designed and built by Gatling, General Electric and others. A set of parallel barrels with conventional integral chambers, fastened together and rotated (in modern designs by an electric motor) around a central axis, are fed with cartridge ammunition by a complex mechanism. Each barrel fires in its turn and not again until all the others have fired, thus dividing the duty cycle of each barrel by the number of barrels. The mechanism performs the loading, firing, and unloading operations in different barrels simultaneously as the set rotates. Misfires or defective ammunition can process through the system normally and not cause a stoppage. Such an arrangement improves the rate of sustained fire by integrating the firepower and ammunition capacity of several automatic firearms together into a single machine. Also integrated are much of the size, weight and complexity of those several firearms, a large heavy magazine, as well as the additional weight and complexity of the electric drive and control systems and their associated power supply.

A multi-bore firearm, with several bores within a single barrel, could potentially exhibit many of advantages of a multi-barrel design, while reducing the size, weight and complexity disadvantages. Moreover, a multi-bore firearm with a single, fixed barrel containing bores that are precisely and permanently aligned to one another would eliminate accuracy challenges arising from the difficulty of achieving and maintaining he alignment of multiple moving barrels to each other and to the gunsights; from non-uniform warpage of the various use-heated barrels; from the centripetal forces acting on the barrels at their mounting points in a direction perpendicular to their axes; and from the angular momentum conserved by a projectile exiting a rotating system. Multi-barrel systems are considered very accurate if the projectile dispersion angle is in the range of 5-8 mils., while a multi-bore system has shown a dispersion angle of <1 mil in field testing of a non-optimized prototype.

A firing pin and miniature electromagnetic striker for each charge with overall electronic fire control eliminates the need for a heavy and complex mechanical firing system, while the use of charge blocks eliminates the need for cartridge ammunition and the necessary integral chambers and heavy reciprocating action. Hot charge blocks are ejected once exhausted, removing excess heat from the firearm. The total heat load of the barrel is divided among the multiple bores, reducing wear and facilitating cooling. Without integral chambers or the need to load cartridge ammunition, barrel heat does not affect the function of a charge block firearm, preventing cook-offs and allowing for near-continuous operation.

The energy required to activate the miniature electromagnetic strikers, camshaft actuator and electronic fire control circuits is low enough to permit the use of a lightweight onboard power supply sufficient to allow extended operations, many thousands of discharges and energy to operate various electronic firearm accessories.

Cartridge ammunition must be loaded into magazines before it can be used in self-loading firearms. Long term storage of cartridges in magazines is not recommended as this can weaken the magazine spring, and allow the accumulation of foreign matter in the magazine, which cannot be effectively sealed. In order to have the ability to quickly reload the firearm, an operator typically pre-loads by hand numerous magazines to carry along with the firearm. Many also carry a container of loose cartridges to reload the magazines, if necessary. To exchange an exhausted or partly exhausted magazine, an operator must handle both if he wishes to reload the ejected magazine later. Charge block ammunition does not require a magazine for transportation or storage. Charge blocks can easily snap together to form stacks that may be carried as is. The magazine can remain attached to the firearm and be refilled at any point by retracting the load knob and inserting fresh charge blocks through the ejection port. An empty or partially empty magazine can be quickly refilled with a pre-assembled stack of the correct size; if a partial refill, any extras can be snapped off. Individual charge blocks may be loaded by the same method. Release the load knob and the firearm is in the ready condition. Charge blocks are sealed units and may be transported or stored indefinitely either individually or in stacks.

SUMMARY

Some embodiments of the invention include a firearm system comprising a receiver complex including a receiver coupled to a forward receiver, a feed port positioned between the receiver and the forward receiver, and a striker coil assembly positioned proximate the receiver including a plurality of strikers extending at least partially through a coil, and a barrel coupled to the forward receiver forming a breech.

In some embodiments, the firearm system includes a breech that comprises a plurality of side-by-side bores. Some embodiments include a barrel that comprises a plurality of side-by-side bores. In some embodiments, the barrel is interchangeable and comprises five side-by-side bores.

Some embodiments include a firearm system comprising a magazine coupled to the receiver complex adjacent the feedport. Further, the magazine is configured and arranged to simultaneously feed more than one dischargeable projectile into the feedport. In some embodiments, the magazine comprises at least one charge block comprising a plurality of dischargeable projectiles. In some embodiments, the charge block comprises five projectiles. In some embodiments of the invention, the charge block comprises a plurality of chambers, where each of the chambers are configured and arranged to house a unit of ammunition.

In some embodiments, the firearm system further comprises an action cam positioned in the receiver. The action cam comprises a single lobe extending the length of the cam, a plurality of firing pin clearance cuts, and at least one timing pin or lobe.

In some embodiments, the firearm system further comprises a recoil shield comprising a plurality of firing pin holes and positioned in the receiver and coupled to the action cam. Further, the firearm system further comprises a plurality of firing pins, wherein at least one of the plurality of firing pins is positioned at least partially within at least one of the plurality of firing pin clearance cuts. In some embodiments, least one of the plurality of firing pins extends through at least one of the plurality of firing pin holes.

Some embodiments include a firearm receiver comprising a receiver coupled to a forward receiver, a feed port positioned between the receiver and the forward receiver, and an action cam positioned in the receiver. The action cam comprises a single lobe extending the length of the cam and a plurality of firing pin clearance cuts. Further, the firearm receiver comprises a recoil shield positioned in the receiver and coupled to the action cam. The recoil shield comprises a plurality of firing pin holes. Further, the firearm receiver comprises a breech comprising a plurality of bores extending through a barrel.

In some further embodiments, the firearm receiver comprises a striker coil assembly positioned in the receiver complex proximate the receiver. The striker coil assembly includes a plurality of strikers each extending at least partially through a coil. In some other embodiments, the firearm receiver comprises a plurality of firing pins, where at least one of the plurality of firing pins is positioned at least partially within at least one of the plurality of firing pin clearance cuts. In some embodiments, at least one of the plurality of firing pins is positioned at least partially within at least one of the plurality of firing pin holes. In other embodiments, at least one of the plurality of strikers is positioned in alignment with at least one of the plurality of firing pins.

Some embodiments include a firearm system assembly method comprising providing a receiver complex comprising a receiver and a forward receiver, forming a feed port positioned between the receiver and the forward receiver, and forming a barrel comprising a plurality of substantially parallel bores. Further, the method includes coupling the barrel to the forward receiver and forming a breech including the plurality of bores. The method includes providing an action cam comprising a single lobe extending the length of the cam and a plurality of firing pin clearance cuts. The method further includes positioning the action cam in the receiver and coupling to a recoil shield, where the recoil shield comprises a plurality of firing pin holes. The method further includes providing a plurality of firing pins, where at least one of the plurality of firing pins is positioned at least partially within at least one of the plurality of firing pin clearance cuts and at least one of the plurality of firing pin holes. The method further includes assembling a striker coil assembly proximate the receiver. The striker coil assembly includes a plurality of strikers each extending through a coil, where at least one of the plurality of strikers is positioned in alignment with at least one of the plurality of firing pins.

In some embodiments, the method further comprises coupling a magazine to the receiver complex adjacent the feedport, where the magazine is configured and arranged to substantially simultaneously feed more than one dischargeable projectile into the feedport by feeding a single charge block comprising a plurality of projectiles.

Some other embodiments include a firearm ammunition assembly comprising a first charge block including a projectile end and a primer end, where the charge block includes a plurality of chambers extending from the projectile end to the primer end. The assembly comprises at least one of a guide rail slot and a feed groove, at least one castellation configured to couple the first charge block with a second charge block, and a plurality of projectiles positioned within the plurality of chambers.

In some further embodiments, the ammunition assembly includes a plurality of chambers that are substantially aligned along an axis positioned substantially perpendicular to an axis along which the first charge block is configured to be fed into a firearm.

DESCRIPTION OF THE DRAWINGS

FIG. 18B illustrates a side view of a magazine in accordance with some embodiments of the invention.

FIG. 18C illustrates a perspective view of a magazine in accordance with some embodiments of the invention.

FIG. 22 illustrates a barrel of the firearm system in accordance with some embodiments of the invention.

FIG. 23 illustrates a breech of the barrel of FIG. 22 in accordance with some embodiments of the invention.

FIG. 24 illustrates an end of the barrel of FIG. 22 including a muzzle in accordance with some embodiments of the invention.

DETAILED DESCRIPTION

Figure 1:
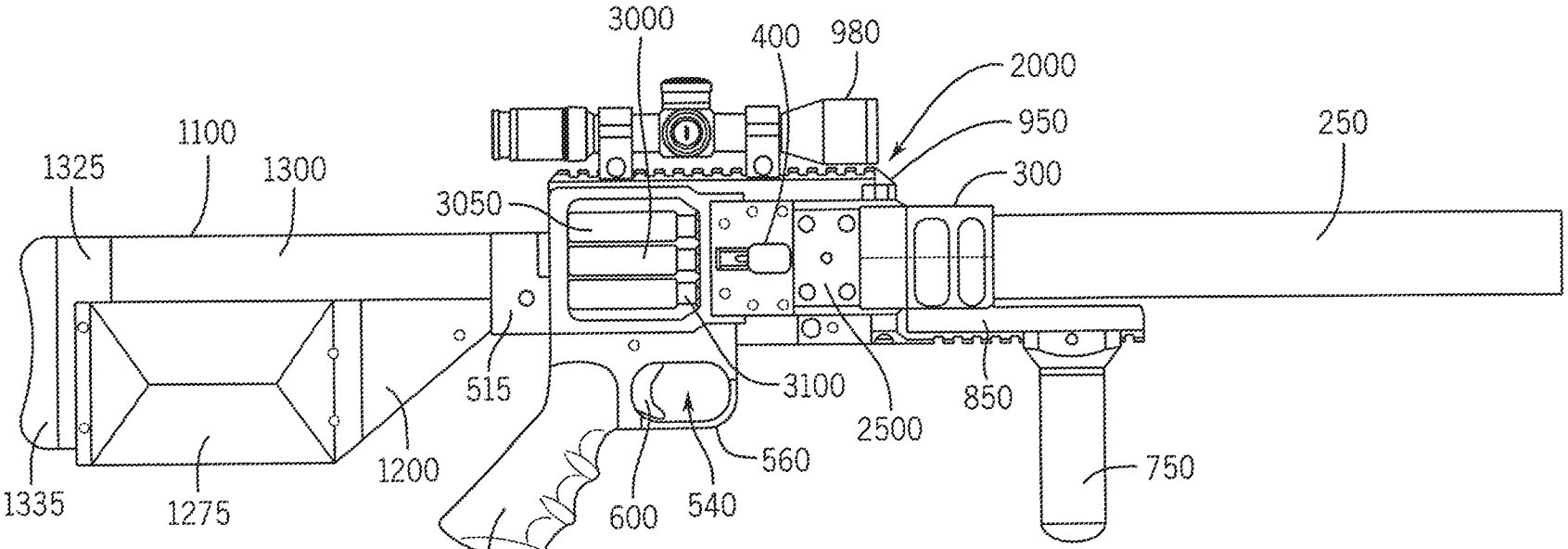
FIG. 1 illustrates a side view of a firearm system in accordance with some embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives that fall within the scope of embodiments of the invention.

Figure 2:
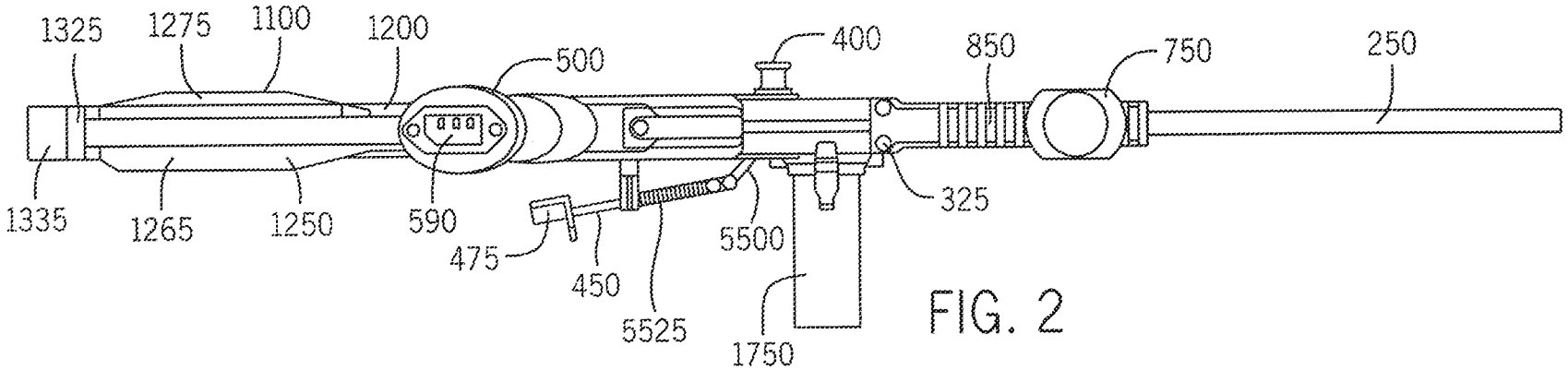
FIG. 2 illustrates a bottom view of a firearm system in accordance with some embodiments of the invention.
Figure 3:
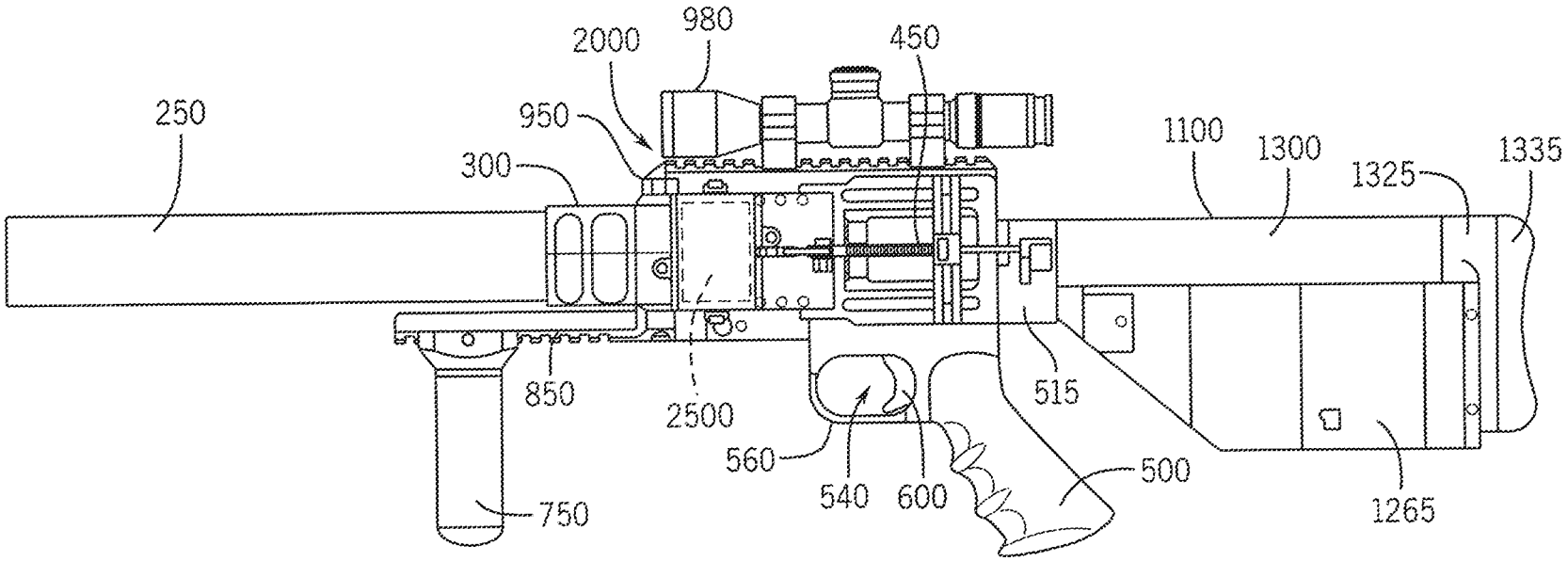
FIG. 3 illustrates side view opposite to the side view shown in FIG. 1 in accordance with some embodiments of the invention.

FIGS. 1-3 illustrate several representative views of a firearm system 10 in accordance with various embodiments of the invention. As shown, the firearm system 10 can comprise numerous components, assemblies and sub-assemblies including components dedicated to loading ammunition, and components dedicated to discharging the loaded ammunition under the control of an operator. Most of the major components of the firearm system 10 are modular and therefore can be readily interchanged. This interchangeability and modularity can enable operators to customize the firearm system 10 for various specific tactical environments. More specifically, FIG. 1 illustrates a side view of a firearm system 10, FIG. 2 illustrates a bottom view of a firearm system 10, and FIG. 3 illustrates side view opposite to the side view shown in FIG. 1 in accordance with some embodiments of the invention. In some embodiments, the firearm system 10 can comprise a receiver complex 2000 that comprises a receiver 4000 coupled to and integrated with a receiver annex 5000. At the rear end (operator end) of the firearm system 10, a buttstock 1100 can be coupled to the receiver complex 2000 using a buttstock adapter 515 coupled to the receiver annex 5000. At the opposite end (the front end) of the firearm system 10 (i.e., extending away from the operator at the rear end) the firearm system 10 can include an interchangeable barrel 250 coupled to a forward receiver 300 coupled with at least one shoulder bolt 325, which is coupled to and integrated with the receiver 4000.

Beginning from the rear of the firearm system 10, the buttstock 1100 can be used primarily to support the firearm system 10 during use. The buttstock 1100 can also provide a convenient and mechanically robust location to house various components of the firearm system 10. For example, in some embodiments of the invention, the firearm system 10 can comprise an onboard power source such as a conventional battery (not shown). In some embodiments, a battery housing stock tube 1300 can be used to store at least one battery for providing power to at least a portion of the firearm system 10. As shown in FIGS. 1 and 3, in some embodiments, the battery housing stock tube 1300 can extend from a buttstock adapter 515 at one end of the firearm system 10 generally parallel with the barrel 250 at the other end of the firearm system 10.

In some embodiments, the battery housing stock tube 1300 can be positioned between the buttstock adapter 515 and the end of the buttstock 1100 comprising a butt plate 1325 coupled to a butt pad 1335. The butt plate 1325 coupled to a butt pad 1335 can serve to cover sensitive portions of the firearm system 10, while providing a contoured shape for comfortable and safe handling of the firearm system 10. In some embodiments of the invention, the battery housing stock tube 1300 can be coupled to an electronic chassis 1200.

In some embodiments of the invention, the electronic chassis 1200 can support and house various electronics and control circuits used for operating and controlling the firearm system 10. In some embodiments, the electronic chassis 1200 can extend from the buttstock adapter 515 bounded by the battery housing stock tube 1300 on one side and the butt plate 1325 and butt pad 1335 on the opposite side. In some embodiments, the buttstock 1100 can include an electronics bay 1250 supported by the electronic chassis 1200, with electronic bay removeable cover 1265 on one side of the buttstock 1100, and a driver cover 1275 on the opposite side of the firearm system 10.

Some embodiments of the invention include various mechanical and electro-mechanical components to enable an operator to control the firearm system 10. In some embodiments, the operator can interface with and actuate one or more mechanical and electro-mechanical components to discharge ammunition from the firearm system 10. For example, in some embodiments of the invention, the firearm system 10 can be configured to discharge ammunition using an electro-mechanical trigger 600. As shown in at least FIGS. 1 and 3, in some embodiments, the firearm system 10 can include a trigger 600 coupled to and extending from the receiver complex 2000. For example, in some embodiments of the invention, the trigger 600 can be positioned below the receiver complex 2000 proximate the receiver annex 5000. In order for an operator to support, aim, and maintain control of the firearm system 10, some embodiments include an interchangeable pistol grip. For example, in some embodiments, a pistol grip 500 can be positioned proximate the receiver annex 5000, and positioned coupled to and extending from the trigger 600 via the trigger housing 545. In some embodiments, an operator can exchange the pistol grip 500 (e.g., to customize the size and shape of the pistol grip 500 based on size requirements of the operator, or the field of use of the firearm system 10). In some embodiments, the pistol grip 500 can be customized to the operator. For example, in some embodiments, the pistol grip 500 can comprise one or more contours for engaging the operator's hand and fingers.

In some embodiments of the invention, the firearm system 10 can comprise various supports and coupling points for various adjustable modular components and accessories. For example, in some embodiments, the firearm system 10 can comprise a forestock Picatinny rail 850 that can be used to mount various accessories, including, but not limited to weapon lights, laser range finders, vision optics, scopes, and cameras, etc. As illustrated in FIGS. 1 and 3, in some embodiments, the forestock Picatinny rail 850 can be mounted to the receiver complex 2000. In some embodiments of the invention, the forestock Picatinny rail 850 can be coupled to the receiver complex 2000 extending proximate the forward receiver 300 along at least a partial length of the barrel 250. Further, in some embodiments, a forward grip 750 can be coupled to the forestock Picatinny rail 850. In some embodiments, the forward grip 750 can be used to handle and transport the firearm system 10, and to enable a user to grip and stabilize the firearm system 10 during use.

Figure 4:
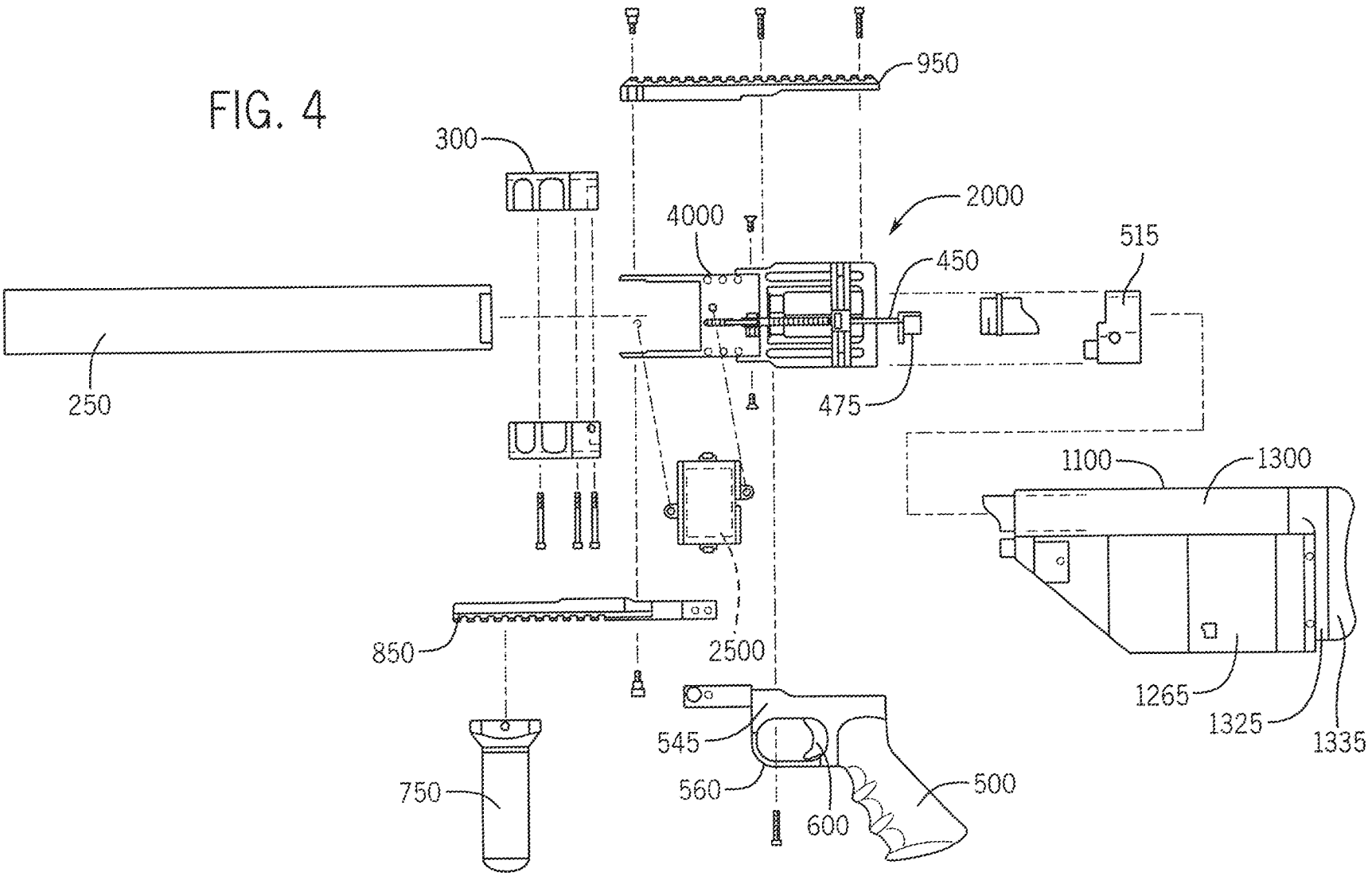
FIG. 4 illustrates an exploded assembly view of a firearm system in accordance with some embodiments of the invention.

Referring also to FIG. 4, illustrating an exploded assembly view of a firearm system 10 in accordance with some embodiments of the invention, the forestock Picatinny rail 850 can be configured to be easily removed from the firearm system 10 to enable access to various components of the firearm system 10, to enable rapid disassembly of the firearm system 10, and/or to enable attachment and removal of accessories. For example, in some embodiments, the forestock Picatinny rail 850 can be assembled using at least one attachment component such as a conventional screw or bolt, or other conventional fastening assembly.

Some embodiments of the invention can include an optics rail 950 that can be used to support or mount various accessories of the firearm system 10. In some embodiments, the optics rail 950 can include various attachment points for coupled components, including, but not limited to attachments for lighting, range finding, scoping and viewing, and recording. For example, in some embodiments, the optics rail 950 can be used to mount various accessories such as weapon lights, illuminators, laser range finders, optical scopes, digital scopes, cameras, video recorders, etc. For example, as illustrated in at least FIGS. 1 and 3, in some embodiments, at least one optics assembly 980 can be coupled to the firearm system 10 using the optics rail 950. In some embodiments, one or more adapters can be used to couple the optics assembly 980 to the optics rail 950. In some embodiments of the invention, the optics rail 950 can be mounted to the receiver complex 2000. As illustrated in FIGS. 1 and 3, in some embodiments, the optics rail 950 can be coupled to the receiver complex 2000 extending from the receiver annex 5000 to proximate the forward receiver 300. Referring also to FIG. 4, illustrating an exploded assembly view of the firearm system 10 in accordance with some embodiments of the invention, in some embodiments, the optics rail 950 can be assembled using a plurality of attachment components such as conventional screws or bolts. Further, in some embodiments, the optics rail 950 can be configured to be easily removed from the firearm system 10 by an operator. For example, in some embodiments, the optics rail 950 can be removed from the firearm system 10 to enable access to various components of the firearm system 10, to enable rapid disassembly of the firearm system 10, and/or to enable attachment and removal of accessories. In some embodiments, the optics rail 950 can be used to support, mount, grasp, and/or handle the firearm system 10. In some embodiments, the optics rail 950 can include various attachments or coupled components, including, but not limited to attachments for grasping or supporting the firearm system 10.

Figure 5:
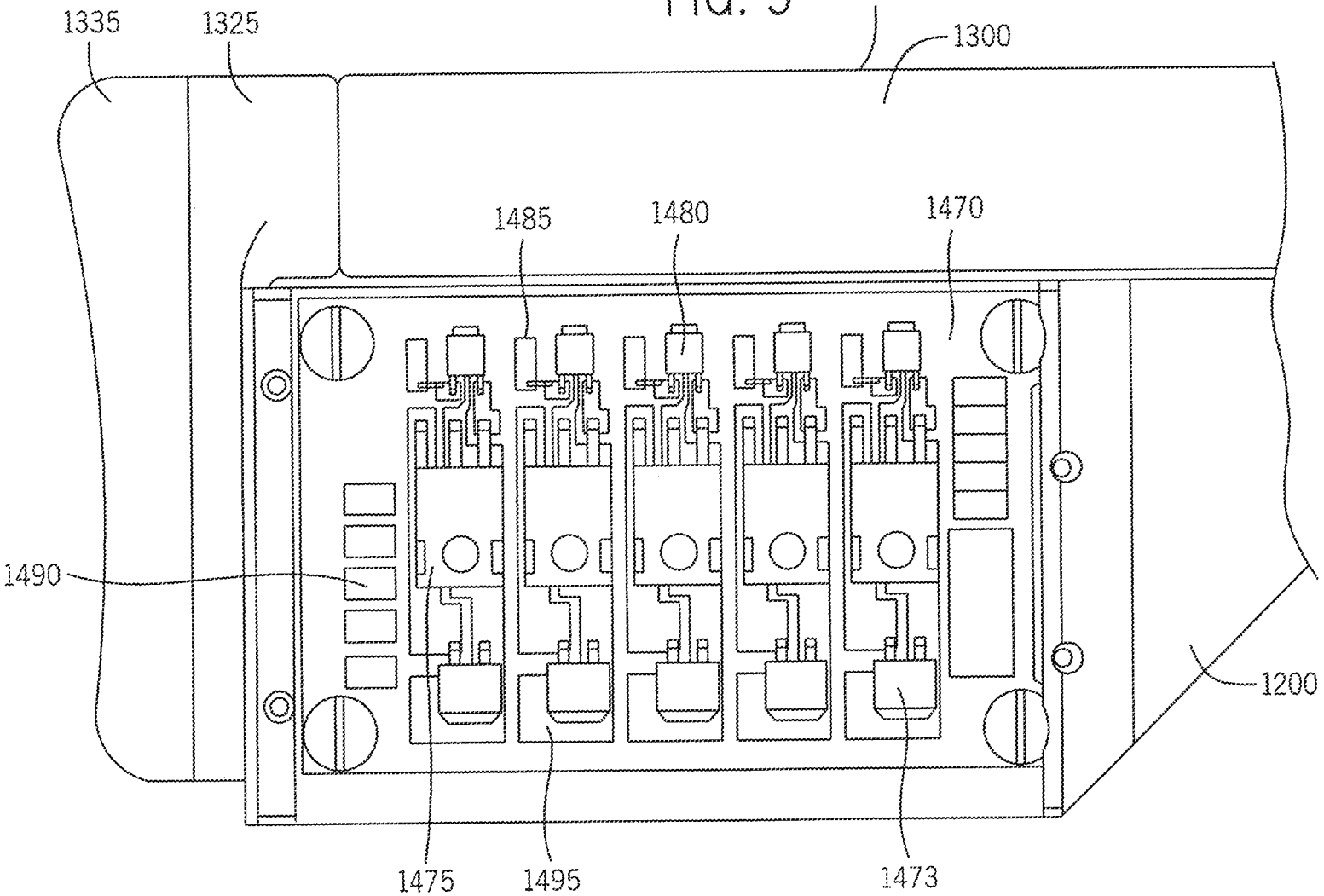
FIG. 5 illustrates an internal side view of a buttstock of the firearm system shown in FIGS. 1-3 showing a close-up of a driver board in accordance with some embodiments of the invention.

In some embodiments of the invention, the firearm system 10 can include electronics and control circuits used for controlling the firearm system 10. For example, FIG. 5 illustrates an internal side view of a buttstock 1100 of the firearm system 10 shown in FIGS. 1-3 showing a close-up of a driver board 1470 in accordance with some embodiments of the invention. In some embodiments, the driver board 1470 can be secured with the electronics chassis 1200 using any conventional mechanisms include screws, clips, rivets, and/or quick-release latches. In some embodiments, the driver board 1470 is mounted for rapid replacement and/or swap-out during use. For example, in some embodiments, the driver board 1470 can comprise a replaceable driver board 1470 that can be rapidly swapped with a new or used driver board 1470 in the field. In some embodiments, power can be provided to the driver board 1470 through a power connection to the power port 590. In some other embodiments, power can be provided by an onboard battery positioned in the battery housing stock tube 1300.

With the driver cover 1275 removed, the various functional components of the driver board 1470 supported in the electronics chassis 1200 can be viewed, shown surrounded by the various components of the buttstock 1100, including the battery housing stock tube 1300, the butt plate 1325, and the butt pad 1335. In some embodiments, the driver board 1470 can comprise inputs 1485 and outputs 1490 into various components of the driver board 1470. In some embodiments, the driver board 1470 can include ultra-fast diodes 1473, coupled to drive transistors 1475, Darlington transistors 1480, and driver electrodes 1495. In some embodiments, driver board 1470 can control various functions of the firearm system 10 based at least in part on an operator's input (e.g., input through the trigger 600). For example, in some embodiments, the driver board 1470 can control current from at least one power source (e.g., a battery positioned in the battery housing stock tube 1300) to at least one striker coil 3050 in the striker coil assembly 3000.

Figure 6:
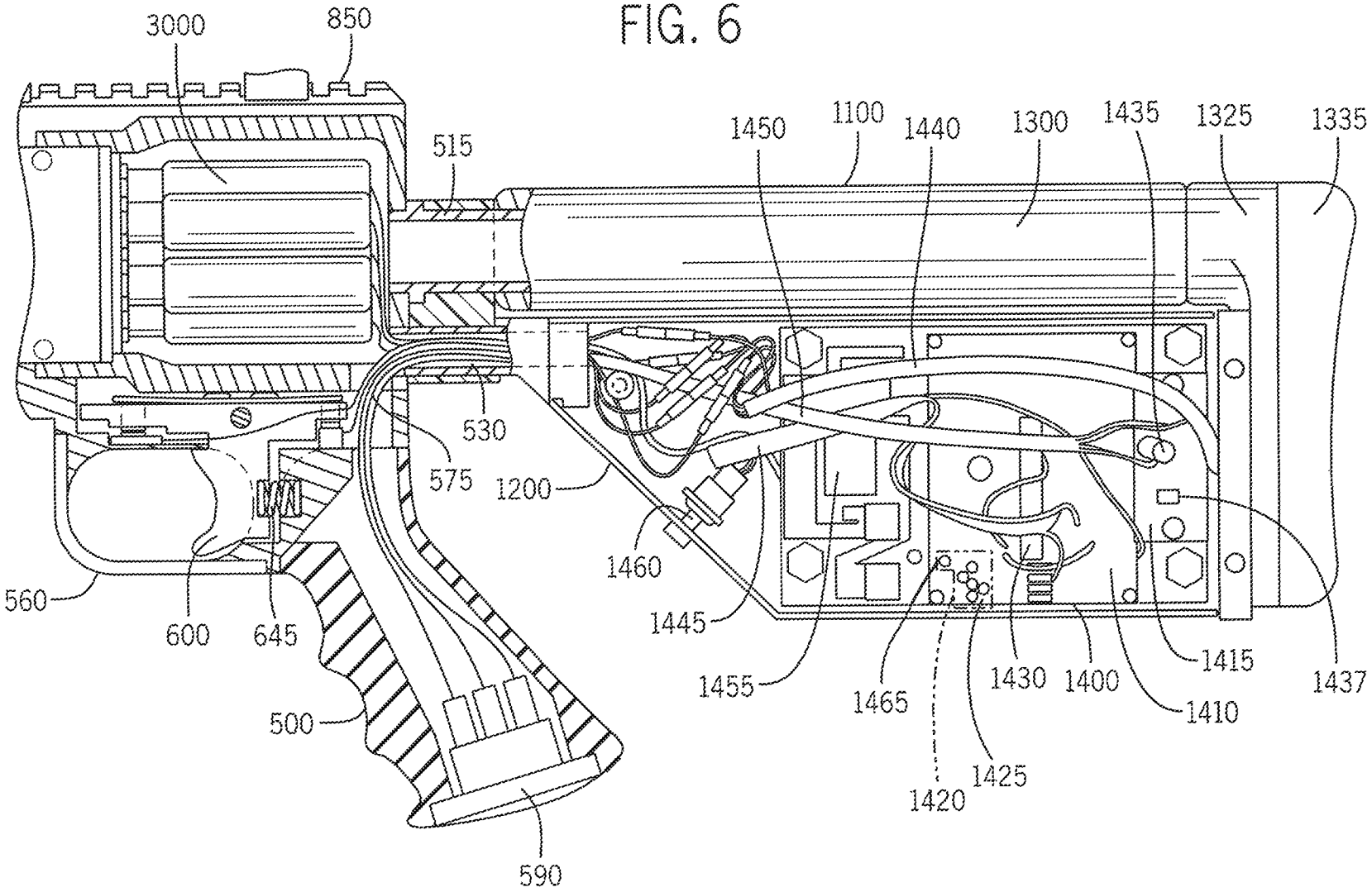
FIG. 6 illustrates a side view of a rear portion of the firearm system of FIGS. 1-3 including an internal view of the buttstock from an opposite side than shown in FIG. 5 showing a close-up of a trigger board in accordance with some embodiments of the invention.

In some embodiments of the invention, the driver board 1470 can couple with at least one trigger control system to control operation and discharge of the firearm system 10. With the electronic bay removable cover 1265 removed, various functional components of the trigger board 1410 can be viewed. For example, FIG. 6 illustrates a side view of a rear portion of the firearm system 10 of FIGS. 1-3 including an internal view of the buttstock 1100 from an opposite side than shown in FIG. 5, and shows a close-up of a trigger board 1410 in accordance with some further embodiments of the invention. The trigger board 1410 is shown supported in the electronics chassis 1200 positioned on the left side of the firearm system 10, and surrounded by the various components of the buttstock 1100, including the battery housing stock tube 1300, the butt plate 1325, and the butt pad 1335. In some embodiments, the trigger board 1410 can be coupled or mounted to a circuit board mounting chassis 1400 that can be supported in the electronic chassis 1200. In some embodiments, power can be provided to the trigger board 1410 through a power connection to the power port 590. In some other embodiments, power can be provided by an onboard battery positioned in the battery housing stock tube 1300.

Some embodiments of the invention include a trigger board 1410 that can comprise control circuitry that can respond to or sense a mechanical actuation of the trigger 600. In some embodiments of the invention, the trigger board 1410 can sense actuation of the trigger 600, and can generate at least one signal or pulse to discharge at least a portion of the firearm system 10. In some embodiments, the trigger board 1410 can be secured to the circuit board mounting chassis 1400 within the electronics chassis 1200 using any conventional mechanisms include screws, clips, rivets, and/or quick-release latches. In some embodiments, the trigger board 1410 can be mounted for rapid replacement and/or swap-out or repair during use. For example, in some embodiments, the trigger board 1410 can comprise a replaceable trigger board 1410 that can be rapidly swapped with a new or used trigger board 1410 in the field.

In some embodiments, the trigger board 1410 can comprise at least one logic chip (sequencer) 1430, and at least one solid state relay 1455. The trigger capacitor 1435 and power supply 1437 are shown mounted on the trigger board front end 1415, with ribbon cable to trigger 1450, and coil harness 1440. In some embodiments, the trigger board 1410 can control operation of the firearm system 10 based on the position of and/or an actuation of the trigger 600. In some embodiments of the invention, the use of at least one optoisolator (not shown) can enable the firearm system 10 to operate safely by optically isolating portions of the trigger board 1410 (e.g., the trigger circuit) from the rest of the circuitry. In this instance, spurious or random electrical pulses that may trigger an unwanted or unplanned actuation of the striker coil assembly 3000 can be avoided.

Other electrical interconnections are shown including ribbon cable to drivers 1445. In some embodiments, at least one operational aspect of the firearm system 10 can be optically communicated to an operator. For example, in some embodiments, annunciators 1425 can be illuminated based on one or more functions of the firearm system 10, and an annunciator window 1420 can enable a user to view the annunciators 1425. In some embodiments, the firearm system 10 can also include a ready light 1465 viewable by an operator, that can be configured to light based on the operational readiness of the firearm system 10. In some embodiments, the firearm system 10 can comprise a reset button 1460 (shown extending through the circuit board mounting chassis 1400). In some embodiments, at least one controller and/or function of the firearm system 10 can be reset using the reset button 1460.

Figure 7:
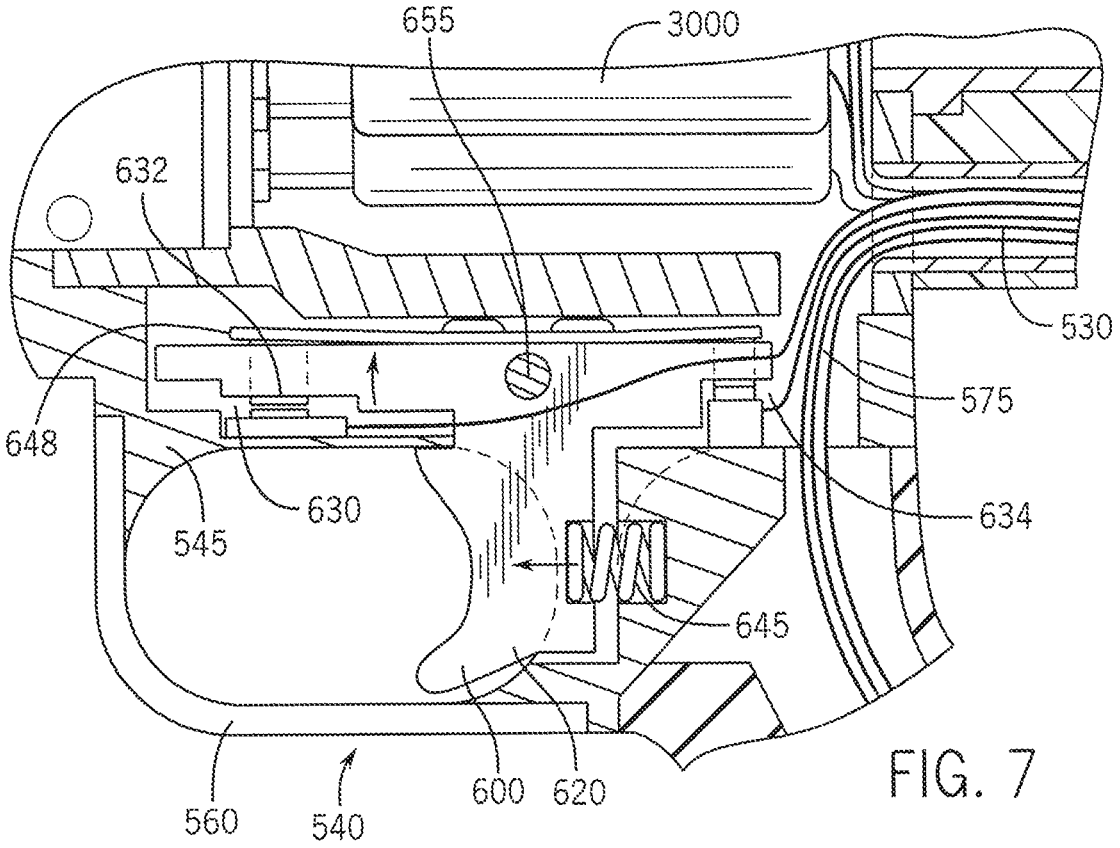
FIG. 7 illustrates a trigger region view of a firearm system in accordance with some embodiments of the invention.
Figure 8:
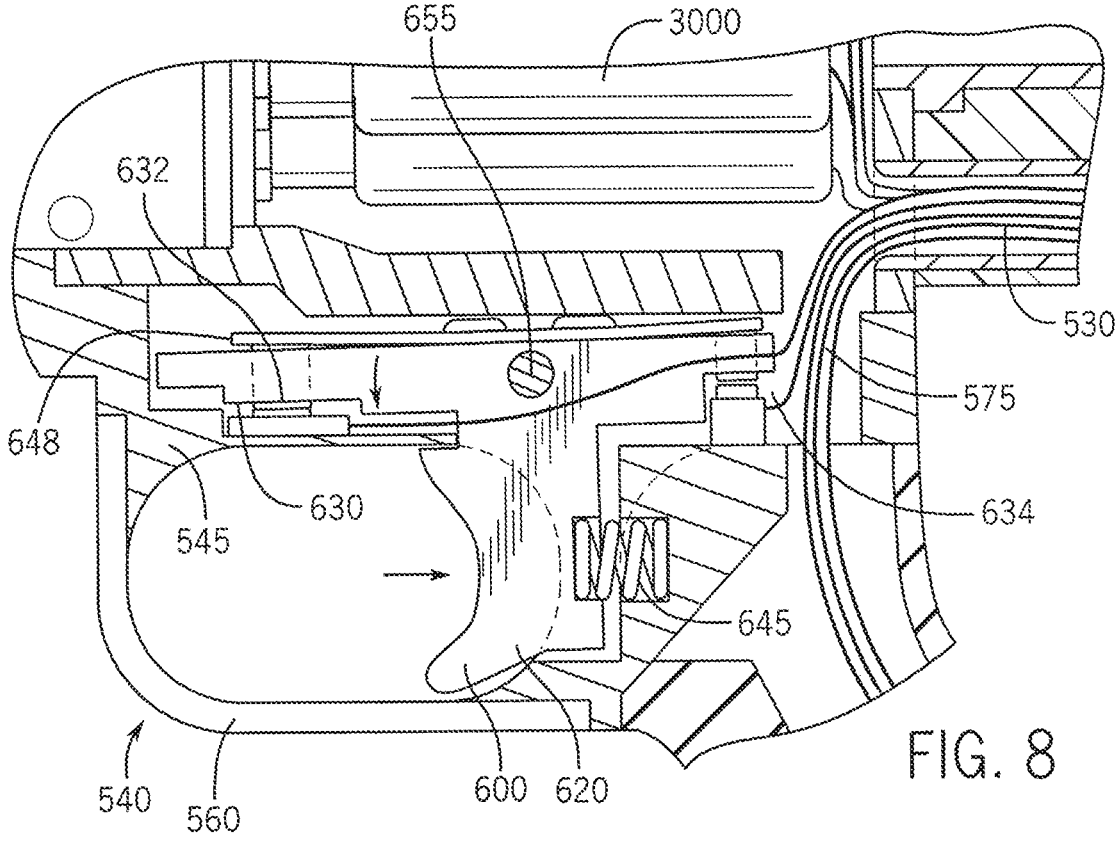
FIG. 8 illustrates a trigger region view of a firearm system illustrating a trigger pull in accordance with some embodiments of the invention.

In some embodiments of the invention, the firearm system 10 can be discharged by an operator using a trigger mechanism. FIG. 7 illustrates a trigger region view of a firearm system 10 in accordance with some embodiments of the invention, and FIG. 8 illustrates a trigger region view of a firearm system 10 illustrating a trigger pull in accordance with some embodiments of the invention. In some embodiments, the firearm system 10 can comprise a trigger assembly 540 including a trigger 600 that can be actuated by an operator to discharge the firearm system 10. In some embodiments, the trigger assembly 540 can comprise a trigger housing 545 including a trigger guard 560 that can at least partially surround the trigger body 620 of the trigger 600. The trigger guard 560 can prevent unwanted or unintended actuation of the trigger 600.

In some embodiments, the trigger 600 can be actuated by an operator to discharge the firearm system 10 using a trigger contact assembly 630. In some embodiments, when an operator pulls the trigger 600 (e.g., by moving the trigger body 620 at least a partial distance towards the pistol grip 500), the trigger body 620 can pivot on the trigger pivot bolt 655, and move the various trigger components of the trigger contact assembly 630 to a closed position (illustrated in FIG. 8). In this instance, the first trigger contact 632 is closed, and a second trigger contact 634 is opened with movement at least partially governed by a force limiting duplex leaf 648. In some embodiments, this actuation is sensed by the trigger board 1410 through electrical connections from the trigger contact assembly 630 through the harness conduit 530, that also provides a passageway for the harness 575 coupled through to the power port 590. In some embodiments, when the trigger 600 is pulled, the trigger rebound spring 645 can compress, and can store potential energy for later release of the trigger 600 when the firearm system 10 has discharged and/or when the operator releases the trigger body 620.

Referring to FIG. 7, when the operator ceases to apply force to the trigger body 620, the trigger rebound spring 645 can expand (shown represented in FIG. 7), and can apply a force to the trigger body 620 to move the trigger body 620 back towards the front of the firearm system 10. As the trigger body 620 moves (e.g., away from the pistol grip 500), the trigger body 620 can pivot on the trigger pivot bolt 655, and move the trigger contact assembly 630 to an open position (shown in FIG. 7). In this instance, the first trigger contact 632 is opened and a second trigger contact 634 is closed with movement at least partially governed by a force limiting duplex leaf 648 and the trigger rebound spring 645.

Figure 9A:
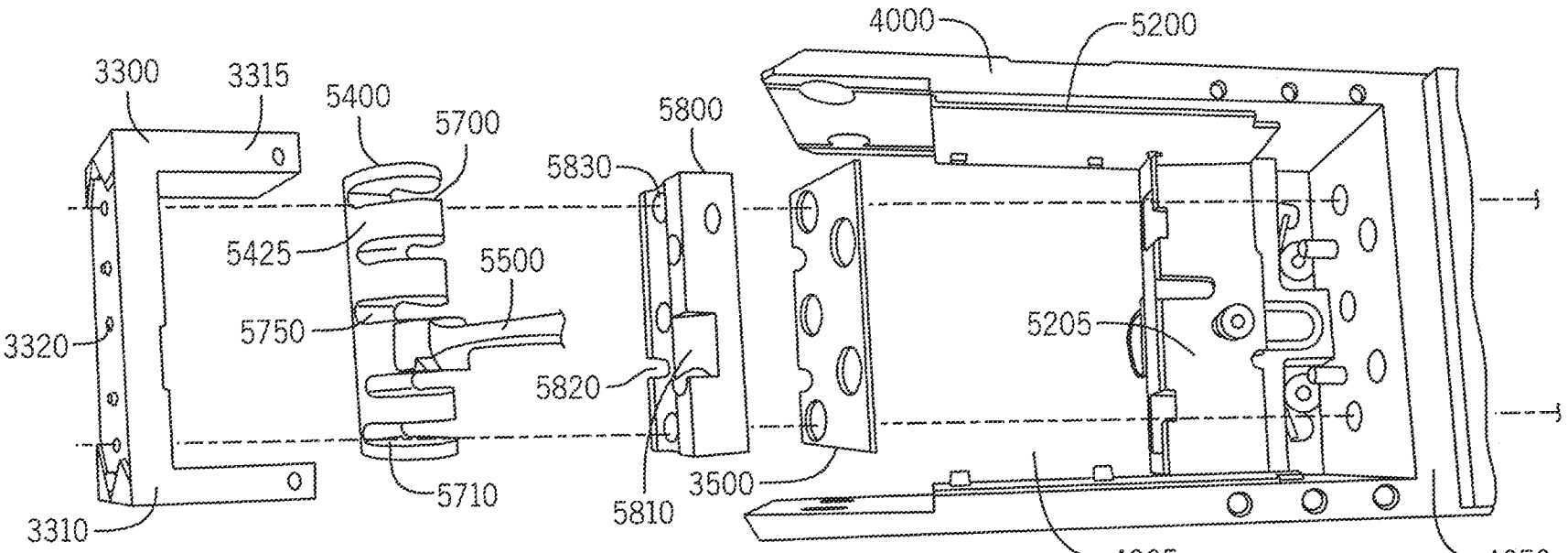
FIG. 9A illustrates an exploded assembly view of a main receiver frame and action in accordance with some embodiments of the invention.

FIG. 9A illustrates an exploded assembly view of a receiver 4000 and action in accordance with some embodiments of the invention. In some embodiments of the invention, the receiver complex 2000 of the firearm system 10 can include a receiver 4000 comprising a receiver body 4025 that can house miscellaneous components for facilitating loading of ammunition into the firearm system 10 and facilitating discharge of the ammunition. For example, the receiver 4000 can house a feed control carriage 5200 that can be positioned in and out of a loading position within the inner region 4005 of the receiver 4000 to facilitate loading and unloading of ammunition and/or ammunition assemblies. Some embodiments of the invention include at least one bushing 5800 and at least one headspace shim 3500 that can be assembled into the inner region 4005 of the receiver 4000 proximate the main support 4050 of the receiver 4000. In some embodiments, the receiver 4000 can also house an action cam 5400. In some embodiments, the action cam 5400 can be assembled into the inner region 4005 of the receiver 4000 proximate or coupled to the bushing 5800.

Some embodiments of the invention can include a movable recoil shield and camshaft assembly. For example, in some embodiments, a recoil shield 3300 can be assembled into the inner region 4005 of the receiver 4000 at least partially surrounding the action cam 5400, the at least one bushing 5800, and the at least one headspace shim 3500. In some embodiments, the recoil shield 3300 can be free to slide forward and backward within a range limited by the action of the action cam 5400. In some embodiments, the action cam 5400 can be mounted within the inner region 4005 behind the recoil shield 3300. In some embodiments, the axis of the camshaft can be positioned within the plane of the bores 260 of the barrel 250 and can be substantially perpendicular to the axis of the bores 260.

In some embodiments, the recoil shield 3300 can contain a series of firing pin holes corresponding in number and location to the primers in the charge block 9000. In some embodiments, the recoil shield 3300 can be positioned in the frame just far enough from the breech end 265 to allow the charge block 9000 to pass through the openings in the frame between the breech end 265 and the recoil shield 3300. In some embodiments of the invention, a frame can be attached to the breech end 265 of the barrel 250 and to which all the other parts can be coupled. In some embodiments, the frame can include an opening at the breech end 265 of the barrel 250 to allow the passage of the charge block 9000.

In some embodiments, a feed control mechanism can be mounted to the frame and can control the motion of the charge block 9000 into and out of the frame and alignment with the bores 260. In some embodiments, a fire control mechanism can control the operation of the action cam 5400 and the plurality of firing pins 3200. In some embodiments of the invention, in operation, the feed control mechanism can move a charge block 9000 into position between the barrel breech (breech end 265) and the recoil shield 3300. In some embodiments, the forward part of the charge block 9000 (containing the charge holes with the projectiles 9400 and propellant) can face the breech end 265, while the rearward part of the charge block 9000 (containing the primers) can face the recoil shield 3300. In some embodiments, with the charge block 9000 in place, the charge holes can precisely aligned with the bores 260 of the barrel 250. The camshaft 5425 can be rotated, which can force the recoil shield 3300 forward, and can trap the charge block 9000 between the breech of the barrel 250 and the recoil shield 3300. In some embodiments, the metal-to-metal contact between the charge block 9000 and the breech can serve to seal the gap between the two parts, which in some embodiments can prevent the escape of hot propellant gasses. This feature can serve several purposes in some embodiments. For example, in some embodiments, this feature can help to reduce fouling of the action by the hot gasses. In some further embodiments, this feature can reduce the transfer of heat to the working parts of the action. Further, in some embodiments, this feature can reduce the erosion of action parts by the cutting effect of hot gasses flowing under high pressure. Finally, in some embodiments, this feature can help to reduce the report produced by the firearm system 10.

In some embodiments, the camshaft 5425 can rotate to lock parts together and then can stop in that position. In this instance, the action is "In Battery" and ready to fire. In some embodiments, firing can be accomplished by the operation of the plurality of firing pins 3200 by the fire control mechanism. In some embodiments, the plurality of firing pins 3200 can be actuated sequentially. In some further embodiments, the plurality of firing pins 3200 can be actuated substantially simultaneously. In some embodiments, the plurality of firing pins 3200 can be actuated until all charges in the charge block 9000 are exhausted. In some embodiments of the invention, after firing is completed, the camshaft 5425 can be rotated in the opposite direction, unlocking the action, withdrawing the recoil shield 3300 and releasing the charge block 9000. In some embodiments, the feed control mechanism can then expels the empty charge block 9000 and replaces it with a fresh one, completing the cycle.

In some embodiments, the Barlows equation for pressure within vessels and pipes can be used to define one or more structural parameters and/or dimensions of the charge block 9000. For example, $$A=(2ST)/Do, \quad \text{(equation 1)}$$

And $$B=(2ST/DoSf) \quad \text{(equation 2)}$$

Where

S is the ultimate tensile strength (lb. in$^2$), T is wall thickness (inches), Do is outside diameter (inches), A is burst pressure (kpsi), B is working pressure (kpsi), Sf is safety factor. Further, bb—Tubular bobbin center section 0.015 or 0.045 wall thickness. Secondary structural component of pressure vessel: sf 1.5. Contributes to "Cwp". Anterior flange sf 1.5 steel bobbin component. Posterior Flange sf-NA is more robust than the anterior flange. In some embodiments of the invention, any bobbin can be supported in the battery by the breech face 268 and/or the composite charge block body. Further, during discharge events, bobbins (within charge block 9000) will be under axial compression forces from the action cam, as well as circumferential tensile forces within the pressure vessels.

In some embodiments, the barrel 250 of the firearm system 10 can be cooled. For example, some embodiments of the invention can comprise a personal weapon (e.g., a battle rifle) that includes enhancements such as a method of barrel cooling. For example, in some embodiments, the encasement of the barrel 250 can be encased in a thermally conductive material such as aluminum, with a maximized surface area to transfer excess heat to the atmosphere. For example, in some embodiments, the casing of the barrel 250 can include one or more fins. For example, in some embodiments, the casing of the barrel can include a plurality of fins (similar to the cylinder of an air-cooled piston engine). In some embodiments, the light alloy can conduct heat resulting in an effective air-cooled barrel with no moving parts. In some embodiments, the barrel 250 can be no heavier than a solid steel barrel from a conventional single-bore rifle. In some embodiments, the barrel 250 can be fired continuously with no loss of function for as long as necessary.

Figure 9B:
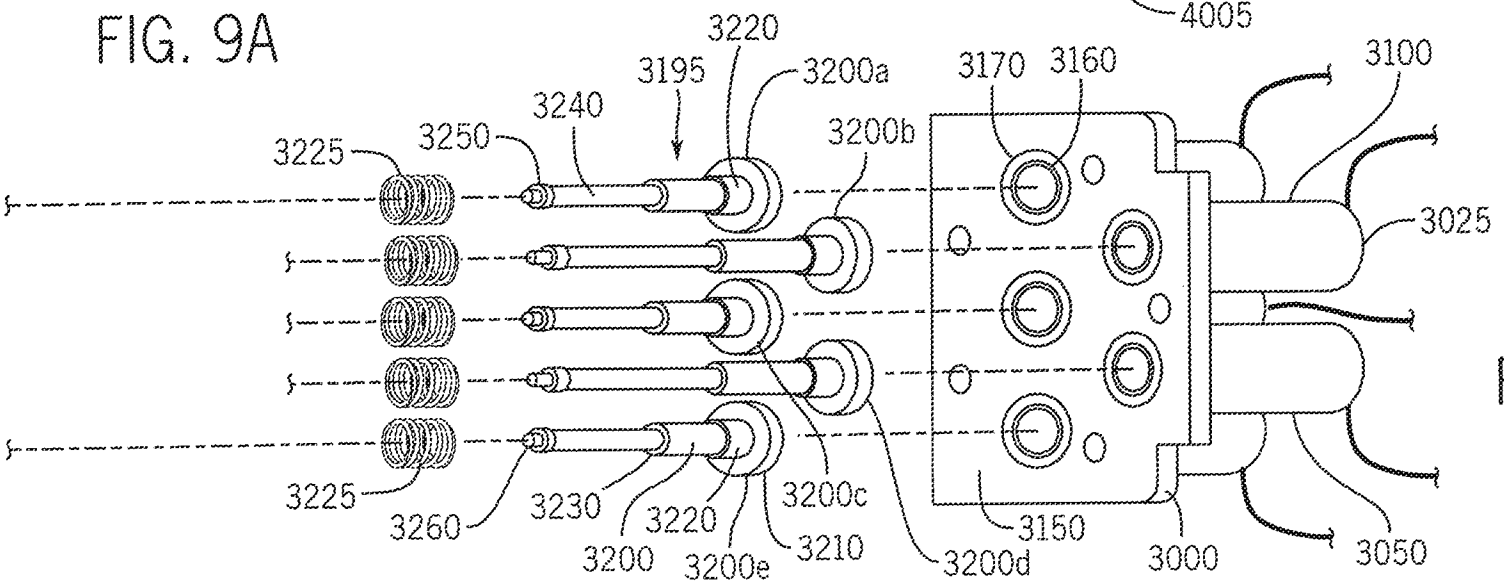
FIG. 9B illustrates a striker coil assembly including firing pins in accordance with some embodiments of the invention.

In some embodiments of the invention, the firearm system 10 can include various mechanisms for igniting and discharging ammunition. Some embodiments of the invention include various electromechanical assemblies that can be controlled by the firearm system 10 in response to an operator's selection of a firing preference. In some embodiments, the electromechanical assemblies can comprise electromechanically operated strikers that can be positioned within the receiver complex 2000 adjacent or proximate the receiver 4000. For example, FIG. 9B illustrates a striker coil assembly 3000 including firing pins in accordance with some embodiments of the invention. In some embodiments of the invention, the striker coil assembly 3000 can comprise a striker coil array 3025 comprising at least one striker coil 3050 comprising a striker coil bobbin 3100. In some embodiments, the striker coil assembly 3000 can be positioned adjacent the outside of the receiver 4000 proximate the main support 4050 (i.e. the opposite side to the at least one bushing 5800, the at least one headspace shim 3500, and the action cam 5400). In some embodiments, the coil plate 3150 can be positioned proximate or adjacent with the outside of the receiver 4000 proximate the main support 4050.

In some embodiments, the striker coil assembly 3000 can comprise at least one striker 3160. In some embodiments, the at least one striker 3160 can be positioned within the striker coil assembly 3000, extending out of the at least one least one striker coil 3050 proximate or adjacent the coil plate 3150. Further, in some embodiments, the striker coil assembly 3000 can include at least one firing pin flange pocket 3170, and the at least one striker 3160 can be positioned within the striker coil assembly 3000, extending out of the at least one least one striker coil 3050 proximate or adjacent the at least one firing pin flange pocket 3170.

Figure 10A:
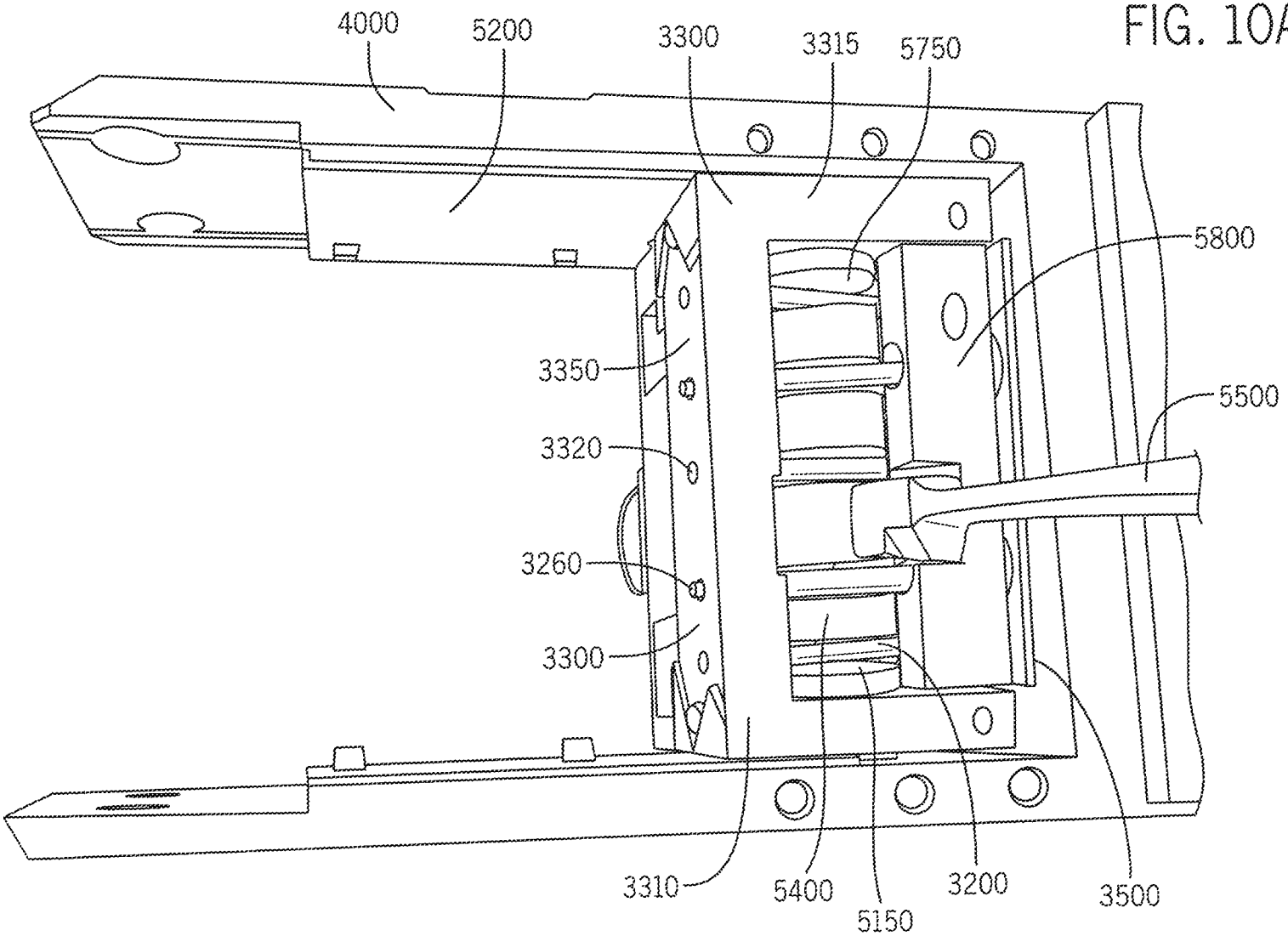
FIG. 10A illustrates a main receiver frame and action cam in accordance with some embodiments of the invention.

In some embodiments of the invention, the firearm system 10 can include firing pins for firing and discharging ammunition from the firearm system 10. For example, as shown in FIG. 9B, some embodiments of the firearm system 10 can be assembled with a firing pin assembly 3190 including a firing pin array 3195 comprising a plurality of firing pins 3200. In some embodiments of the invention, the firing pin array 3195 can be positioned in the inner region 4005 of the receiver 4000. FIG. 10A illustrates a main receiver frame 4000 and action showing the previously described feed control carriage 5200, recoil shield 3300, action cam 5400, bushing 5800, and headspace shim 3500 assembled into the inner region 4005 of the receiver 4000. The plurality of firing pins 3200 are also shown nestled between firing pin clearance grooves 5750 of the action cam 5400.

Referring again to FIG. 9B, in some embodiments of the invention, the firearm system 10 can comprise a plurality of firing pins 3200 including at least a first firing pin 3200*a*, a second firing pin 3200*b*, a third firing pin 3200*c*, a fourth firing pin 3200*d*, and a fifth firing pin 3200*e*. In some embodiments, each of the plurality of firing pins 3200*a*, 3200*b*, 3200*c*, 3200*d*, and 3200*e* can comprise a tubular body 3230, and a solid shank 3240 extending from one end of the tubular body 3230, and a flange 3210 coupled to the other end of the tubular body 3230. In some embodiments, the solid shank 3240 can comprise an alignment ball 3250 with a stepped tip 3260 positioned at the end opposite the flange 3210. Further, in some embodiments, at least one return spring 3225 can be positioned over the spring shank 3220, directly adjacent to the flange 3210.

Figure 11A:
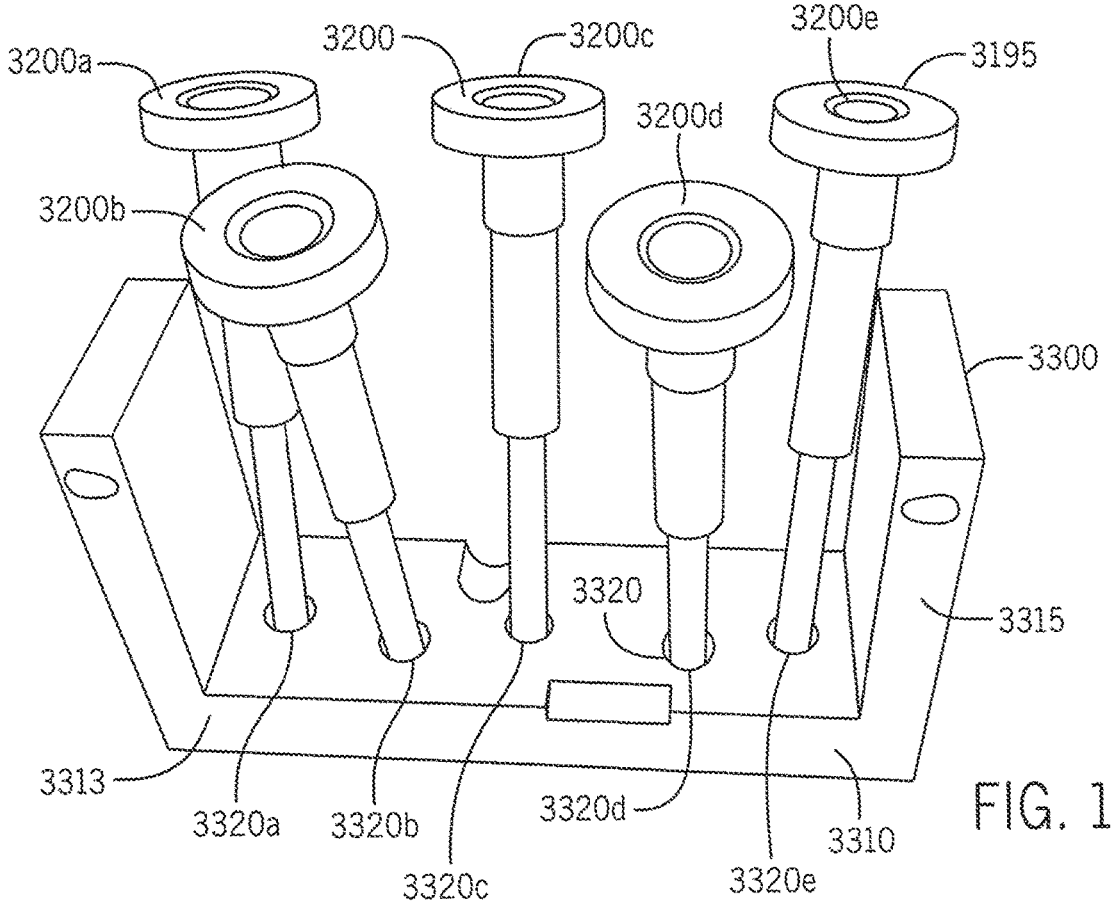
FIG. 11A illustrates a rear perspective view of recoil shield with firing pins in accordance with some embodiments of the invention.
Figure 11B:
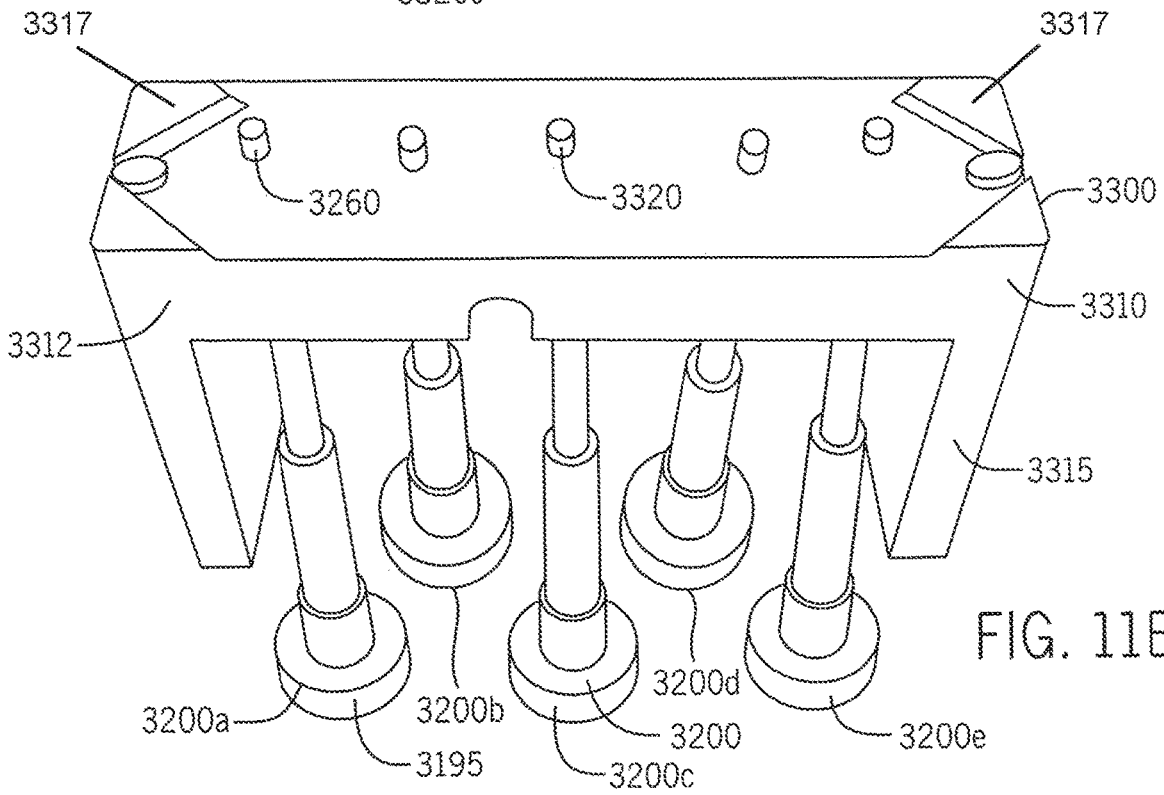
FIG. 11B illustrates a front perspective view of recoil shield with firing pins in accordance with some embodiments of the invention.

Referring again to FIG. 10A, in some embodiments, when the plurality of firing pins 3200 are positioned between the firing pin clearance grooves 5750 of the action cam 5400, and the at least one bushing 5800 is assembled into the inner region 4005 of the receiver proximate the action cam, the plurality of firing pins 3200 can extend through a plurality of firing pin holes 3320 of the recoil shield 3300. In doing so, in some embodiments, at least one stepped tip 3260 of the plurality of firing pins 3200 can extend through the recoil shield 3300. This is also shown in FIGS. 11A and 11B, and described below.

Figure 10B:
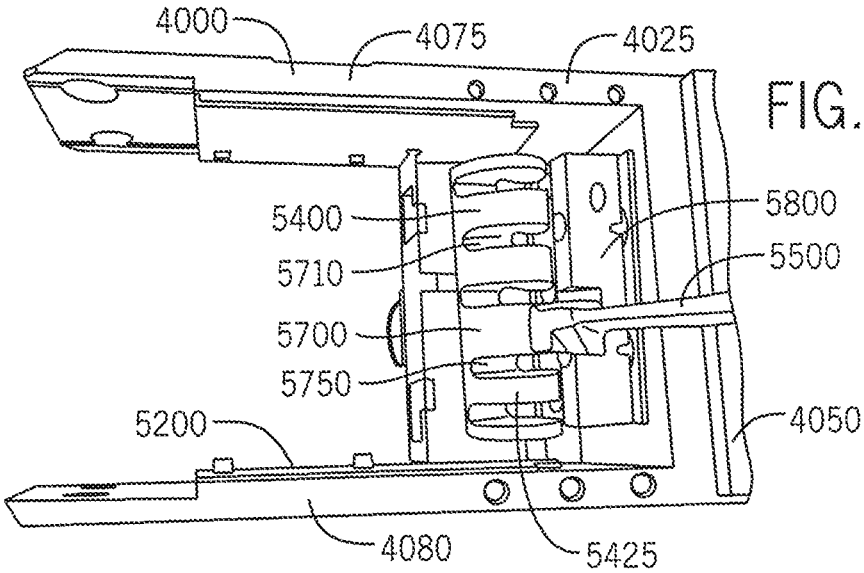
FIG. 10B illustrates a main receiver frame with recoil shield removed in accordance with some embodiments of the invention.
Figure 10C:
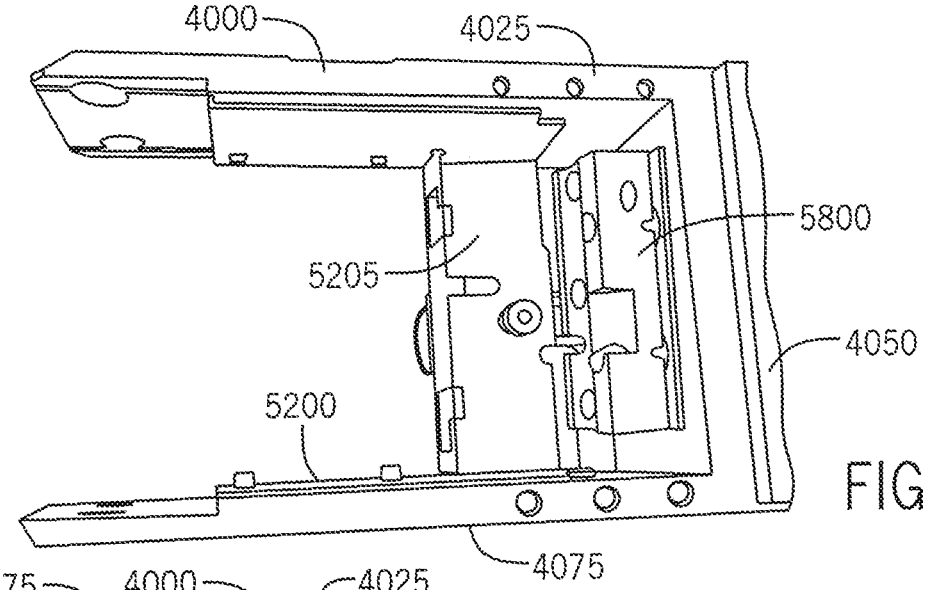
FIG. 10C illustrates a main receiver frame with recoil shield and action cam removed in accordance with some embodiments of the invention.
Figure 10D:
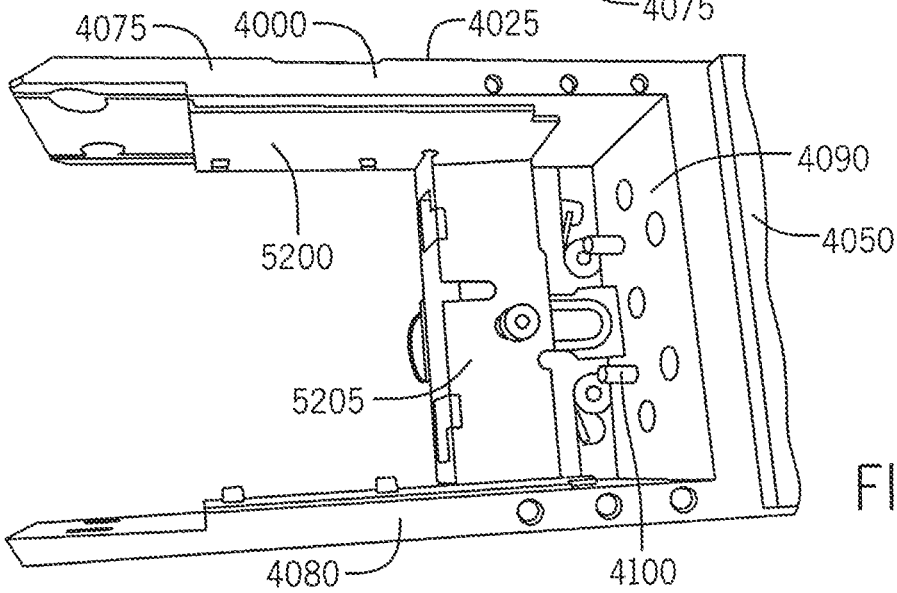
FIG. 10D illustrates a main receiver frame with recoil shield, action cam, and bushing removed in accordance with some embodiments of the invention.

The assembly of components with the receiver 4000 described above and depicted in FIGS. 9A and 9B can be further visualized in FIGS. 10B-10D showing the receiver 4000 depicted in several stages of assembly into the inner region 4005 of the receiver 4000. For example, FIG. 10B illustrates a main receiver 4000 frame with recoil shield 3300 removed in accordance with some embodiments of the invention, FIG. 10C illustrates a main receiver 4000 frame with recoil shield 3300 and action cam 5400 removed in accordance with some embodiments of the invention, and FIG. 10D illustrates a main receiver 4000 frame with recoil shield 3300, action cam 5400, and bushing 5800 removed in accordance with some embodiments of the invention. Shown in this view are the firing pin aperture 4090 and the bushing locator pins 4100.

Figure 10E:
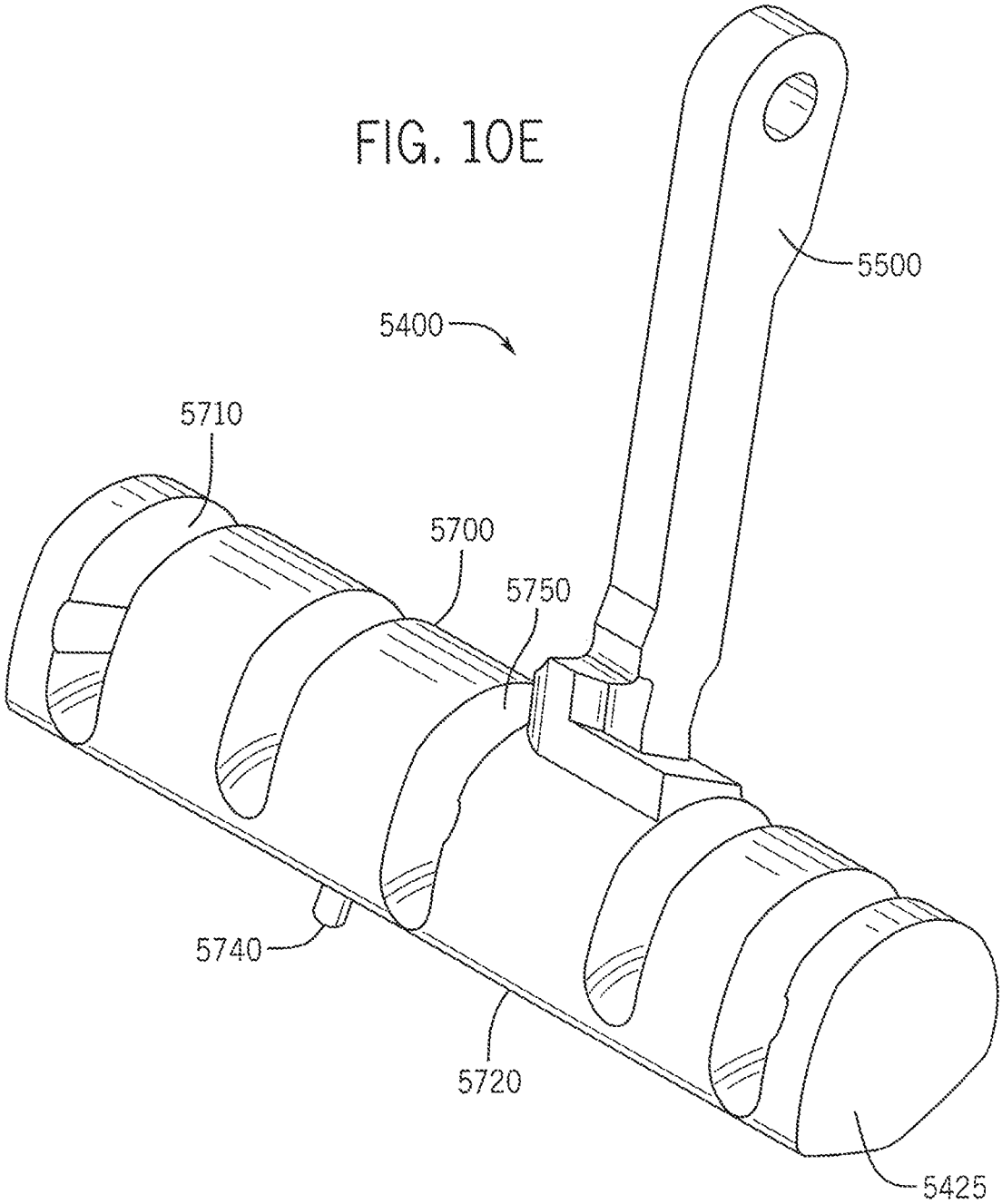
FIG. 10E illustrates a perspective view of an action cam in accordance with some embodiments of the invention.
Figure 10H:
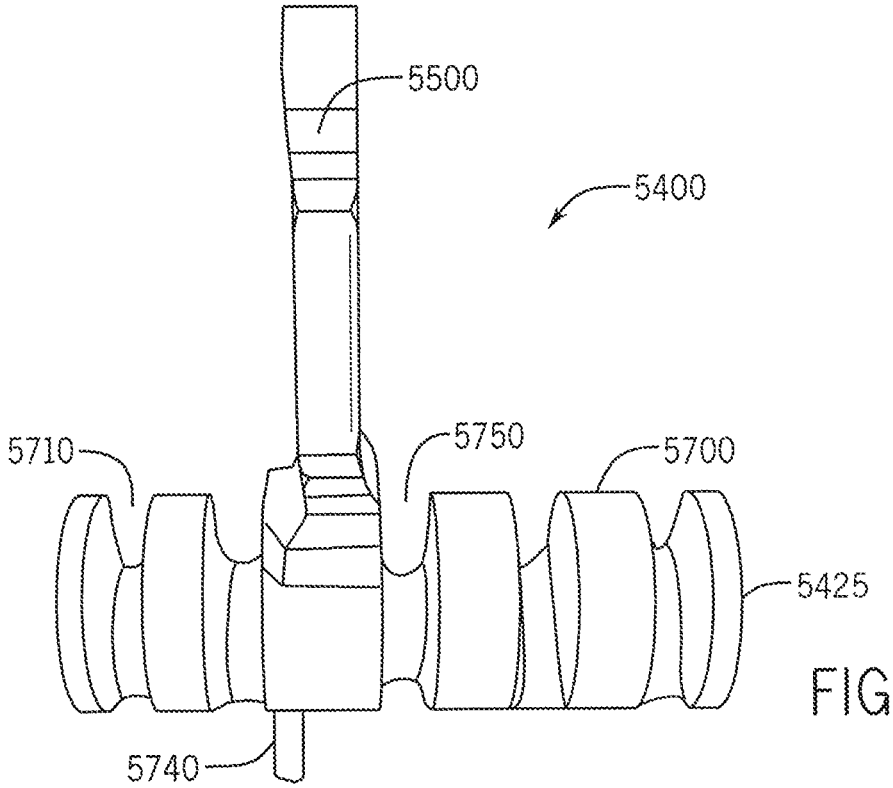
FIG. 10H illustrates a bushing side view an action cam in accordance with some embodiments of the invention.
Figure 10I:
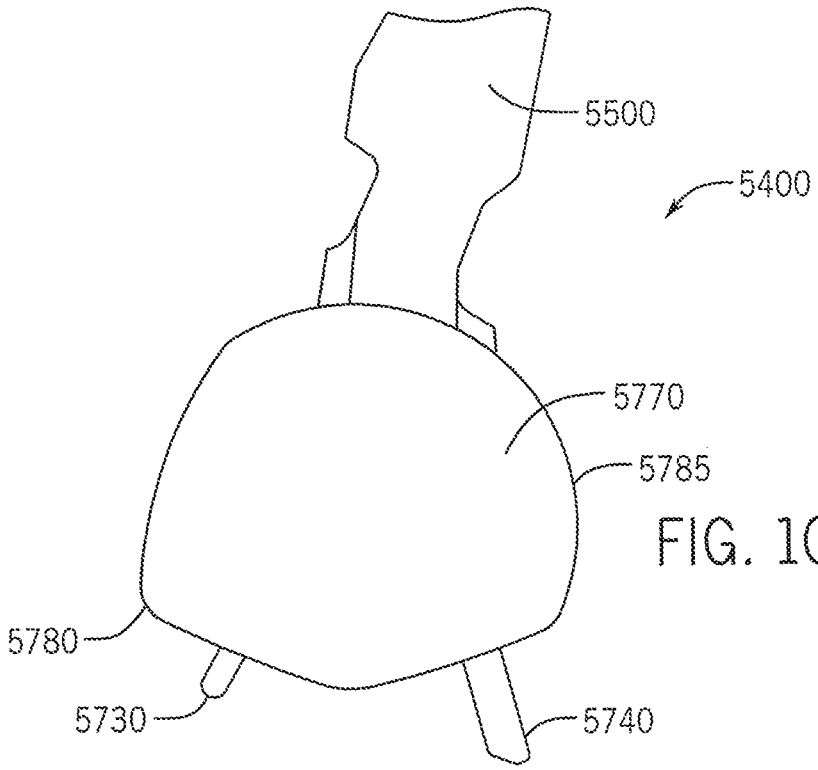
FIG. 10I illustrates an end view of an action cam in accordance with some embodiments of the invention.
Figure 10F:
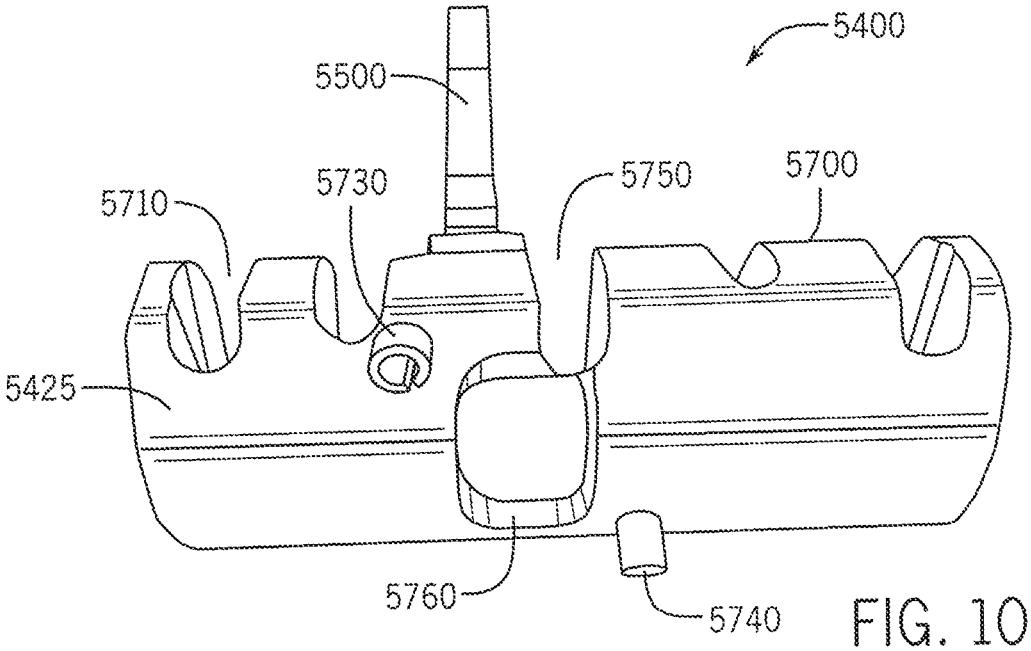
FIG. 10F illustrates a bottom view of an action cam in accordance with some embodiments of the invention.
Figure 10G:
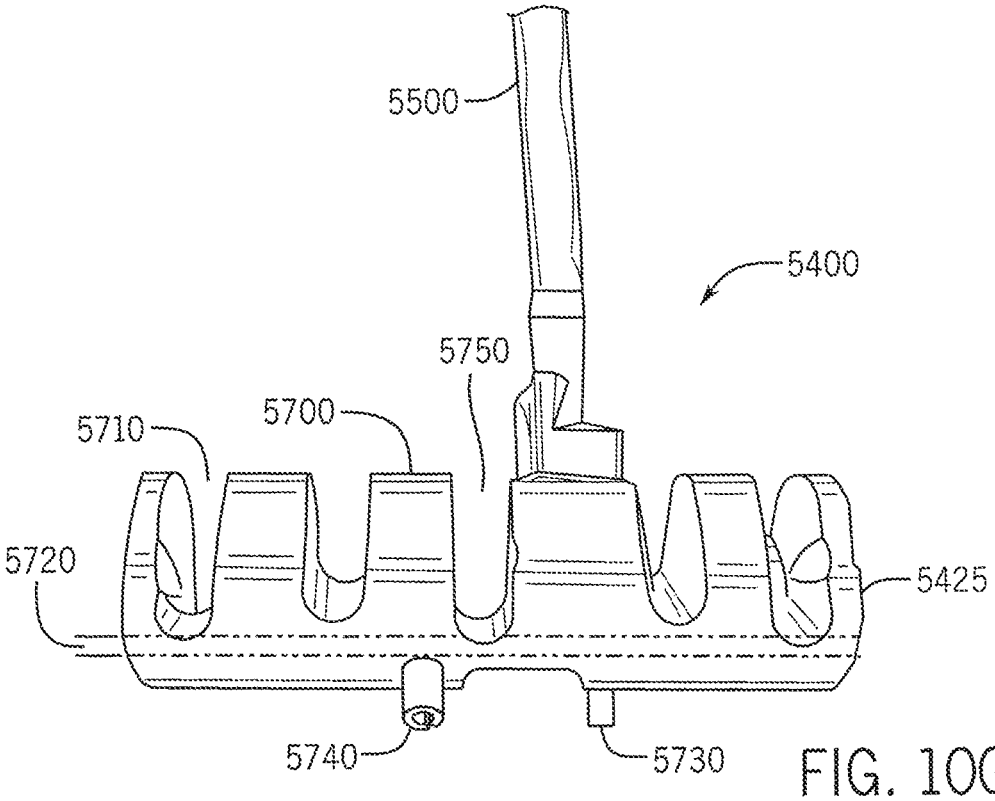
FIG. 10G illustrates a front view of an action cam in accordance with some embodiments of the invention.

Further details of the action cam 5400 are illustrated in the various views shown in FIGS. 10E-10I. For example, FIG. 10E illustrates a perspective view of the action cam 5400 in accordance with some embodiments of the invention. FIG. 10F illustrates a bottom view of the action cam 5400 in accordance with some embodiments of the invention, and FIG. 10G illustrates a front view of the action cam 5400 in accordance with some embodiments of the invention. Further, FIG. 10H illustrates a bushing side view of the action cam 5400 in accordance with some embodiments of the invention, and FIG. 10I illustrates an end view of an action cam 5400 in accordance with some embodiments of the invention. In some embodiments, the action cam 5400 can comprise a camshaft 5425, and a cam lever 5500 coupled to the camshaft 5425. In some embodiments, the camshaft 5425 can comprise a plurality of load bearing disks 5700 and a plurality of assembly grooves 5710, where each of the grooves is positioned between two of the disks of the plurality of load bearing disks 5700.

In some embodiments, the action cam 5400 includes firing pin clearance groove 5750, and knob screw clearance cut 5760. Referring to FIG. 10F, the camshaft 5425 can comprise a lobe tip 5720 extending the longitudinal length of the camshaft 5425. Referring to FIG. 10I, in some embodiments, the camshaft 5425 can comprise a cam lobe profile 5770 that includes a locking lobe 5780, and a cam base circle and load bearing surface 5785. In some embodiments, the cam base circle and load bearing surface 5785 can interface with bushing 5800 when assembled into the main receiver 4000. In some embodiments, the action cam 5400 can include at least one structure related to timing of one or more actions of the firearm system 10. For example, in some embodiments, the firearm system 10 can include a first timing pin 5730 extending from the camshaft 5425. Some embodiments also include a second timing pin 5740 extending from the camshaft 5425. In some embodiments action cam 5400 can be rotated ⅛ turn (45°) by the motion of cam lever 5500. With cam lever 5500 in the forward position, the lobe tip 5720 is positioned 45° out of the plane of the bores 260, the recoil shield 3300 is in its rearmost position, and the first timing pin 5730 can engage the feed control carriage bridge 5205 timing slot 5217*a*. Pin 5730 holds the feed carriage 5200 in a position such that feed control pins 5219 are not in alignment with feed grooves 9200 of charge block 9000. The base of charge block 9000 rests on feed control pins 5219 with chambers 9425*a*, 9425*b*, 9425*c*, 9425*d*, 9425*e* correctly aligned with bores 260*a*, 260*b*, 260*c*, 260*d*, 260*e*. In some embodiments, movement of cam lever 5500 away from the forward position rotates action cam 5400 lobe tip 5720 toward the plane of bores 260*a*, 260*b*, 260*c*, 260*d*, 260*e*, thereby forcing the recoil shield 3300 forward to trap charge block 9000 between breech of barrel 250, and the face of recoil shield 3300. In some embodiments, castellations 3317 couple with complementary recessed areas 9300 on charge block 9000. In some embodiments, detent pins (not shown) delay forward movement of the feed control carriage 5200 until the second timing pin 5740 engages feed control carriage bridge 5205 timing slot 5217*b*. In some embodiments, continued movement of cam lever 5500 to the rearward position aligns action cam 5400 lobe tip 5720 with the plane of bores 260, locking the action into battery and forcing feed control carriage 5200 forward to position feed control pins 5219 into alignment with feed grooves 9200 of charge block 9000. In some embodiments, movement of the cam lever 5500 away from rearward position rotates action cam 5400 lobe tip 5720 away from plane of bores 260, unlocking action and releasing charge block 9000. In some embodiments, rearward motion of the feed control carriage 5200 is delayed by feed control carriage return springs (not shown) until first timing pin 5730 engages feed control bridge 5205 timing slot 5217*a*. In some embodiments, the magazine spring 1900 forces charge block 9000 angles feed grooves 9200 to engage feed control pins 5219. In some embodiments, continued movement of cam lever 5500 rotates action cam 5400 first timing pin 5730 to move feed control carriage 5200 rearward as magazine spring 1900 forces charge block 9000 angled feed grooves 9200 past feed control pins 5219. In some embodiments, the charge block 9000 exits ejection port 2500 as the cam lever 5500 reaches a forward position and feed control carriage 5200 reaches rearward position with feed control pins 5219 out of alignment with feed grooves 9200 of subsequent charge block 9000. In some embodiments, the base of subsequent charge block 9000 encounters feed control pins 5219 and rests with chambers 9425*a*, 9425*b*, 9425*c*, 9425*d*, 9425*e* correctly aligned with bores 260*a*, 260*b*, 260*c*, 260*d*, 260*e*, completing the action cycle.

Figure 10J:
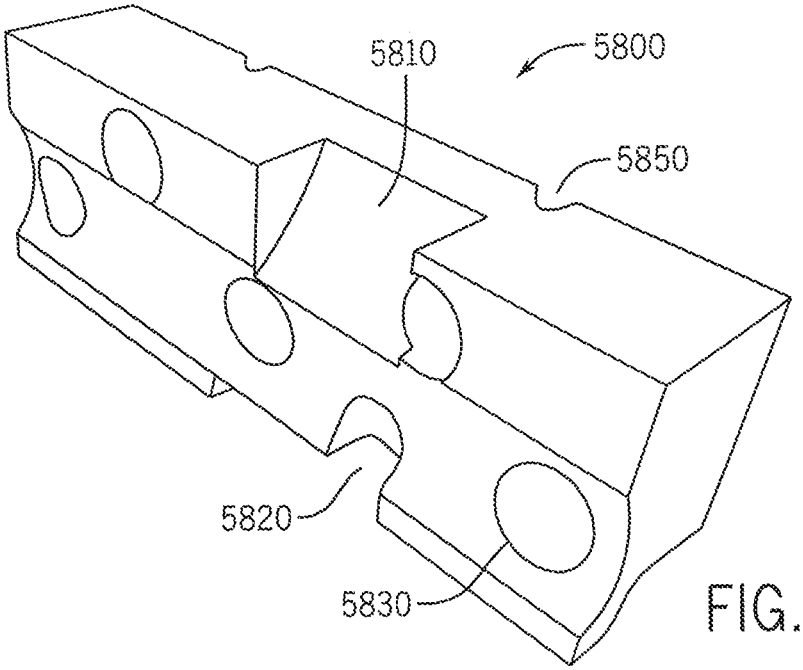
FIG. 10J illustrates a perspective view of a bushing in accordance with some embodiments of the invention.

FIG. 10J illustrates a perspective view of a cam bushing 5800 in accordance with some embodiments of the invention. The cam bushing 5800 provides the main structural thrust support for the cam shaft 5425 of the action cam 5400, and in some embodiments, includes various relief and clearance holes. For example, in some embodiments of the invention, the cam bushing 5800 includes a cam lever clearance cut 5810, timing pin clearance holes 5820, and firing pin clearance holes 5830.

Figure 10K:
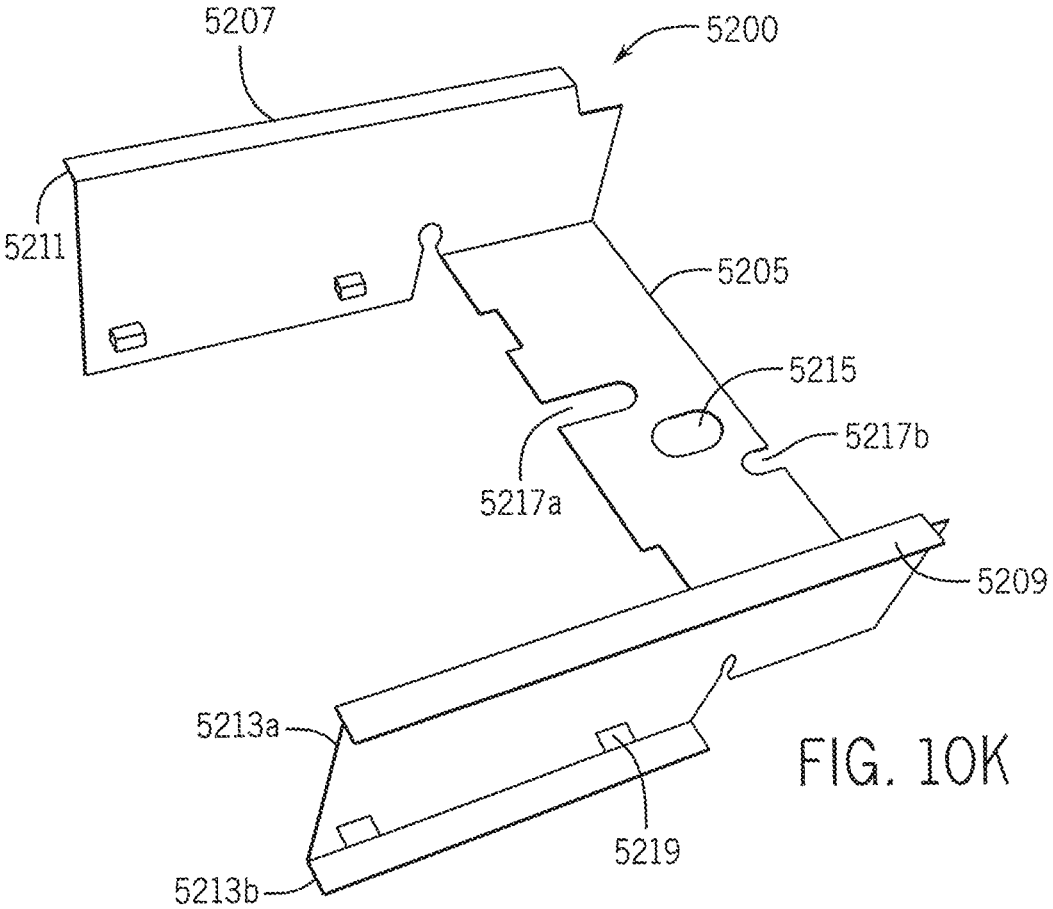
FIG. 10K illustrates a perspective view of a feed control carriage in accordance with some embodiments of the invention.

When assembled with the receiver 4000 coupled with the first side wall 4075 and the second side wall 4080, the feed control carriage 5200 can facilitate movement of charge blocks 9000 within the feedport 2500 of the receiver complex 2000. FIG. 10K illustrates a perspective view of a feed control carriage 5200 in accordance with some embodiments of the invention. In some embodiments, the feed control carriage 5200 can comprise a feed control carriage bridge 5205 extending between side walls 5207, 5209. The feed control carriage bridge 5205 can comprise timing slots 5217*a*, 5217*b* positioned to provide clearance for the first and second timing pins 5730, 5740 of the action cam 5400. In some embodiments, the side walls 5207, 5209 can include a plurality of guide rails 5211 configured to couple with the side walls 4075, 4080 of the receiver 4000. For example, in some embodiments, the feed control carriage 5200 can comprise upper and lower guide rails 5213*a*, 5213*b* on either or both side walls 5207, 5209. In some further embodiments, the feed control carriage bridge 5205 can comprise a knob screw slot 5215 to facilitate coupling of the load knob 400. Further, in some embodiments, either or both side walls 5207, 5209 can comprise feed control pins 5219 positioned to couple with feed grooves 9200 of the charge block 9000.

In some embodiments, each charge within a charge block 9000 can be fired by its own firing pin. In some embodiments, the number of firing pins can equal the number of charges of the charge block 9000. Referring to FIG. 11A, illustrating a rear perspective view of a recoil shield 3300, in some embodiments, the firearm system 10 can include a plurality of firing pins 3200 aligned with and inserted through a plurality of firing pin holes 3320 in the recoil shield 3300. In some embodiments, the plurality of firing pins 3200 can be used to fire a plurality of projectiles from the firearm system 10. For example, for a charge block 9000 comprising five chambers, a separate firing pin can be assigned to each chamber, and therefore the firearm system 10 can comprise five firing pins comprising the first firing pin 3200*a*, the second firing pin 3200*b*, the third firing pin 3200*c*, the fourth firing pin 3200*d*, and the fifth firing pin 3200*e*.

In some embodiments, the plurality of firing pins 3200*a*, 3200*b*, 3200*c*, 3200*d*, 3200*e* can be aligned with and assembled with the plurality of firing pin holes 3320. For example, in some embodiments of the invention, the first firing pin 3200*a* can be assembled into the first firing pin hole 3320*a*, and the second firing pin 3200*b* can be assembled into the second firing pin hole 3320*b*. Further, the third firing pin 3200*c* can be assembled into the third firing pin hole 3320*c*, the fourth firing pin 3200*d* can be assembled into the fourth firing pin hole 3320*d*, and a fifth firing pin 3200*e* can be assembled into the fifth firing pin hole 3320*e* as shown. As shown, the plurality of firing pins 3200 can be positioned in the recoil shield 3300 extending away from the shield body 3310 and between and generally parallel with the wings 3315. In some embodiments, with the wings 3315 being positioned perpendicular to the shield body 3310, the plurality of firing pins 3200 can be positioned extending from the shield body 3310 towards one or more sides of the shield body 3310. For example, FIG. 11B illustrates a front perspective view of recoil shield 3300 showing the plurality of firing pins 3200 extending through the plurality of firing pin holes 3320 in accordance with some embodiments of the invention. In some embodiments, the plurality of firing pins 3200 can pass through the shield body 3310 with the stepped tips 3260 of the plurality of firing pins 3200 exposed and extending away for the shield body 3310. In some embodiments of the invention, the plurality of firing pins 3200 can slant towards either of the first side 3312 of the shield body 3310 or the second side 3313 of the shield body 3310. In the example embodiment depicted in FIGS. 11A and 11B, the first, third, and fifth plurality of firing pins 3200*a*, 3200*c*, 3200*e* can slant towards the first side 3312 of the shield body 3310, and the second, and fourth plurality of firing pins 3200*b*, 3200*d* can slant towards the second side 3313 of the shield body 3310. Also shown in FIG. 11B are the castellations 3317 that couple with complementary recessed areas 9300 on the charge block 9000.

Figure 12:
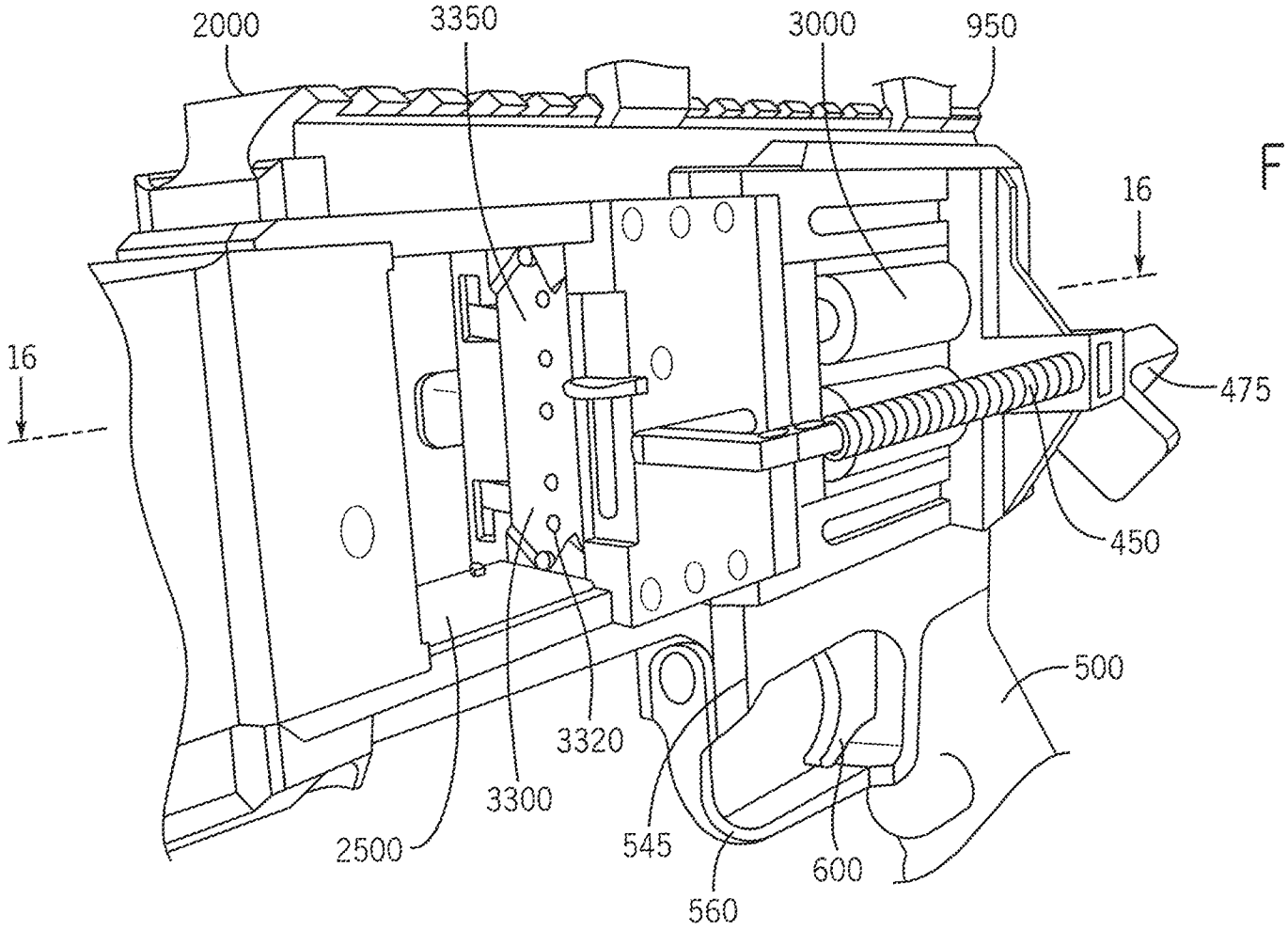
FIG. 12 illustrates a perspective view of the receive complex showing the recoil face region of the firearm system in accordance with some embodiments of the invention.
Figure 13A:
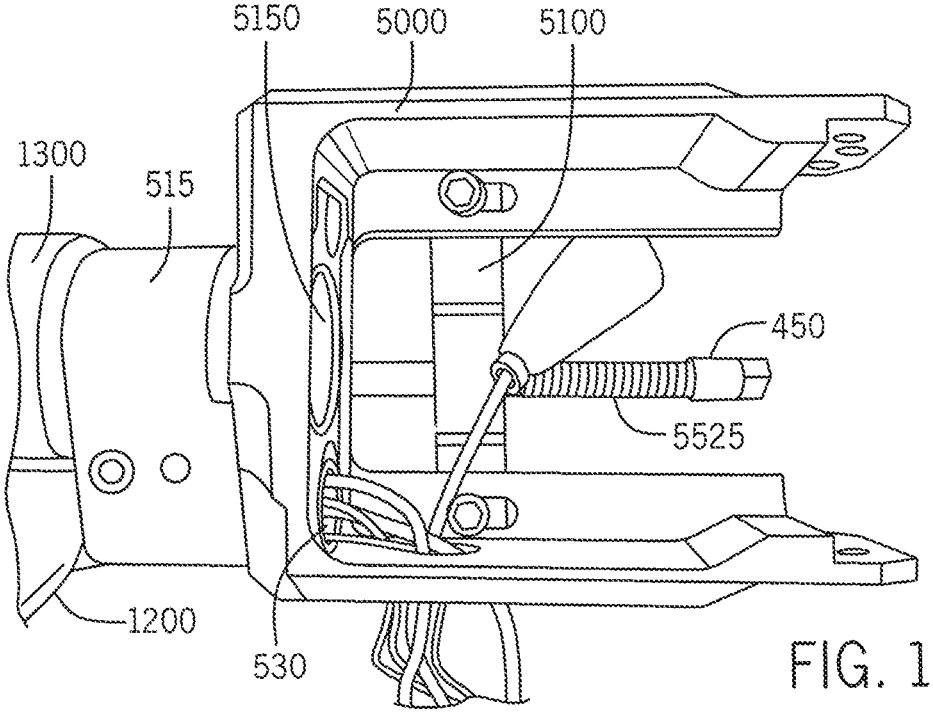
FIG. 13A illustrates a side view of a receiver annex region of the firearm system in accordance with some embodiments of the invention.
Figure 13B:
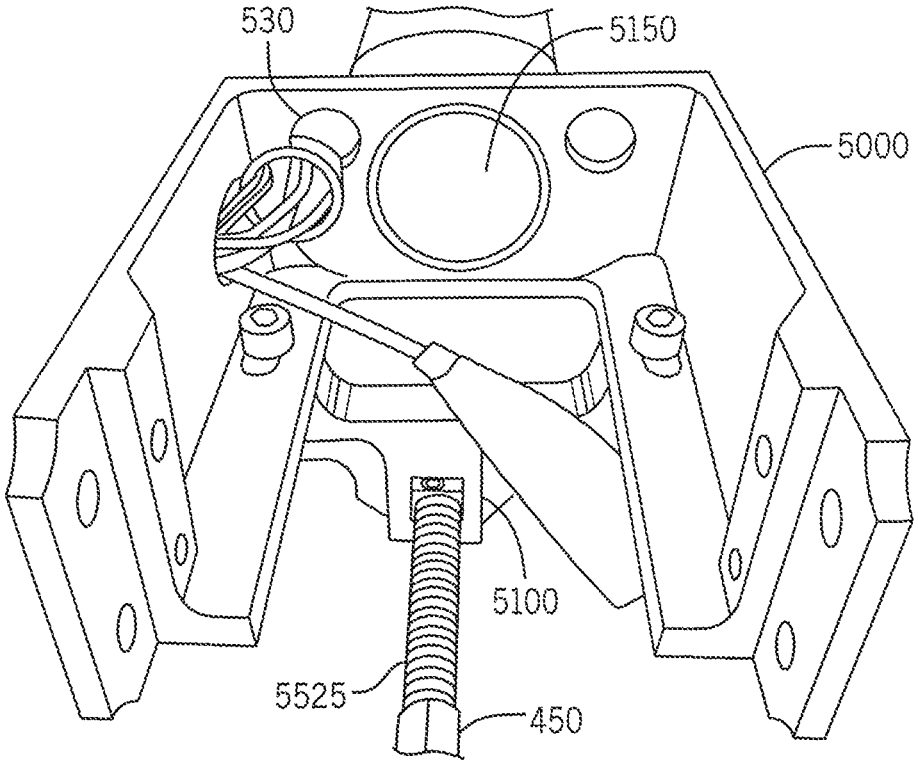
FIG. 13B illustrates an internal view of a receiver annex region of the firearm system in accordance with some embodiments of the invention.

FIG. 12 illustrates a perspective view of the receiver complex 2000 showing the recoil face region of the firearm system 10 in accordance with some embodiments of the invention. This view includes a close-up of the center region of the receiver complex 2000 with the opening in the receiver 4000 for the charge block 9000 (feedport 2500), and also illustrates the feed rod 450. This view also shows the recoil shield 3300 and the plurality of firing pin holes 3320 from the front viewing towards the rear of the weapon. Further as illustrated, some embodiments of the invention include an extension to the rear of the receiver 4000 that houses the striker coil assembly 3000, and serves as a mounting point for the buttstock 1100. For example, FIG. 13A illustrates a side view of a receiver annex 5000 region of the firearm system 10 in accordance with some embodiments of the invention, and FIG. 13B illustrates an internal view of a receiver annex 5000 region of the firearm system 10 in accordance with some embodiments of the invention. In some embodiments, the receiver annex 5000 also houses a harness conduit 530 for wiring can lead through the stock to the various control boards (e.g., trigger board 1410 and driver board 1470) as well as the battery tube (with the battery tube interior 5150 shown in FIG. 8). Also shown is the cam lever feed rod 450, with rod spring 5525 coupled to mounting point 5100.

Figure 14:
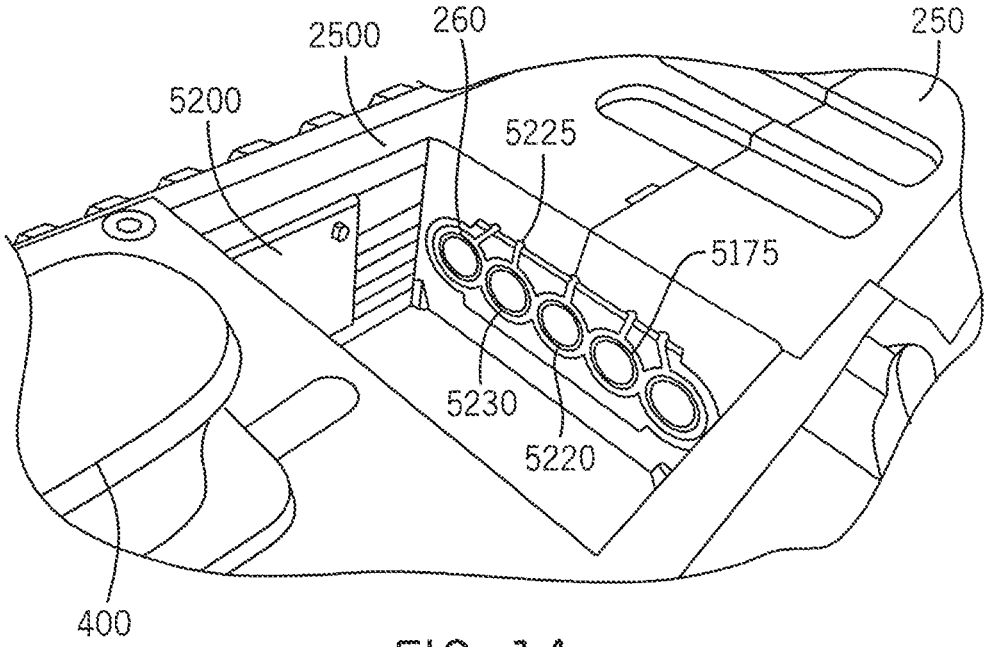
FIG. 14 shows the breech region of the firearm system in accordance with some embodiments of the invention
Figure 15:
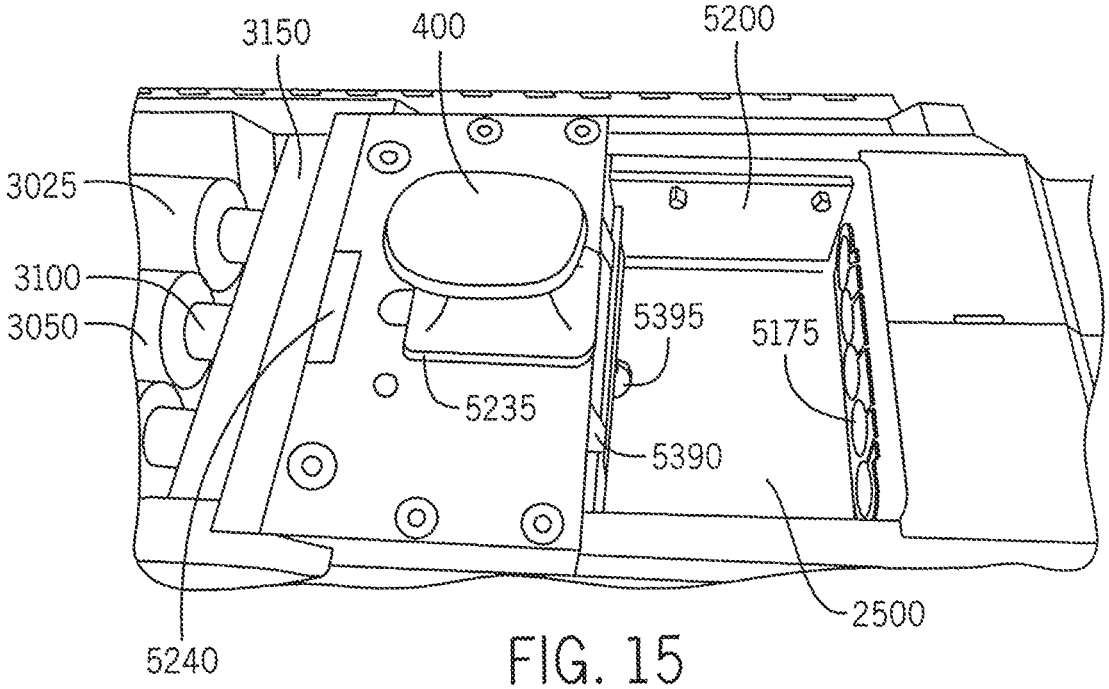
FIG. 15 shows the feedport region of the receiver complex of the firearm system in accordance with some embodiments of the invention.

FIG. 14 shows the breech region of the firearm system 10 in accordance with some embodiments of the invention. This view shows the ejection port (feedport 2500) showing the load knob 400 and feed control carriage 5200 in the loading position (pulled to the rear). Also shown is the breech 5175, including gas rings 5230, vents 5225, and forcing cones 5220. FIG. 15 shows the feedport region of the receiver complex 2000 of the firearm system 10 in accordance with some embodiments of the invention. Shown adjacent to the load knob 400 is the latching tooth cavity 5240. Further, the ejection port (feedport 2500) is shown with the load knob 400 in the forward position, and the action closed and locked without a charge block 9000 in place, and shows follower finger 5395 and loading ratchets 5390 in their stowed position.

In some embodiments, the firearm system 10 can include removable housing for storing and feeding ammunition into the firearm system 10. For example, in some embodiments, the firearm system 10 can include a removable and/or replaceable magazine that can be used to store ammunition, and help feed ammunition into the firearm system 10. In some embodiments, the magazine can feed ammunition including dischargeable projectiles into the firearm system 10. In some embodiments, the magazine can be pre-loaded with ammunition when uncoupled from the firearm system 10.

Figure 16:
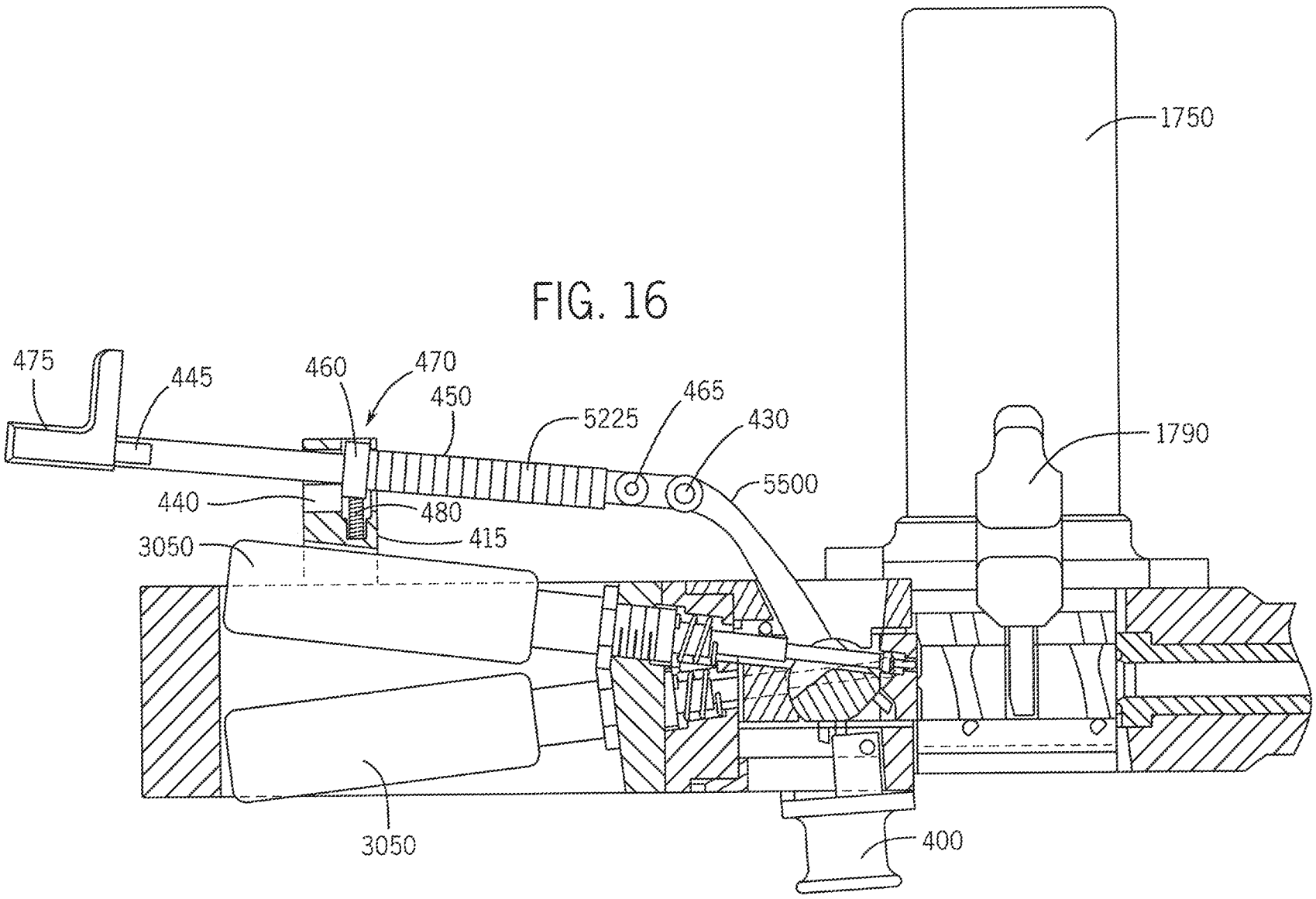
FIG. 16 illustrates a view of the magazine and feed control portion of the firearm showing internal action in accordance with some embodiments of the invention.

In some embodiments of the invention, the firearm system 10 can load and discharge ammunition that comprises a combination of chamber and ammunition. FIG. 16 illustrates a view of the ammunition magazine 1750 and feed control portion of the firearm showing internal action in accordance with some embodiments of the invention. The cam lever feed rod 450 is shown extending from the firearm system 10 coupled to the cam lever 5500. In some embodiments, an operator can actuate the cam lever 5500 using the thumb pad 475 mounted to the feed rod 450. In some embodiments, the ammunition magazine 1750 shown extending from the receiver 4000 can provide ammunition to the firearm system 10. In some embodiments, feeding of ammunition from the ammunition magazine 1750 can be controlled by an operator using the feed rod 450 and/or the load knob 400. Feed rod 450 and load knob 400 are provided to enable direct manual control of the mechanical action of the firearm system 10. The thumbpad 475 can be accessible while a user's hand remains on the pistol grip 500, and a user can press the thumbpad 475 to push cam lever 5500 towards a forward position. Referencing FIG. 16, in some embodiments, the spring nut 460 can anchor one end of expansion spring 5225 to feed rod mounting bracket 415. In some embodiments, the anchor screw 465 can attach to the other end of expansion spring 5225 to feed rod 450. In some embodiments, flats 445 on both sides of the feed rod 450 can be engaged with slot 440 of mounting bracket 415 when the feed rod 450 is in a fully forward position (to hold action in the open and unlocked condition). Further, in some embodiments, spring nut 460 can slide in the spring nut slot 470. In some embodiments, compression spring 480 can hold flats 445 out of slot 440 unless desired. In some embodiments, the thumbpad 475 can be pressed fully forward (at any time), and then be released to cycle action and exchange charge blocks 9000. In some embodiments, the rod 450 couples with cam lever 5500 at pivot point 430. In some embodiments, each time thumbpad 475 is pressed and released, the charge block in battery is ejected by the force stored in the magazine spring and transmitted to the charge block in battery by adjacent charge blocks 9000 or the magazine follower 1810. In some embodiments, when the thumbpad is pressed to eject the final charge block 9000, magazine follower 1810 moves past the follower finger 5395, engaging the action latch pin and catching the cam lever 5500 in the forward position. In some embodiments, the load knob 400 is coupled to the feed control carriage 5200 by the knob screw and the knob screw slot 5215. In some embodiments, slot 5215 allows normal cycling of the feed control carriage 5200 when knob 400 is in the forward position. In some embodiments, pulling the load knob 400 to the rear pulls feed control carriage 5200 to its rear-most position. In some embodiments, the rear feed control pins 5219 stow into pockets in right side plate 425 while front feed control pins 5219 align with magazine guide rails 1780 and 1770. In some embodiments, load ratchets 5390 deploy and permit one-way passage of charge blocks 9000 through feed control carriage 5200 into magazine 1750. In some embodiments, motion of the magazine follower 1810 back past follower finger 5395 retracts action latch pin, releasing cam lever 5500. In some embodiments, releasing load knob 400 returns feel control carriage 5200 to a forward position, retracts loading ratchets 5390, and allows expansion spring 5525 to pull cam lever 5000 to rearmost position, rotating action cam and locking action into battery. In some embodiments, a partially empty magazine can be refilled by pressing thumbpad 475 forward until flats 445 engage with slot 440, then inward to lock action open. In some embodiments, a user can pull and latch load knob 400 and insert charge blocks 9000 into magazine 1750. The user can then move thumbpad 475 outward to unlock action, and then release load knob 400 to return action to battery.

Figure 17:
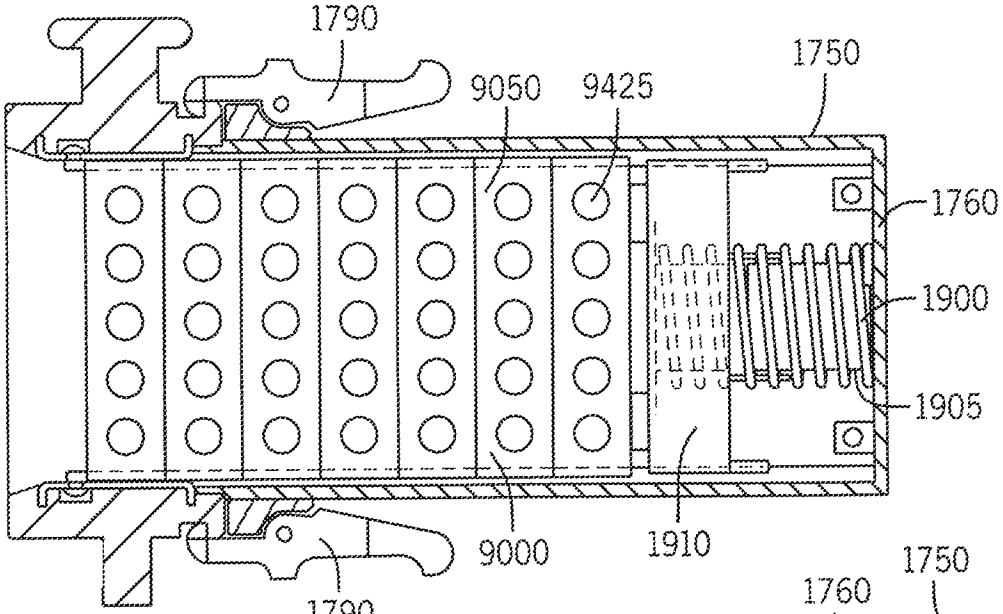
FIG. 17 illustrates a side view of a magazine showing an internal view with charge blocks in position in accordance with some embodiments of the invention.

FIGS. 17, and 18A-18C illustrate various views of an ammunition magazine 1750 of the firearm system 10. Referring initially to FIG. 17, illustrating a side view of a magazine 1750, in some embodiments, the ammunition magazine 1750 can comprise a main housing 1760, and at least one quick release latch 1790 coupled to the main housing 1760, and a base ring 1840 coupled to the main housing 1760 at one end of ammunition magazine 1750. In some embodiments, the ammunition magazine 1750 can store and feed ammunition that comprises a combination ammunition chamber, ammunition and magazine assembly (hereinafter referred to as a "charge block" and shown as charge block 9000). In some embodiments of the invention, the firearm system 10 can include a plurality of blocks 9000 coupled to or otherwise inserted into and housed within the ammunition magazine 1750 for the purpose of feeding at least one charge block 9000 into the feedport 2500 of the firearm system 10. More specifically, some embodiments of the invention can include one or more charge blocks 9000 coupled to or inserted into the ammunition magazine 1750 for enabling the firearm system 10 to discharge at least one projectile (e.g., a bullet) from the charge block 9000 and out of the firearm system 10 towards a target. As shown in FIG. 17, in some embodiments, a plurality of charge blocks 9000 can be housed in the main housing 1760 of the ammunition magazine 1750. In the example embodiment shown in FIG. 17, when the ammunition magazine 1750 is fully loaded with charge blocks 9000 (e.g., the housing includes eight charge block 9000), a magazine spring 1900 can be positioned in the main housing 1760 in a spring position 1905. In this position, the magazine spring 1900 can be in a compressed state, and can apply a force to one or more charge blocks 9000 within the ammunition magazine 1750.

Figure 18A:
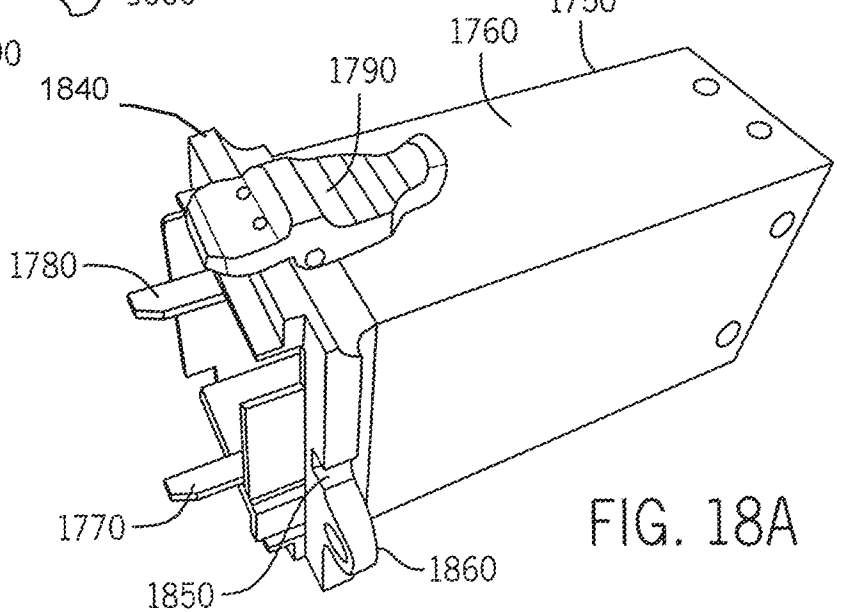
FIG. 18A illustrates a perspective view of a magazine in accordance with some embodiments of the invention.

FIG. 18A illustrates a perspective view of the ammunition magazine 1750, FIG. 18B illustrates a side view of the ammunition magazine 1750, and FIG. 18C illustrates a perspective view of the ammunition magazine 1750 in accordance with some embodiments of the invention. In some embodiments, the ammunition magazine 1750 can comprise a receiver coupling assembly 1770 coupled to the main housing 1760. In some embodiments, the ammunition magazine 1750 can include a base ring 1840 including a screw mount boss 1860 extending from the base ring 1840, and a cam lever clearance groove 1850 formed in the base ring 1840. Further, in some embodiments of the invention, the ammunition magazine 1750 can include at least one guide rail extension 1780 extending from the main housing 1760. In some embodiments, the receiver coupling assembly 1770 can include a follower 1810 with a firing pin clearance groove 1820, and at least one stand-off pad 1870.

In some embodiments, the above described ammunition magazine 1750 can be used to hold, store, and/or feed ammunition into the firearm system 10 for discharge of ammunition. In some embodiments, the ammunition magazine 1750 can feed ammunition from at least one charge block 9000 including one or more projectiles into the firearm system 10. In some embodiments of the invention, the firearm system 10 can discharge at least one projectile from the ammunition comprising a charge block 9000. Further, as shown in the view of FIG. 18B, in some embodiments, at least one side of the ammunition magazine 1750 can comprise at least one overpressure vent 1800 that can facilitate escape of gases produced as a result of ammunition discharge from one or more charge blocks.

Figure 19:
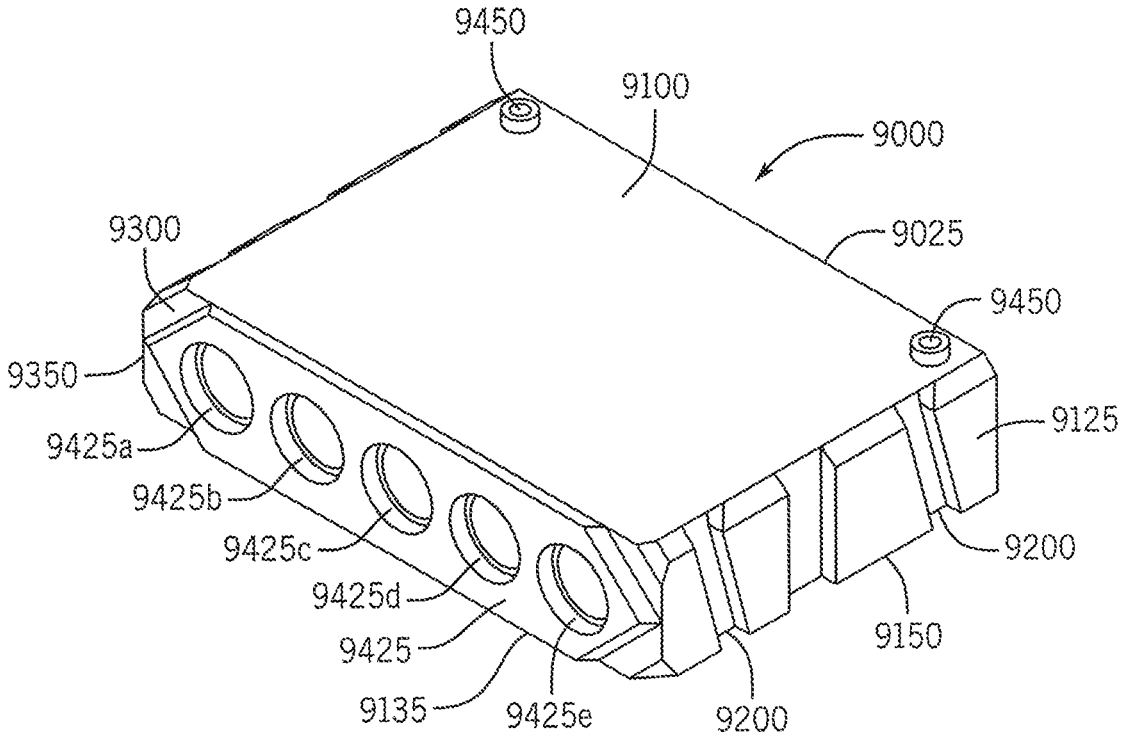
FIG. 19 illustrates a perspective view of a charge block in accordance with some embodiments of the invention.

FIG. 19 illustrates a perspective view of a charge block 9000 in accordance with some embodiments of the invention. In some embodiments, the charge block 9000 can comprise a flat block, square or rectangular in shape, with a series of charge holes along one edge corresponding in number and spacing to bores 260 of the firearm system 10. In some embodiments of the invention, the charge blocks 9000 can combine the functions of breech block, chamber, cartridge case and magazine. In some embodiments of the invention, each charge block 9000 can act as a breech block as it comes into battery (feedport 2500) in line with the bores 260 of a firearm system 10. In some embodiments, combining the chamber with the cartridge eliminates the need for an integral chamber in the barrel 250, as well as the need for a powerful action to feed cartridges into that chamber. In some embodiments, each charge block 9000 is also a magazine, and in some embodiments, can hold as many shots as the firearm system 10 has bores 260.

In some embodiments of the invention, each charge block 9000 can contain a plurality of side-by-side "charges." As used herein, side-by-side shall mean any substantially aligned configuration whether disposed horizontally, vertically or otherwise. In some embodiments, each charge can comprise at least one projectile, propellant, and primer. In some embodiments, each charge can comprise at least one projectile, propellant, and primer arranged as in a conventional cartridge. In some embodiments, each charge hole can be substantially the same diameter as the bores 260, and can be open at the top, closed at the bottom, and deep enough to contain a projectile with propellant below. In some embodiments of the invention, a series of primer pockets are arranged along the opposite edge of the charge block corresponding in number and spacing to the charge holes. In some embodiments, each primer pocket is connected to the closed end of the corresponding charge hole by a flash hole. In some embodiments, each primer pocket is fitted with a standard primer of the boxer type.

In some embodiments of the invention, the charge block 9000 can be positioned behind the breech of the barrel 250 of the firearm system 10. For example, in some embodiments of the invention, each charge can align with one of the five matching bores (e.g., such as bores 260 of a barrel 250 illustrated in FIG. 22). In some embodiments, the charge block 9000 can comprise a generally rectangular block body 9025 comprising top and bottom surfaces 9100 and sides 9125, and ends including a recoil face 9135, and a breech face 9145. Because of the flat, substantially square shape, charge blocks can be stacked together to achieve a larger capacity magazine in some embodiments.

In some embodiments of the invention, the charge block 9000 can comprise a plurality of chambers 9425. In the example embodiments of FIG. 19, the charge block 9000 can comprise five chambers comprising a first chamber 9425*a* positioned adjacent to a second chamber 9425*b*, where the second chamber 9425*b* is positioned adjacent to a third chamber 9425*c*, the third chamber 9425*c* is positioned adjacent to a fourth chamber 9425*d*, and the fourth chamber 9425*d* is positioned adjacent to a fifth chamber 9425*e*. In some other embodiments, the charge block 9000 can comprise more or fewer chambers than shown. For example, in some embodiments, the charge block 9000 can comprise four or fewer chambers, and in some other embodiments, the charge block 9000 can comprise six or more chambers. In some embodiments, the charge block 9000 can be generally smaller than the size of a deck of playing cards. For example, in some embodiments, the charge block 9000 can measure between about 2.25 inches to about 2.5 inches by about 3.5 inches. In some other embodiments, the charge block 9000 can be less than about 2.25 inches by about 3.5 inches. In other embodiments, the charge block 9000 can be greater than about 2.25 inches by about 3.5 inches.

In some embodiments of the invention, the charge blocks 9000 can be arranged to substantially match the configuration of the bores 260 of the barrel 250. For example, in some embodiments of the invention, where the bores 260 of the barrel 250 are positioned horizontally (i.e., the bores 260 of the barrel 250 are positioned in a side-by-side arrangement), the charge blocks 9000 can be arranged horizontally and stacked horizontally. In other embodiments where the bores 260 are positioned vertically (i.e., the bores 260 of the barrel 250 are positioned successively on top of each other), the charge blocks 9000 can be arranged vertically, and multiple charge blocks 9000 can be stacked vertically. In some embodiments, by dropping charge blocks 9000 into position for firing successively, a fresh charge block 9000 can replace an exhausted or partially exhausted charge block 9000. Other embodiments can be used in other applications, such as a light machine gun (squad weapon), or a heavy machine gun (vehicle mounted), where various feeding arrangements (such as breech configurations that require feeding from the side or lifting the charge blocks from below) can be used.

In some embodiments, each charge within a charge block 9000 can be fired by its own firing pin. In some embodiments, once some or all charges are discharged, the charge block 9000 can be replaced with another charge block 9000 that is at least partially charged (e.g., includes at least one charge comprising a dischargeable projectile). In some embodiments, since each charge block 9000 is replaced after five shots or discharges, chamber overheating is not an issue. In some embodiments, because each charge block 9000 is not reused, there is no requirement to withstand repeated heavy pressures. In some embodiments, an ordinary chamber must be robust enough to safely fire every cartridge used over the entire life of the barrel 250, perhaps many thousands of rounds, under any and all conditions. In some embodiments, the charge blocks 9000 are used only once, and so can be thinner. In some embodiments, the charge blocks 9000 are disposable. In some embodiments, the disposability of the charge blocks 9000 can remove the issue of chamber overheating, although in some embodiments, the problem of barrel heat remains. In some embodiments, barrel heat is less of a concern than chamber heat as it has little effect on function, but continuous firing could eventually result in reduced accuracy, bore erosion, ignition of flammable materials, etc.

In some embodiments, the use of charge blocks 9000 in a firearm system 10 can reduce the energy needed to operate the action of the firearm system 10. In some embodiments, the charge blocks 9000 can slide into position using the energy stored in the magazine spring 1900. In some embodiments, the charge block 9000 can be replaced once every five shots or less, with a total movement of only about 0.5 inch. In some embodiments, the motion is about 60 to 80 times less than what is needed for the same five shots in a conventional weapon and the time required can be substantially equally less.

In some embodiments, the charge block 9000 can comprise a width of about 50.8 mm, and a length of about 35 mm. In some embodiments, the charge block 9000 can comprise a thickness or height of about 12.7 mm. In some other embodiments, the width, length, and thickness or height of the charge block 9000 can be different than that illustrated. In some embodiments, the charge can be positioned substantially evenly spaced within the chamber block. For example, in some embodiments, the charges can be positioned so as to include a center to center distance between the each adjacent charge block of about 9 mm. Further, in some embodiments, the primer end of the charge block 9000 can include a spacing of about 1.6 mm between the primer end of each end positioned charge block 9000 and the edge of side edge of the charge block 9000.

In some embodiments, each charge within a charge block 9000 can comprise at least one projectile 9400, one or more propellants, and at least one primer charge. In some embodiments, the charge blocks 9000 can comprise Kevlar or carbon fiber composites, providing very lightweight blocks that can be stronger than steel. In some embodiments, the charge blocks 9000 can be a generally flat rectangular shape enabling them to be stacked like pancakes into a magazine similar in size and shape to an ordinary box magazine (such as magazine 1750 described earlier). In some embodiments of the invention, a magazine about the same length as an M16 (i.e., about 7 inches) can be used. This type of magazine can hold as many as 70 shots, and can be no heavier than a conventional M16 magazine of this size. In some embodiments, the charge blocks 9000 can utilize a pre-assembled cartridge, such as a 0.22 WMR cartridge. This type of cartridge fires a projectile of similar diameter and weight to a 0.556 NATO round, but at a lower pressure and velocity. The lower pressure can allow the charge block 9000 to be machined from a light alloy such as an aluminum alloy, and are reloadable to facilitate development and testing. In some embodiments, alloying elements can include other light weight metals, such as magnesium, copper, zinc, or chromium. In some further embodiments, heavier metals, such as iron (steel), zirconium, tungsten, and other rare earth metals can be used.

Some embodiments of the invention can include a charge block 9000 with a charge that comprises one or more reinforced bobbins and at least one pressure vessel. In some embodiments, an individual reinforced bobbin can be a self-contained segment comprising a pressure vessel of the charge block 9000 that enclosed a projectile. In some embodiments, several different bobbin types can be used.

Figure 20A:
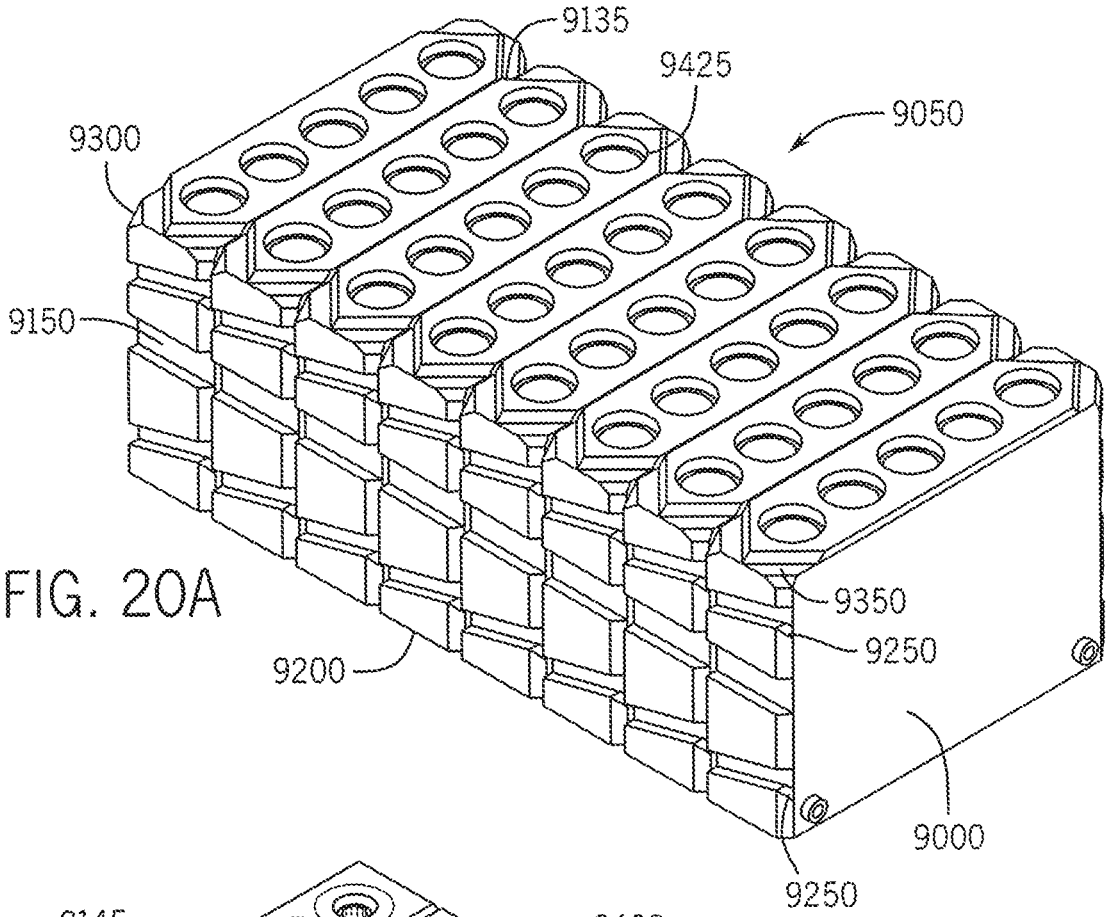
FIG. 20A illustrates a rear-side perspective view of a stack of charge blocks in accordance with some embodiments of the invention.
Figure 20B:
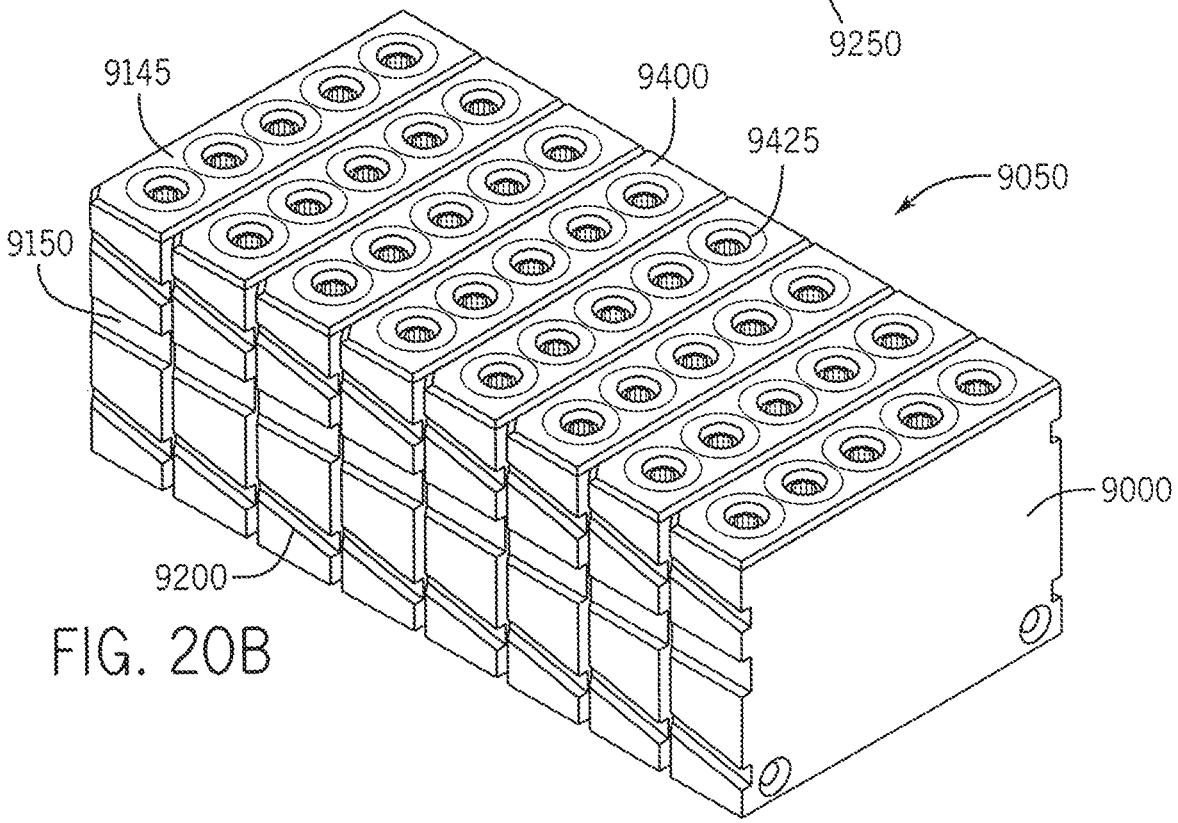
FIG. 20B illustrates a front-side perspective view of a stack of charge blocks in accordance with some embodiments of the invention.
Figure 20C:
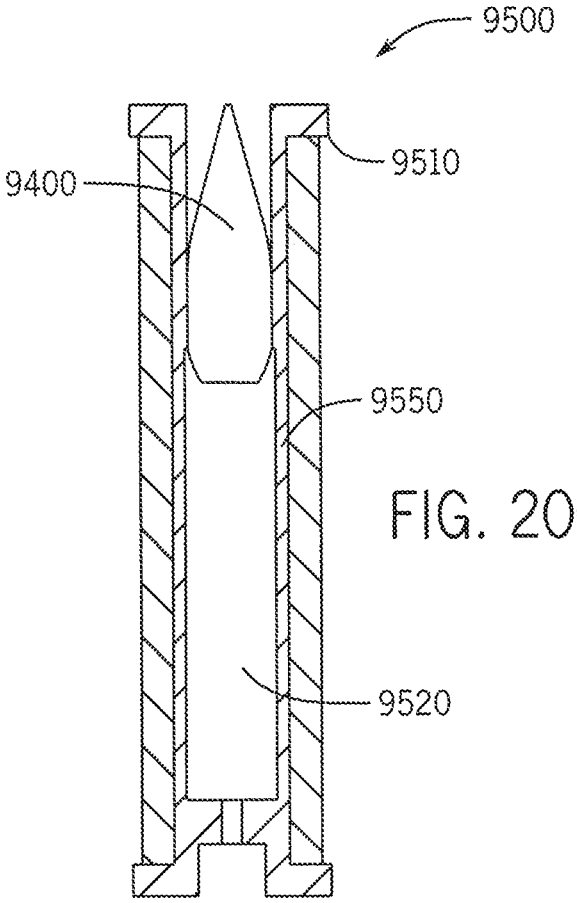
FIG. 20C illustrates a cross-sectional view of a bobbin of a charge block according to one embodiment of the invention.
Figure 20D:
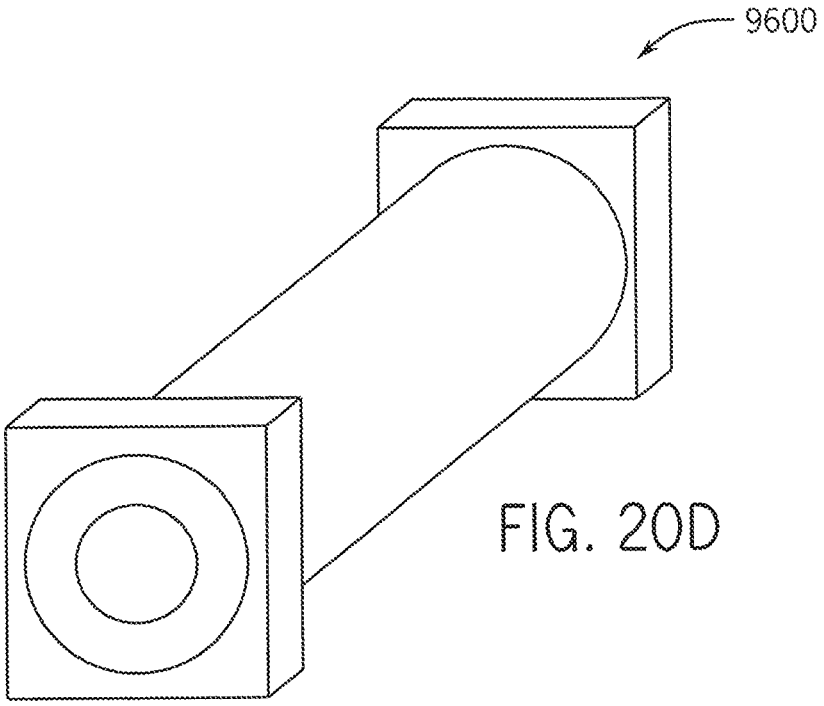
FIG. 20D illustrates a perspective view of a bobbin of a charge block according to one embodiment of the invention.
Figure 20E:
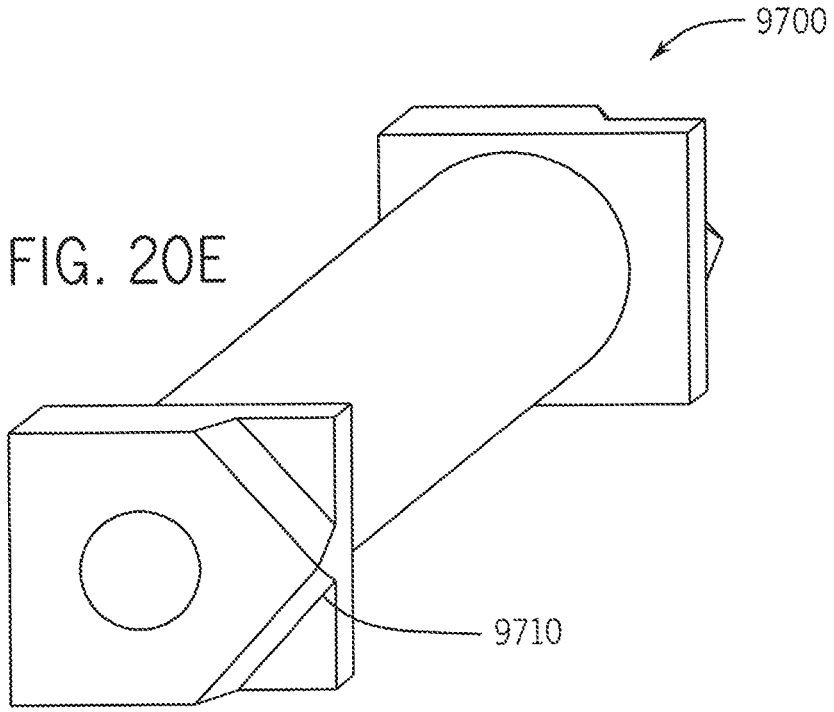
FIG. 20E illustrates a perspective view of a bobbin of a charge block according to another embodiment of the invention.
Figure 20F:
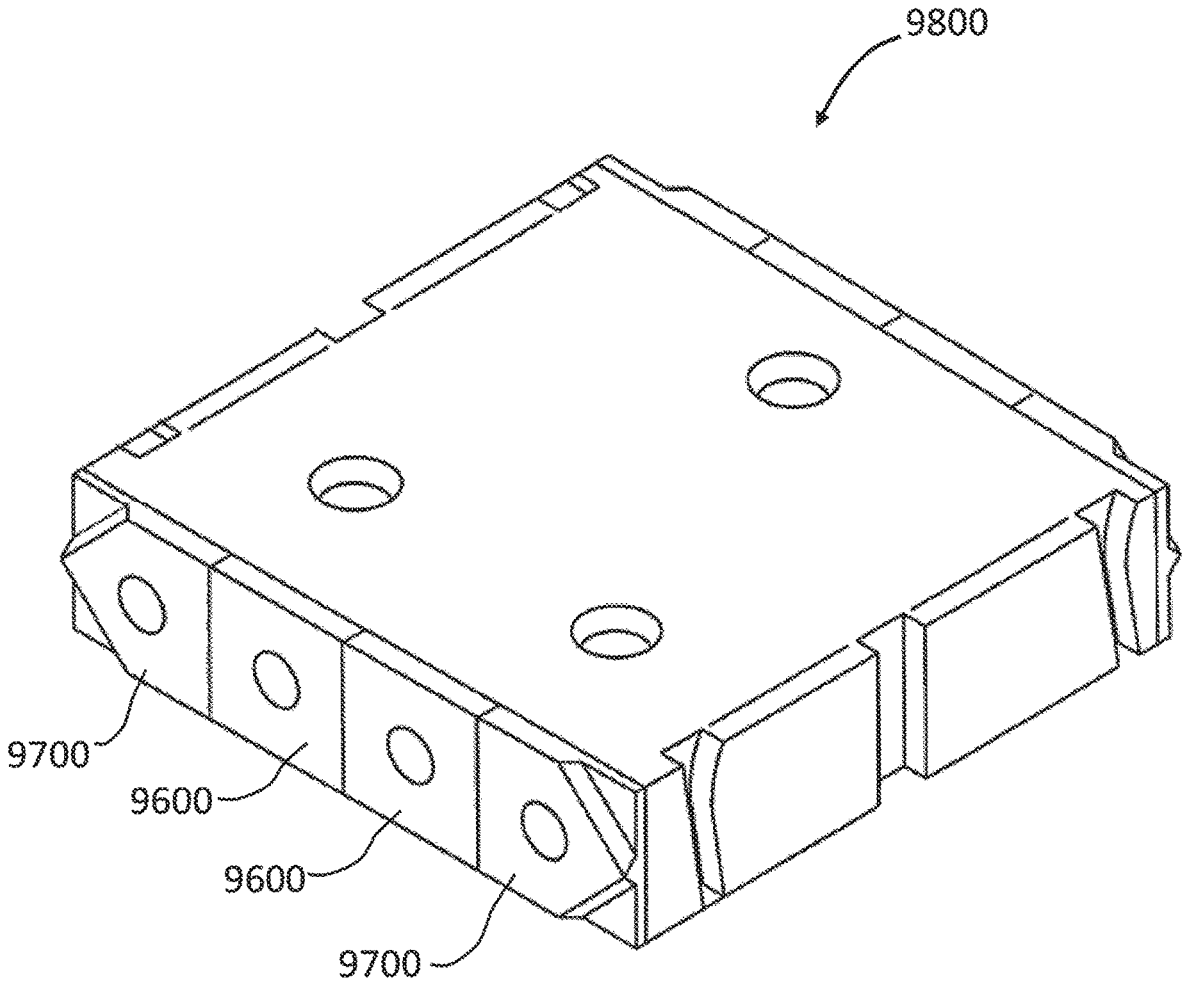
FIG. 20F is a perspective view of a charge block assembled using the bobbins of FIGS. 20D-20E in accordance with some embodiments of the invention.

For example, FIG. 20C illustrates a cross-sectional view of a bobbin 9500 of a charge block 9000 according to one embodiment of the invention. In some embodiments, the bobbin 9500 can comprise a "type 1" bobbin that can comprise rectangular flanges with recessed areas. Further, in some embodiments of the invention, the bobbin 9500 can comprise a "type 2" that can comprise a square, flat faced flange (i.e., with no recessed areas), and can otherwise comprise a structure that is identical to the "type 1" bobbin. For example, FIG. 20D illustrates a perspective view of a bobbin 9600 of a charge block 9000 according to one embodiment of the invention. Further, FIG. 20E illustrates a perspective view of a bobbin 9700 of a charge block 9000 including tapered edge 9710. In some embodiments, bobbins 9600, 9700 can be coupled into an assembly forming a charge block. For example, FIG. 20F is a perspective view of a charge block 9800 assembled using the bobbins of FIGS. 20D-20E in accordance with some embodiments of the invention.

In some embodiments, the bobbin 9600 shown in FIG. 20D can comprise dimensions of about 13 mm by 14.5 mm by 55 mm. Further, in some embodiments, the wall of the bobbin 9600 can comprise a thickness of about 2 mm. In some embodiments, the bobbins 9500, 9600, 9700 can include burst strengths of about 175,740 psi. In some embodiments, the bobbins 9500, 9600, 9700 can comprise a main body including a primer end and a projectile end. In some embodiments of the invention, bobbins can comprise a dumbbell shape. In some embodiments, the main body can comprise cylindrical center sections, and can include one or more flanges. Various types and shapes of flanges can be used depending on the characteristics of the propellant and one or more features of the firearm system 10. For example, in some embodiments, the bobbins can differ only in the flanges positioned at each end of the bobbin. As an example, in the cross-sectional view of the bobbin 9500, the projectile 9400 is shown positioned in the projectile end 9510, and the opposite end of the bobbin 9500 comprises the primer end 9520. In some embodiments, the primer end 9520 can comprise a primer pocket with a flash hole. Further, the primer pocket can be coupled to a propellant chamber 9550 extending from the primer end adjacent to the primer pocket through at least a partial length of the bobbin 9500. In some embodiments, a projectile 9400 can be positioned within the bore of the bobbin 9500. In some embodiments, the projectile 9400 can comprise a first end 9400*a* positioned adjacent to the propellant. Further, a second end 9400*b* can comprise the projectile tip that extends towards the projectile end 9510 of the bobbin 9500.

Some embodiments of the invention can include methods of manufacturing charge blocks 9000. In some embodiments, each bobbin for a charge block 9000 can include a fiber/epoxy composite reinforcement. In some embodiments, the bobbins 9500, 9600, 9700 can comprise an anodized metal alloy. In some further embodiments, the anodized alloy bobbins are wound with a continuous strand of aramid or carbon fiber epoxy composite to form a strong reinforcement cylinder encasing the propellant chamber. In some embodiments of the invention, bobbins (such as bobbins 9500, 9600, 9700) comprising steel or steel-based alloy can be wet wound with a parallel orientation continuous filament aramid and/or carbon fiber polymer composite reinforcement cylinder to a specified diameter. In some embodiments, the cast fiber polymer composite main body of the charge block 9000 can add reinforcement and physical protection to the imbedded reinforced bobbins. In some embodiments of the invention, after curing, reinforced bobbins are assembled into an alignment jig. In some embodiments, the assembled set of bobbins is wet wrapped with two adjacent parallel orientation continuous filament aramid or carbon fiber polymer composite reinforcement bands to a specified thickness. In some embodiments, after curing, the assembled and aligned bobbin set can be removed from the jig and installed into a resin transfer precision die mold.

In some embodiments of the invention, non-directional fiber reinforced polymer can be pressure injected into the evacuated mold to fill the spaces between and around the assembled bobbins, forming the edges, slots, grooves and other surface features.

Some embodiments of the invention include methods to form reinforced bobbins by assembly together in a die mold. In some embodiments, a charge block 9000 can be fabricated using non-directional fiber reinforced epoxy that is injected into a die mold to form a completed charge block 9000. In some embodiments, flanges comprising a metal alloy are exposed on each end, and all other exterior features are molded.

In some embodiments of the invention, one or more castellation matching sockets can be incorporated (see for example FIG. 19 showing castellations 9450). Some embodiments of the invention include charge blocks 9000 including recessed areas that interlock with matching raised bosses on a breech end 265 of the barrel 250 and recoil shield 3300 when in battery. In some embodiments, tapered edges can help to ensure correct alignment of the charge block 9000 with the bores 260 of the firearm system 10. In some embodiments, one or more castellations 9450 can fit matching sockets on adjoining charge blocks 9000 to facilitate alignment and stacking. In some embodiments, charge blocks 9000 can snap together for rapid loading, but can be separated by the action for individual ejection within the firearm system 10. In some embodiments, the castellations 9450 can also provide tactile confirmation of the orientation of the charge block 9000. Further, in some embodiments, asymmetric keyways can be added to one or more edges of the charge block near guide slots to help ensure correct orientation when loading.

In some embodiments, each bobbin can be loaded with a primer, propellant and projectile. Intended for multi-bore firearms, charge blocks 9000 can be assembled from two or more bobbins (e.g., such as bobbin 9600 or bobbin 9700). As a result, in some embodiments of the invention, the charge block 9000 can include one or more guides, slots, or grooves to facilitate loading, coupling, alignment, and transport within the firearm system 10 (e.g., such as when stored and transporting within the ammunition magazine 1750. For example, in some embodiments, the block body 9025 can comprise at least one guide rail slot 9150, and/or at least one feed groove 9200 positioned in the sides 9125. Referring to FIGS. 19, 20A-20B, in some embodiments of the invention, the charge block 9000 can comprise a plurality of feed control grooves 9200 positioned on each side of the charge block 9000. For example, FIG. 19 shows one example of a charge block 9000 including feed control grooves 9200 positioned on each side of the chamber block (shown one side in the perspective view). In some embodiments, the feed control grooves can be slanted. For example, in some embodiments, the feed controls grooves can slant towards the projectile end of the charge block 9000. In this instance, with regard to the primer end feed control grooves 9200, the distance between the bottom edge of the primer end feed control grooves (at the bottom face of the chamber block) and the primer end of the charge block 9000 can be about 8 mm, and the distance between the top edge of the primer end feed control grooves (at the top face of the charge block 9000) and the primer end of the charge block 9000 can be about 5 mm. Further, in regard to the projectile end feed control grooves 9200, in some embodiments, the distance between the bottom edge of the projectile end feed control grooves 9200 (at the bottom face of the chamber block) and the projectile end of the charge block 9000 can be about 2 mm, and the distance between the top edge of the projectile end feed control grooves 9200 (at the top face of the charge block 9000) and the projectile end of the charge block 9000 can be about 5 mm.

In some embodiments, as the charge block 9000 is transported within the ammunition magazine 1750, movement of the charge block 9000 can be guided by the at least one guide rail slot 9150. Further, in some embodiments, as the charge block 9000 is transported within the ammunition magazine 1750 into the receiver complex 2000, the at least one feed groove 9200 can facilitate feeding of the charge block 9000 into the feedport 2500. Further, in some embodiments, the charge block 9000 can comprise an ejection ramp 9250 (shown in FIG. 20A) positioned on the sides 9125 to facilitate ejection of the charge block 9000 from the firearm system 10. Further, in some embodiments, the recoil face 9135 of the charge block 9000 can comprise one or more surfaces or structures to facilitate coupling, alignment, and feeding of the charge block 9000 within the receiver complex 2000. For example, in some embodiments, the charge block 9000 can comprise at least one recessed area 9300 and at least one tapered edge 9350 positioned adjacent the sides 9125.

In some embodiments, coupling and alignment of charge blocks 9000 (e.g., to form a plurality of charge block 9050) can be facilitated by one or more surfaces, sides, and/or structures coupled to or integrated with the charge block 9000. For example, in some embodiments, the charge block 9000 can comprise at least one castellation 9450 extending from at least one of the surfaces 9100. In some embodiments, multiple charge blocks 9000 can be coupled to form a plurality of charge blocks 9050. The plurality of charge blocks 9050 can provide a convenient storage of charge blocks 9000, and/or can enable a user to transport and load more than one charge block 900 into the firearm system 10. For example, FIG. 20A illustrates a rear-side perspective view of a stack of charge blocks (plurality of charge blocks 9050) in accordance with some embodiments of the invention, and FIG. 20B illustrates a front-side perspective view of a stack of charge blocks (plurality of charge blocks 9050) in accordance with some embodiments of the invention. In some embodiments, the plurality of charge blocks 9050 can comprise two or more charge blocks 9000 that are at least partially coupled using the at least one castellation 9450.

In some embodiments, one or more charge blocks 9000 of the plurality of charge blocks 9050 can include at least one projectile 9400. For example, in some embodiments, the charge block 9000 can comprise at least one projectile 9400 positioned in any one of the first chamber 9425*a*, the second chamber 9425*b*, the third chamber 9425*c*, the fourth chamber 9425*d*, or the fifth chamber 9425*e*. In some other embodiments, the charge block 9000 can comprise two or more projectiles 9400. For example, in some embodiments, the charge block 9000 can comprise a fully loaded charge block where a projectile 9400 is positioned in each of the chambers 9425*a*, 9425*b*, 9425*c*, 9425*d*, and 9425*e*. Further, in some embodiments, the plurality of charge blocks 9050 can be full charged when each of the charge blocks 9000 comprise chambers 9425*a*, 9425*b*, 9425*c*, 9425*d*, 9425*e* that include a projectile 9400.

In some embodiments, the projectile 9400 can comprise any conventional bullet. For example, in some embodiments, the projectile 9400 can comprise a conventional round, flat, or tipped nose bullet comprising conventional bullet materials such as lead or copper. In other embodiments, the projectile 9400 can comprise a nose configured to penetrate and expand on impact. For example, in some embodiments, the projectile 9400 can comprise a soft-point, hollow-point, bronze-point, or open point expanding bullet. In some embodiments, the projectile 9400 can comprise a lead alloy, such as a lead alloy hardened with antimony. In some embodiments, the projectile 9400 can comprise a jacketed or semi-jacketed bullet. For example, in some embodiments, the projectile can comprise a copper-alloy or aluminum jacket.

Figure 21:
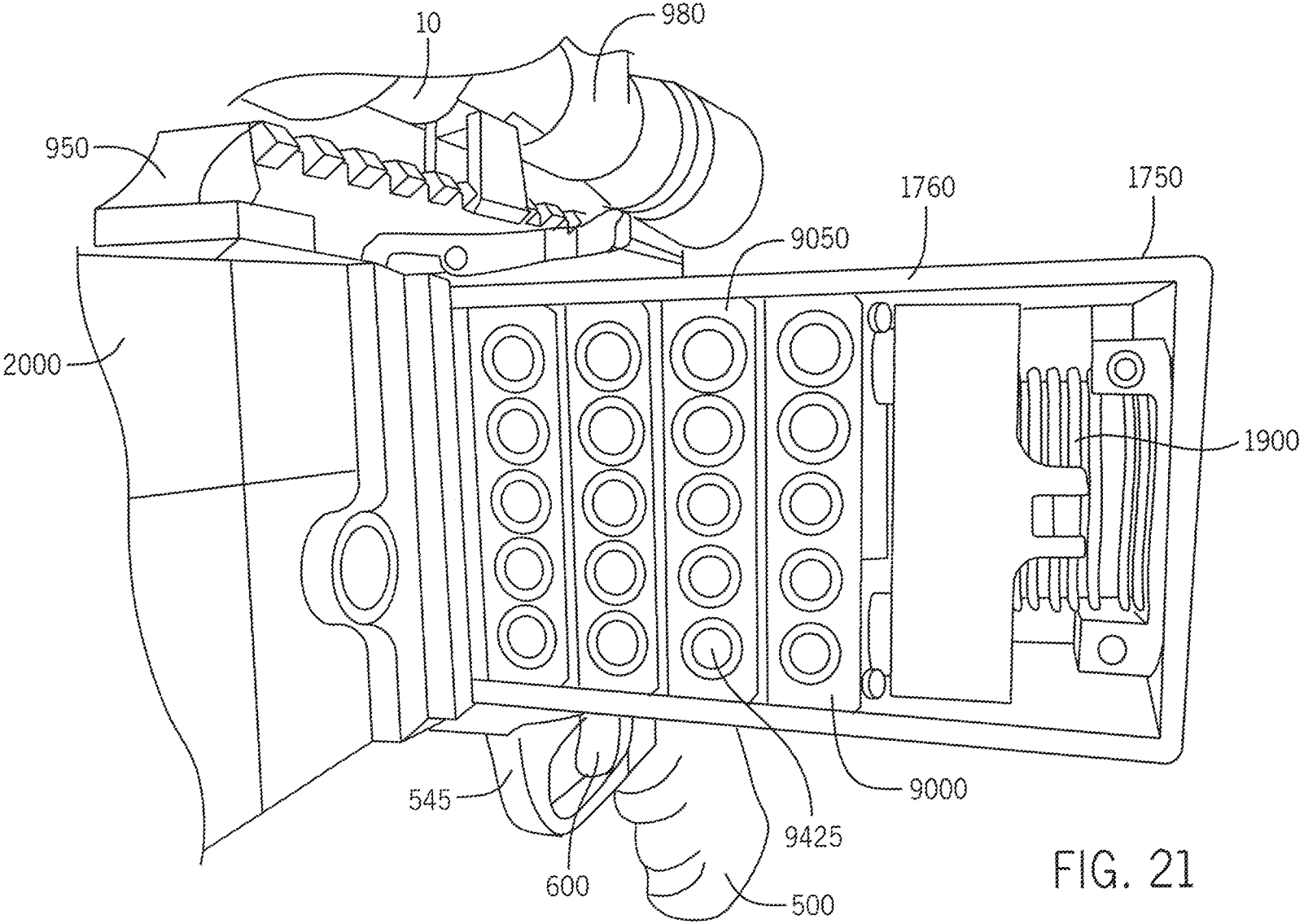
FIG. 21 illustrates partially loaded magazine installed into the firearm system in accordance with some embodiments of the invention.

In some embodiments, a single charge block 9000 or plurality of charge blocks 9050 can be positioned to be loaded into the firearm system 10 using the ammunition magazine 1750. For example, FIG. 21 illustrates a partially loaded ammunition magazine 1750 coupled to the firearm system 10 in accordance with some embodiments of the invention. As shown, in some embodiments, the ammunition magazine 1750 can be at least partially loaded with charge blocks 9000 and positioned to be fed into the feedport 2500 of the receiver complex 2000 of the firearm system 10. In some embodiments, an operator can install at least one charge block 9000 into the main housing 1760 of the ammunition magazine 1750 coupled to the firearm system 10. In some embodiments, charge blocks 9000 can be fed into the receiver complex 2000 at least partially using force applied by the magazine spring 1900. In some other embodiments, an operator can manually feed charge blocks 9000 into the ammunition magazine 1750 as the charge block 9000 are fed into the feedport 2500. In some other embodiments, an operator can manually feed charge blocks 9000 into the feedport 2500 of the firearm system 10.

In some embodiments of the invention, the firearm system 10 can discharge one or more projectiles 9400. For example, in some embodiments, a projectile 9400 can be discharged from any of the chambers 9425*a*, 9425*b*, 9425*c*, 9425*d*, 9425*e* that include a projectile 9400 (i.e., that are in a loaded state). Upon discharge, one or more projectiles 9400 exiting from a charge block 9000 can travel out of the firearm system 10 through at least one bore positioned in at least one barrel 250. In some embodiments, projectiles 9400 can be sequentially discharged from a charge block 9000 positioned in the firearm system 10. In other embodiments, more than one projectile 9400 can be discharged from the charge block 9000 at substantially the same time. For example, in some embodiments, two or more projectiles 9400 can be discharged from the charge block 9000 at substantially the same time. In some embodiments, all projectiles 9400 of the charge block 9000 can be discharged from the charge block 9000 at substantially the same time.

Some embodiments of the invention include a firearm system barrel 250, and methods of manufacture of the firearm system barrel 250. Some embodiments of the invention include a multi-bore, selective-fire, high capacity firearm system 10. For example, in some embodiments of the invention, the firearm system 10 can comprise multiple bores within a single barrel. In some embodiments, the bores can be arranged planar and parallel in a vertical array. In some other embodiments, the bores can be arranged planar and parallel in a horizontal array. For example, FIG. 22 illustrates a barrel 250 of the firearm system 10 in accordance with some embodiments of the invention. In some embodiments, the barrel 250 can comprise a barrel body 255 including bores 260 through which a projectile 9400 can enter from the charge block 9000 and exit the firearm system 10. The example embodiment shown in FIG. 22 includes a total of five bores 260 stacked vertically. Other embodiments of the invention can include more or less numbers of bores 260. For example, some embodiments can comprise four bores 260 or less than four bores 260. Other embodiments can include six or more bores 260. Further, in some embodiments, the bores 260 can be arranged side-by-side horizontally.

In some embodiments of the invention, the barrel 250 can include lightweight arrangements with a hard steel core and a complex cast outer housing (for cooling and structural support). For example, some embodiments of the invention include a barrel 250 that can comprise an inner core of hard steel, through which the bores 260 pass. In some embodiments, the inner core is embedded in a cast light alloy casing. For example, some embodiments of the invention comprise a barrel 250 that comprises an inner core with bores 260 comprising steel or steel-based alloy, or nickel or nickel-based alloy (e.g., including beryllium nickel) that is embedded in a cast light alloy casing comprising an aluminum-based alloy.

Some embodiments of the invention include methods of barrel fabrication using a process that includes the use of commercially available computer-controlled electrical discharge milling (hereinafter "EDM"). EDM is extremely accurate and induces virtually no stress into the work piece. This can eliminate a major constraint of the existing lathe-based boring methods (such as turning, boring, drilling, milling, etc.), and can permit great flexibility in barrel design. Traditional methods of barrel fabrication require a symmetrical cylindrical barrel blank, subsequent stress relief, bore drilling, further stress relief, rifling, and additional stress relief, followed by a limited amount of exterior machining. In some embodiments of the invention, barrels of almost any configuration and material can be fabricated, stress relieved, and then finally bored and rifled. Because the EDM machining induces virtually no stress in the barrel 250, straight bores 260 can be made and aligned. Multiple bores 260 bring the power and ammunition capacity of several single-bore rifles together into one weapon with little, if any, weight penalty. For example, in the case of five bores 260 shown in the example embodiment of FIG. 22, the power of five guns can be achieved with a weight of one traditional weapon.

In some embodiments of the invention, projectiles 9400 that have been discharged can exit the charge block 9000 and enter at a bore 260 of the barrel 250 of the firearm system 10 prior to exit from the firearm system 10. The bores 260 and their entry and exit of the barrel 250 can be seen more clearly in FIGS. 23 and 24, and can comprise a first bore, 260*a*, a second bore 260*b*, a third bore 260*c*, a fourth bore 260*d*, and a fifth bore 260*e*. For example, FIG. 23 illustrates a breech end 265 of the barrel 250 of FIG. 22 in accordance with some embodiments of the invention, and FIG. 24 illustrates an end of the barrel 250 of FIG. 22 including a muzzle 270 in accordance with some embodiments of the invention. In some embodiments, the breech end 265 of the barrel 250 can comprise a face 268 that includes one or more channels or conduits for transport of gases and other vapors. In some embodiments of the invention, one or more of the bores 260 of the breech end 265 can comprise one or more gas conduits at least partially encircling at least one of the bores 260. For example, in some embodiments, one or more of the bores 260 of the breech end 265 can include gas rings 5230 at least partially encircling one or more of the bores 260. Further, in some embodiments, the face 268 of the breech end 265 can comprise one or more vent channels (vents 5225) extending from the one or more gas conduits and/or gas rings 5230. In some embodiments, one or more of the vents 5225 can extend to the edge or the face 268. Further, in some embodiments, the gas ring 5230 can include a diameter that is greater than the outer diameter of the forcing cone 5220 of the breech end 265 (see FIG. 14) so that the gas ring 5230 can be positioned to exhaust gases from and away from the bores 260. In some embodiments, the profile of the gas rings 5230 can be shaped to provide improved gas flow and/or to enable the use of various manufacturing techniques. In some embodiments, the profile of the gas rings 5230 can be curved or rounded. In some further embodiments, the profile of the gas rings 5230 can comprise a groove-like cross-section. In some other embodiments, the profile of the gas rings 5230 can comprise a square or rectangular cross-section.

Figure 25:
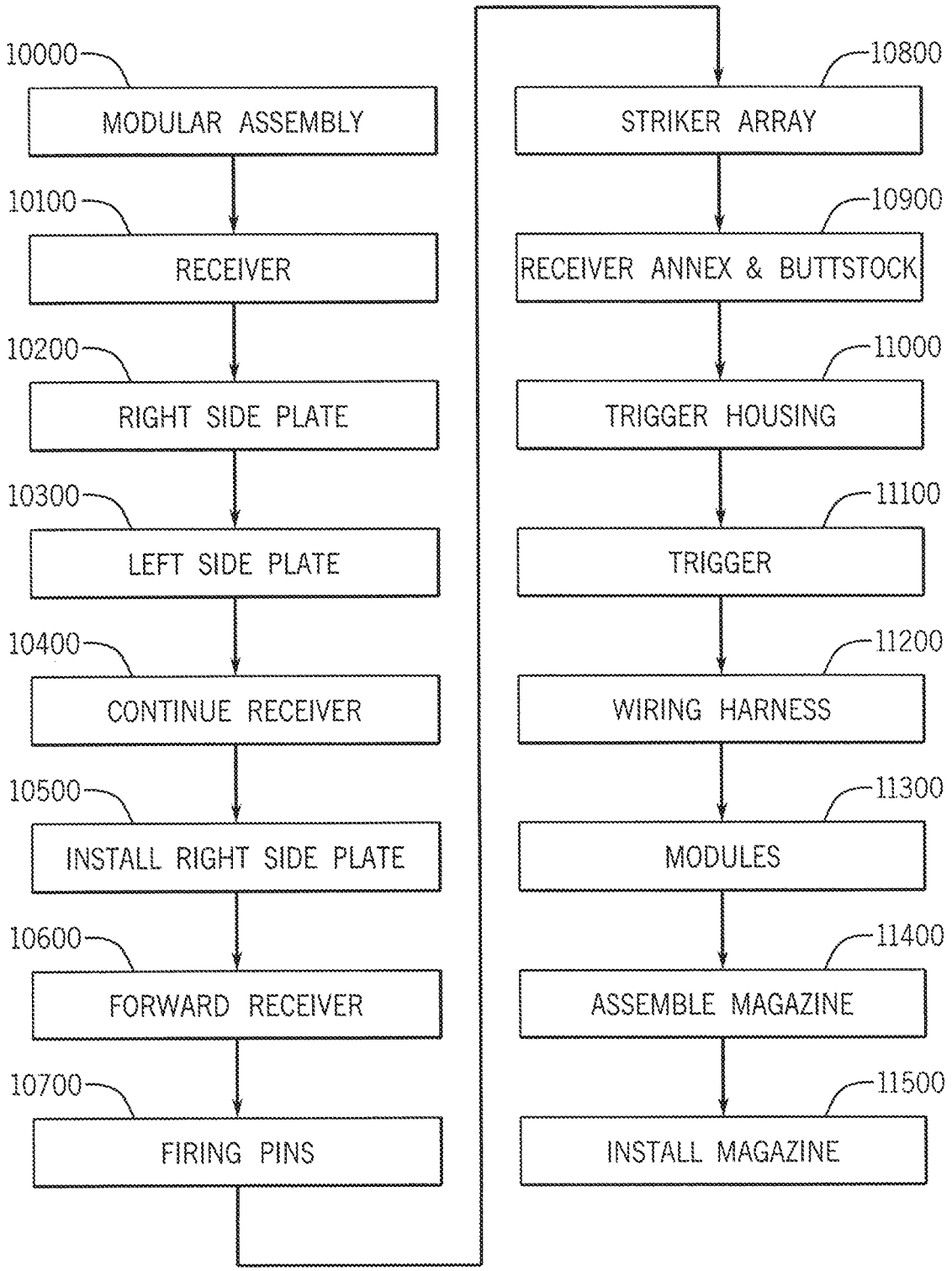
FIG. 25 illustrates an assembly readiness process for the firearm system of FIGS. 1-3 in accordance with some embodiments of the invention.

Some embodiments include a method of assembly of the firearm system 10. For example, FIG. 25 illustrates an assembly readiness process for the firearm system 10. In some embodiments, the firearm system 10 of FIGS. 1-3 can comprise a modular assembly 10000, including assembly starting from a bare receiver (shown as receiver step 10100). In some embodiments, the assembly process can proceed with pressing in brushing locating pins, and inserting spring followers, feed control rebound springs, and rebound spring set screws. Further, from an open (forward) end of receiver 4000, the operator can slide the feed control carriage 5200 into corresponding receiver grooves until seated against rebound spring followers. The assembly can proceed with assembly of right and left-side plates. For example, the step of right-side plate 10200 can include an operator sliding a compression spring onto a loading ratchet shaft, inserting the ratchet with spring into side plate, and repeating for a second ratchet. Further, the assembly can comprise installing the ratchet lever into the side plate, and ensuring ends are engaged with both loading ratchet shafts. The operator can install pivot screws, insert a detent compression spring and detent pin, and repeat for a second detent pin. Further, the assembly can comprise installing a load knob glide track, load knob, load knob glide pad and glide pad screw. The operator can then fasten the assembled right side plate 425 to the receiver 4000, and link the load knob to the feed control carriage 5200 with the load knob screw. The operator can continue assembly of the firearm system 10 by proceeding with an assemble left side plate 10300, and can install recoil shield glide pads, insert a magazine follower finger compression spring and cam lever latch pin, and install follower a finger and finger pivot pin. In some embodiments, the operator can proceed with a continue receiver assembly (step 10400), and place an action cam 5200 transversely within the receiver 4000, while engaging camshaft timing pins with respective feed control carriage bridge 5205 timing slots. In some embodiments, the operator can position a camshaft against a cam brushing with the cam lever directly opposite the feed control carriage bridge 5205. The operator can place a recoil shield 3300 within the feed control carriage 5200 with recoil face oriented toward the forward (open) end of the receiver 4000, and with return spring holes 3380 visible. The operator can position the recoil shield 3300 against the camshaft 5425, and install the recoil shield return leaf spring. An installation of a right side plate 425 (step 10500) can proceed with the operator placing the cam lever slot over the cam lever 5500, and positioning the right side plate 425 onto the receiver 4000 over the recoil shield 3300 and camshaft 5425. The operator can then push and hold fully to the rear to preload recoil shield return spring, and install fasteners. In some embodiments, proceeding with a forward receiver step 10600, the operator can fasten upper and lower the halves of the forward receiver 300 together over the breech end 265 of the barrel 250, ensuring the barrel bosses are fully seated in forward receiver 300 section of the receiver complex 2000. The operator can place the firing pin return spring into the return spring pocket in the receiver 300, and insert the firing pin through return spring and into the receiver and action until the firing pin flange contacts the return spring. The operator can repeat for all firing pins 10700. In some embodiments, the operator can proceed with a striker array step 10800 where the operator can thread the striker coil assembly 3000 into the striker coil plate 3150. The operator can insert the striker spring 3110 and striker 3160 into the coil assembly 3000, repeat with remaining coils 3050 and strikers 3160, and fasten the assembled array to receiver 4000 atop firing pin flanges.

In some embodiments, a receiver annex and buttstock step 10900 includes threading the stock tube 1300 into receiver annex 5000, and sliding the stock adapter over the tube to engage with receiver annex 5000. The operator can fasten the conduit adapter to the electronic chassis 1200 and insert the assembly into the stock adapter. In some embodiments, the operator can then align the buttplate with the receiver annex 5000, fasten it to the stock tube 1300 and electronics chassis 1200, and install a conduit lock screw. In some embodiments, the operator can install circuit board mounting grommets into electronics chassis 1200, fasten coil driver and controller circuit boards on opposite sides of mounting grommets (driver board 1470 and trigger board 1410), with the coil driver board 1470 to the right, the trigger controller board 1410 to the left, and electronic chassis 1200 in between.

In some embodiments, the operator can fasten the driver board cover to electronic chassis 1200, fasten the action rod mounting bracket to the receiver annex 5000, and insert a spring nut compression spring and action rod spring nut into mounting bracket. In some embodiments, the operator can then proceed to assemble the slide action rod expansion spring onto action rod, install a rod spring anchor screw, slide the action rod through mounting bracket and rod spring nut, thread the action rod spring into rod spring nut three turns, and thread the action rod thumb pad 475 onto action rod. Proceeding with the trigger housing step 11100, in some embodiments, the operator can fasten the trigger guard 560 to the trigger housing 545, temporarily position the pistol grip 500 on the trigger housing 545, and press the set switch and trigger switch circuit boards into respective mounts and fasten mounts to trigger housing 545.

In some embodiments, the operator can proceed with trigger assembly and installation in step 11100 by inserting set switch and trigger switch impulse pistons into respective pockets in trigger body 620. In some embodiments, the operator can cover both with a duplex leaf spring, and fasten the spring to trigger 600. The operator can then insert a trigger rebound spring into trigger housing 545, and slide the trigger body 620 through a slot in the housing 545. In some embodiments, the operator can then rotate the trigger to preload rebound spring, and install the pivot bolt. In some embodiments, using the wiring harness step 11200, the operator can pass the pigtail from control board and reset switch through the conduit, the receiver annex access port, the trigger housing 545 and the pistol grip 500. Further, in some embodiments, the operator can pass the trigger and reset switch pigtails through receiver annex access port and conduit to the control board. In some embodiments, the operator can then pass striker coil leads through conduit to driver board output pigtail, and pass the striker coil common through the access port, trigger housing 545, and pistol grip 500. With harness 575 in place, the operator can temporarily separate the pistol grip 500 from the trigger housing 545.

In some embodiments, in the modules step 11300, the operator can position the receiver annex/buttstock assembly over the striker array and fasten securely to receiver 4000. The operator can fasten the trigger housing 545 to the assembled receiver/receiver annex 5000, fasten the pistol grip 500 to the trigger housing 545, connect the harness 575 to an external power port socket, and fasten the socket to the pistol grip 500. Further, in some embodiments, the operator can position the optics rail 950 along the top of the receiver complex 2000, and fasten the rail 950 loosely to the receiver annex 5000. In some embodiments, the operator can position the forward receiver 300 and barrel 250 assembly into the receiver/receiver annex assembly, and loosely fasten the forestock Picatinny rail 850 and receiver 4000 to the forward receiver 300. In some embodiments, the operator can then fasten the optics rail 950 and receiver 4000 to the forward receiver 300, and fasten the forestock Picatinny rail 850 to the trigger housing 545. The operator can then torque to specified values all fasteners, and attach the control board cover to electronic chassis 1200.

Some embodiments of the invention include an assemble magazine step 11400 where an operator can fasten at least one quick release latch 1790 to base ring 1840 coupled to the main housing 1760 at one end of ammunition magazine 1750. In some embodiments, the operator can slide a magazine spring 1900 over a magazine follower spring guide cup to position the magazine spring 1900 in the main housing 1760. In some embodiments, the operator can position the follower on the magazine guide rails, and press the magazine spring 1900 and follower entirely through the main housing 1760 until follower contacts end stops. In some embodiments, the operator can then slide the magazine end cap guide cup into the protruding compression magazine spring 1900, and preload the magazine spring 1900 by pressing the end cap into the main housing 1760, and install fasteners. Finally, in some embodiments, the operator can proceed with an install magazine step 11500, and push the magazine 1750 fully into the receiver loading port (feedport 2500) until the base ring 1840 contacts the receiver 4000 and the quick release latches 1790 click into position.

Figure 26:
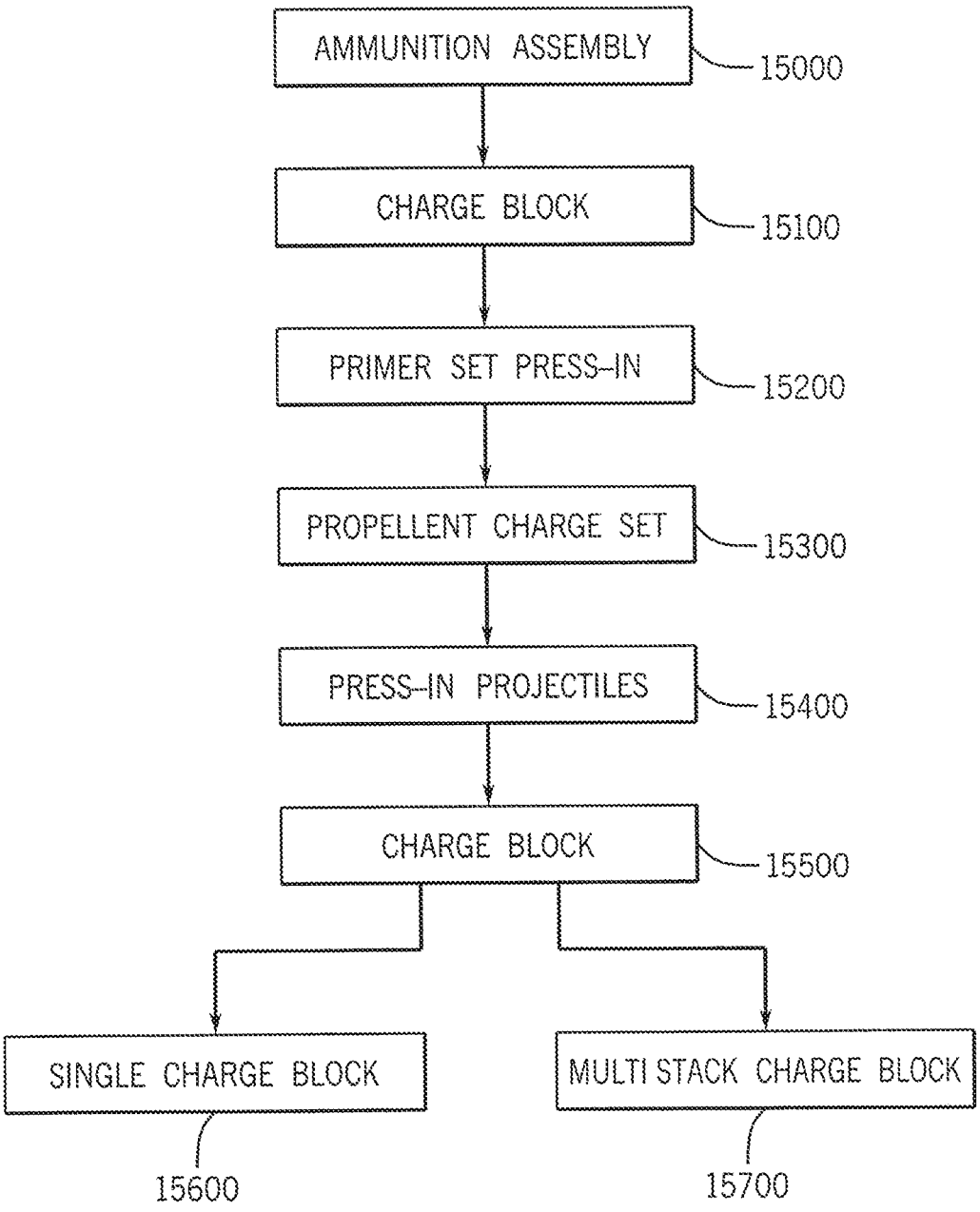
FIG. 26 illustrates an ammunition assembly process in accordance with some embodiments of the invention.

In some embodiments of the invention, in order to propel one or more projectiles (such as projectile the 9400) when discharging the firearm system 10, the firearm system 10 can be coupled to an ammunition assembly such as magazine 1750. In some embodiments, the ammunition assembly can be prepared using one or more charge blocks 9000 (shown in FIG. 19 and described earlier). In some embodiments, the charge blocks 9000 can be prepared from conventional ballistic materials including for example propellant, primer, a housing (such as the the block body 9025), and at least one projectile such as projectile 9400. A method of assembly of at least one charge block 9000 is shown in FIG. 26, illustrating an ammunition assembly step 15000 in accordance with some embodiments of the invention. In some embodiments of the invention, the ammunition assembly step 1500 can proceed as a charge block assembly 15100 step, in which single or multiple charge blocks 9000 can be prepared by loading into a conventional ammunition press. In some embodiments, the ammunition assembly 1500 can comprise a primer set press-in step 15200. For example, in some embodiments, one or more primer charges can be assembled into one or more of the plurality of chambers 9425 of a charge block 9000. In some embodiments, primer charges are loaded into all empty primer pockets. For example, in some embodiments, primer can be loaded into all of the chambers 9425*a*, 9425*b*, 9425*c*, 9425*d*, 9425*e*. In some embodiments, the primer is used to initiate ignition of a propellant, which is assembled into the charge block 9000 during the propellant charge set 15300. During this step, a measured quantity of selected propellant can be loaded into empty propellant chambers 9425*a*, 9425*b*, 9425*c*, 9425*d*, 9425*e*. Further, one or more projectiles 9400 can be selected and loaded into at least one of the plurality of chambers 9425 of a charge block 9000 during a press-in projectiles step 15400 to prepare the loaded charge block 9000 in step 15500. In some embodiments, the ammunition assembly step 15000 can include single charge block assembly step 15600 and/or a multi-stack charge block assembly 15700. For example, in step 15600, fully or partly loaded charge blocks 9000 can be independently inserted into the firearm system 10. In some further embodiments of the invention, step 15700 can comprise assembly of charge blocks 9000 that can be snapped together (or otherwise attached to each other or to a support structure) prior to loading into the firearm system 10 to facilitate the loading process. Example embodiments of assemblies of charge blocks of this type can be seen in FIGS. 20A-20B. In this instance, pre-assembled batteries of charge blocks 9000 can be correctly orientation to one another and can be inserted as a unit (plurality of charge blocks 9050) into the firearm system 10.

Figure 27:
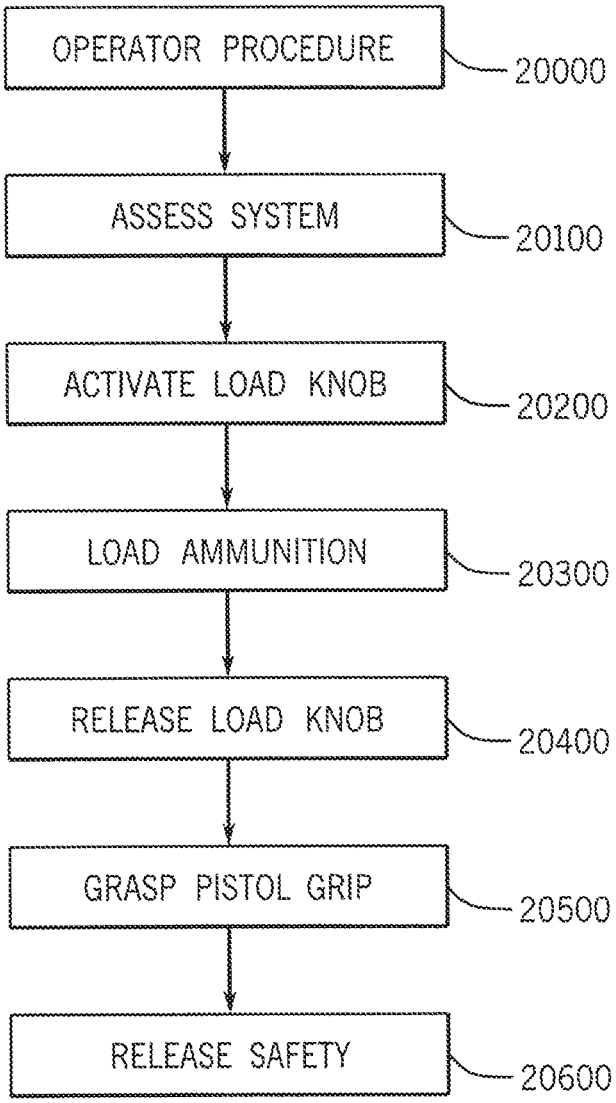
FIG. 27 illustrates a firearm start up and readiness to fire procedure in accordance with some embodiments of the invention.

In some embodiments of the invention, prior to discharging the firearm system 10, an operator can proceed with at least one operation procedure to check or monitor of at least one component of the firearm system 10 and/or to configure the firearm system 10 to a readiness to fire state. For example, FIG. 27 illustrates a firearm system 10 start up and readiness to fire procedure in accordance with some embodiments of the invention. In some embodiments, the operator, with the firearm system 10 provided, can proceed with operator procedure 20000 by performing an initial assessment of the firearm system 10 (shown as assess system step 20100). In some embodiments, the assess system step 20100 can include an assess system condition to ensure action is locked-open, ensure safety is in the "safe" position. In some embodiments, the operator can then connect a power cable to the power port 590 to provide external power, and can then load ammunition into the firearm system 10. In some embodiments, the operator can proceed with an activate load knob step 20200. Further, in some embodiments, the operator can proceed with load ammunition step 20300. In some embodiments, the operator can activate the load knob in step 20200 by pulling the load knob 400 fully to the rear until a "click" (or other noticeable feedback) is felt. Ammunition loading can proceed by inserting individual or pre-assembled groups of charge blocks 9000 into the loading port (feedport 2500) of the receiver 4000. Subsequently, in some embodiments, the operator can proceed with release load knob step 20400. An operator can then grasp the firearm system 10 using a grasp pistol grip step 20500, and ready the firearm system 10 to fire by executing the release safety step 20600.

Figure 28A:
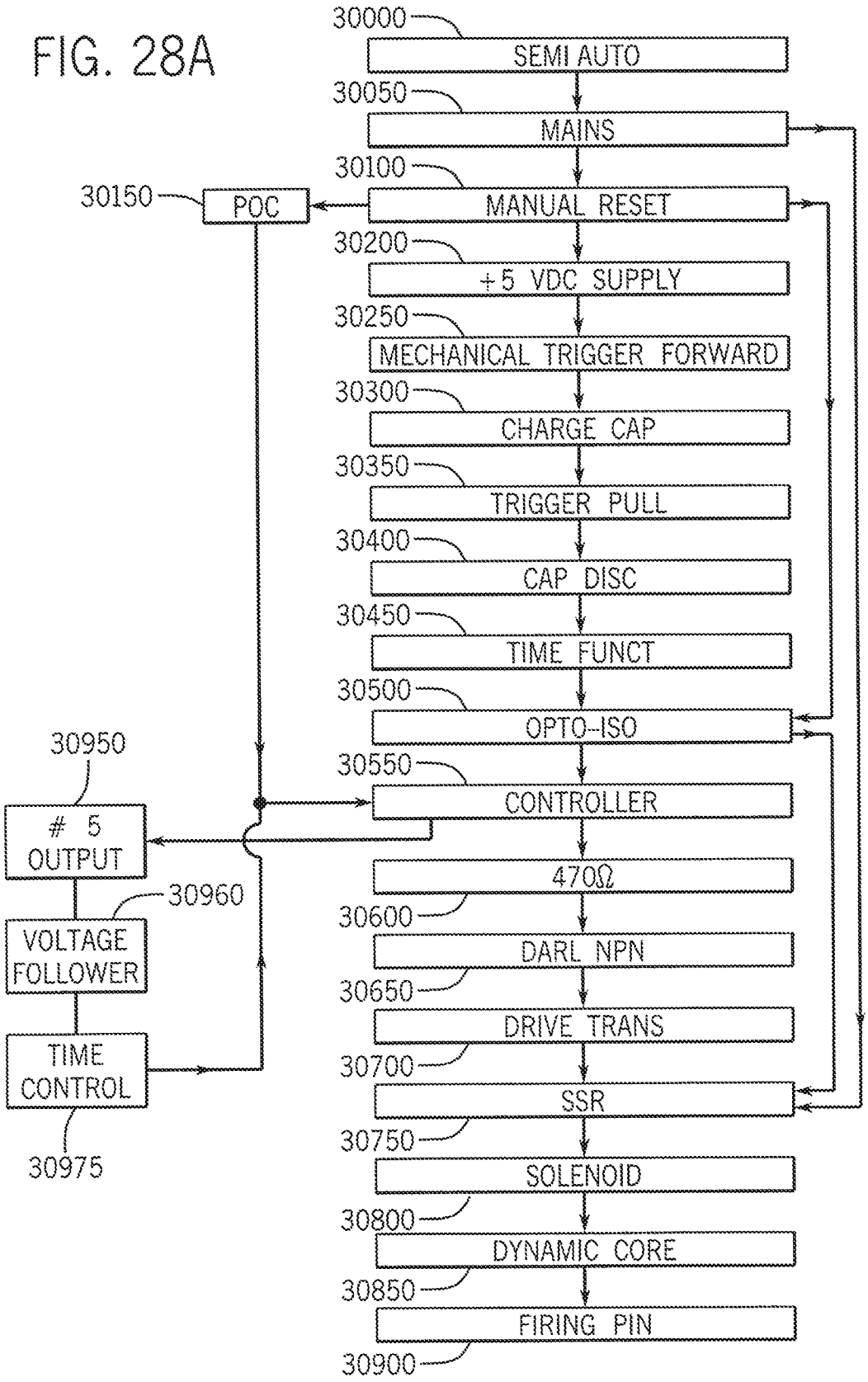
FIG. 28A illustrates a semi-automatic operational process of the firearm system of FIGS. 1-3 in accordance with some embodiments of the invention.

In some embodiments of the invention, the firearm system 10 can be operated in using an operator selectable single-action mode, a semi-automatic action mode, and/or in an automatic action mode. FIG. 28A illustrates a semi-automatic operational process of the firearm system 10 of FIGS. 1-3 in accordance with some embodiments of the invention. In some embodiments, the semi-automatic mode of operation of the firearm system 10 can comprise a semi-auto process 30000 that can proceed as a series of steps using one or more controllers of the firearm system 10.

Some embodiments include a separate firing pin, an electromagnetic striker, and a drive transistor provided for each bore. In some embodiments of the invention, a single operator controlled trigger 600 can activate alternately one of a pair of normally open single pole single throw momentary tactile micro switches. In some embodiments of the invention, when the trigger 600 is forward, one switch is held closed and completes a circuit to charge a capacitor, and the other switch remains open. In some embodiments, as the operator pulls the trigger 600 to the rear, the closed switch opens first, and then the other switch closes.

In some embodiments of the invention, the capacitor discharges through the closed switch, a resistor, and an optoisolator to define a single, reliable, consistent square-wave pulse of intended potential and duration. In some embodiments, the clean pulse can then serve to directly control the switching of the solid state relay, and simultaneously stimulate the controller. The controller can then sequentially direct a signal to enable each drive transistor in turn, advancing one step per pulse until the series is complete, then immediately or promptly resetting.

In some embodiments of the invention, the solid state relay, various drive transistors and associated electromagnetic strikers can be coupled in series parallel with the high energy DC power source. In some embodiments, the synchronous switching of the solid state relay in combination with one of the various drive transistors can direct a clean high current pulse to the electromagnetic striker coupled to that particular drive transistor. Thus, in some embodiments, each trigger 600 pull pulses only one electromagnetic striker at a time, advancing through the sequence until all the various strikers have been pulsed in the order of their respective positions in a desired sequence. In some embodiments, enabled by the final pulse of the sequence, the controller can immediately reset to its initial state. In some embodiments of the invention, the reset signal can activate an action electro-activator to replace an emptied or partially emptied charge block with a fresh one.

In some embodiments of the invention, each electromagnetic striker contains a solenoid which converts the high current pulse into a temporary magnetic field. In some embodiments, a pair of linear, cylindrical iron cores within the solenoid (one stationary and the other dynamic) can be separated by an air gap and a compression spring. In some embodiments, the presence of the magnetic field converts the two cores into temporary magnets of opposite polarity across the air gap. In some embodiments, under the influence of the magnetic field, the dynamic core can move to close the air gap, compressing the spring. Further, in some embodiments, absent the magnetic field, the compressed spring can expand, accelerating the dynamic core to strike the corresponding firing pin.

Referring to the semi-automatic process 30000 of FIG. 28A, in some embodiments, the firearm system 10 can include at least one circuit designed for semi-auto multi-bore firearms such that each trigger 600 pull discharges one of the various bores 260 in a set order until all have been discharged. Further, as part of the semi-automatic process 30000, some embodiments include a mains 30050 comprising a dual voltage power supply with common ground. In some embodiments, mains 30050 can include a high voltage (+36-54 VDC) side to energize electromagnetic strikers and a low voltage (+11-14 VDC) side to power the electronics of the firearm system 10. Further, some embodiments include a manual reset 30100. In some embodiments, a normally closed single pole single throw momentary switch can be wired to interrupt power to the front end (trigger circuit) resulting in a power on clear ("POC") reset (shown as power on clear 30150) to an initial state in the firing sequence. Further, in some embodiments, it can route power to a phototransistor within an optoisolator.

In some embodiments of the invention, the power on clear 30150 includes an RC circuit that provides a positive signal level pulse to reset terminal of a 4017 controller to ensure initial state condition on start up or manual reset. Some embodiments include a +5 VDC power supply 30200 that can comprise a 11-14 VDC input, +5 VDC output, and provides regulated power to the front end.

Some embodiments of the invention include a mechanical trigger forward 30250. In some embodiments, an operator controlled mechanical trigger 600 is normally held in the forward position by a trigger rebound spring. In some embodiments, the mechanical trigger forward 30250 controls a pair of single pole single throw momentary switches. In some embodiments, one switch is held closed when in forward position, and the other switch remains open.

Some embodiments of the invention include a charge capacitor 30300. In some embodiments, a closed forward-trigger switch completes the circuit from the power supply to a charge capacitor in the front end. In some embodiments, a pull down resistor ensures a ground state of circuit absent intended charge voltage. In some further embodiments, a series resistor value regulates capacitor charge time.

Some embodiments include a trigger pull mechanism 30350. Some embodiments include an operator controlled motion of the mechanical trigger 600 from the forward position ("charge" switch closed, "discharge" switch open) to the rearward position ("charge" switch open, "discharge" switch closed) with a segment within the range of motion where both switches are open. In some embodiments, the firearm system 10 can be controlled so that at no point in the range of motion is it possible for both switches to be closed simultaneously.

Some embodiments include a capacitor discharge 30400. In some embodiments, once the "trigger pull" closes the "discharge" switch, the charged capacitor can discharge through the switch, current limiting resistor and LED within optoisolator to ground.

Some further embodiments include a time function 30450. In some embodiments, when connected to ground between the "discharge" switch and a current limiting resistor, the value of the timing resistor controls the discharge rate of capacitor, and therefore the output pulse duration.

Some embodiments include an optoisolator 30500 comprising a light emitting diode proximate to a phototransistor. In some embodiments, the light emitting diode can be energized by a timed discharge of a trigger capacitor that illuminates the phototransistor, and can enable current flow through the phototransistor only when illuminated by LED. In some embodiments, the optoisolator 30500 can electrically isolate +5 VDC trigger circuit from +12 VDC (nom.) controller, driver and SSR circuits. Further, in some embodiments, the optoisolator 30500 can directly translates a +5V signal level pulse from the trigger 600 into a +12V pulse of sufficient current to directly enable SSR transistor, and to simultaneously stimulate the clock input of a controller (such as synchronous decade counter 4017 I/C shown as controller 30550.)

Figure 28B:
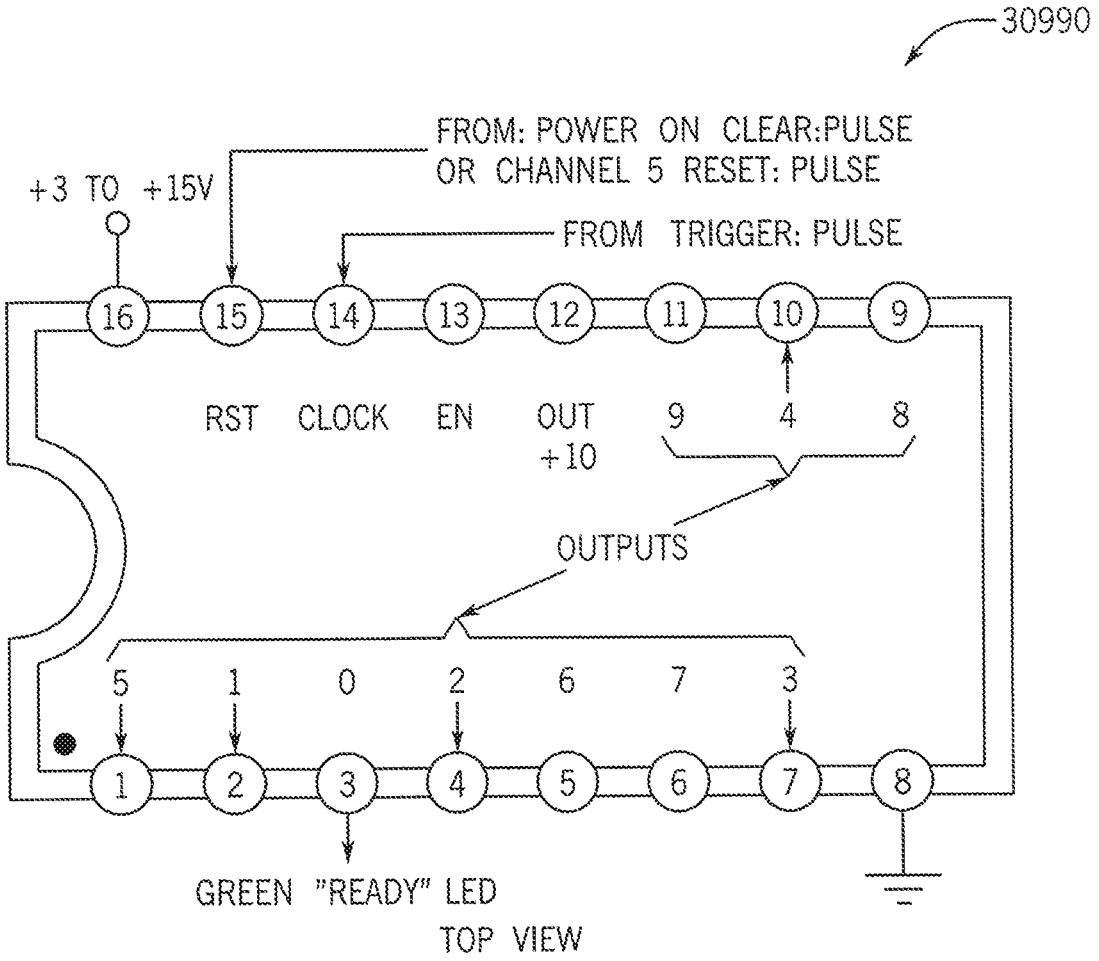
FIG. 28B shows a schematic of decade counter 30990 used in accordance with some embodiments of the invention.

In some embodiments, the controller 30550 can be utilized to individually enable the various drive transistors in a predetermined repeating sequence. For example, referring to FIG. 28B, showing a schematic of decade counter 30990, in some embodiments, this can function in conjunction with the solid state relay to control the timing and distribution of the heavy current pulses required to operate the electromechanical strikers. In some embodiments, the decade counter 30990 can illuminate the annunciators 1425 to display the changing status of the system.

Some embodiments include a current limiting resistor (in some embodiments, 4700) 30600. In some embodiments, the controller output current is insufficient to directly enable a drive transistor. In some embodiments, a high gain Darlington power transistor can be provided to boost current. In some embodiments, the current limiting resistor on the controller output can be used to adjust the Darlington output to properly bias the TIP35NPN bipolar drive transistor (shown as 30650). In some embodiments, the Darlington NPN transistor 30650 can be required to boost signal level controller output (<10 mA) to ≈1.0 ADC needed to properly bias a TIP35NPN drive transistor 30700.)

In some embodiments of the invention, the power transistor TIP35NPN 30700 can act as a switch to route high current pulse from a solid state relay to a particular electromagnetic striker. In some embodiments, conduction can be enabled by a boosted signal output from the controller, synchronous with the solid state relay on the positive transition of the pulse.

Some embodiments of the invention include a solid state relay 30750. In some embodiments, a heavy duty 75A switching transistor can be directly controlled by the +12 VDC output pulse from the trigger circuit. In some embodiments, conduction is enabled on the positive transition of the pulse, and disabled on the negative transition. In some embodiments, the solid state relay 30750 can be wired in series with high voltage power supply, the various electromagnetic striker solenoids and their associated drive transistors. In some embodiments of the invention, a conventional ultra-fast clipping and clamping freewheeling diode is employed to eliminate any "ringing" or reverse currents due to the collapse of the magnetic field generated by the solenoid at the negative transition of the pulse.

In some embodiments, solenoid 30800 can include two parallel coils of 28 GFI copper magnet wire, 680 turns each, with a combined DC resistance of 2.80, operating at +56 VDC with a current of 20 A, and resulting in MMF 27.2 k amp-turns. In some embodiments, when energized, the dynamic core (striker) can move to close the air gap, compressing striker spring. In some embodiments, a de-energized striker is released to impact the firing pin.

In some embodiments of the invention, a dynamic core 30850 can comprise a mild steel cylindrical mass accelerated by low-magnetic stainless-steel striker spring. In some embodiments, the dynamic core 30850 can rest against firing pin flange when inactive, and can be contained within a sealed tubular solenoid bobbin. In some embodiments, a clearance between the core and bobbin can permits airflow around the core to reduce friction and other resistance when in motion. In some embodiments, a co-axial suspension with a powerful magnetic field prevents contact with bobbin tube when solenoid is energized, further reducing friction. In some embodiments, full compression of the striker spring is needed to accelerate the core to sufficient velocity to successfully ignite a primer. In some embodiments, an uncompressed striker spring holds the core (striker) in a neutral position at all times except when in actual operation, precluding unintended discharge. In some embodiments, sealed construction prevents liquid or particulate intrusion due to external conditions, ensuring reliability.

Some embodiments include firing pin 30900. In some embodiments, this transmits impact energy from electromagnetic striker to the charge block primer, initiating ignition of the propellent charge and discharging the firearm. In some embodiments, a large flange on the striker end of the firing pin is confined within a pocket in the receiver limits the range of motion. In some embodiments, it is held in a neutral position away from primer by a return spring. In some embodiments, a ball near the primer end of the firing pin rides in a matching socket in the rear face of the recoil shield 3300, and can prevent binding due to motion of the recoil shield 3300 and maintain precise alignment of the firing pin tip. In some embodiments, an O-ring within recoil shield socket can help to prevent liquid or particulate intrusion into action.

In some embodiments, a current limiting resistor tied to #5 output 30950 (the output of the controller) correctly biases small signal switching transistor 2N2222A (voltage follower), increasing current available to operate an RC circuit, and isolating the input to 2N2222A transistor. Some embodiments also include a voltage follower 3096. In some embodiments, the RC circuit 30975 (time control) produces a short pulse to the reset input of the controller, resetting the controller to the initial state and energizing the a output of the controller, illuminating the green "ready" LED in the annunciator display.

Figure 29:
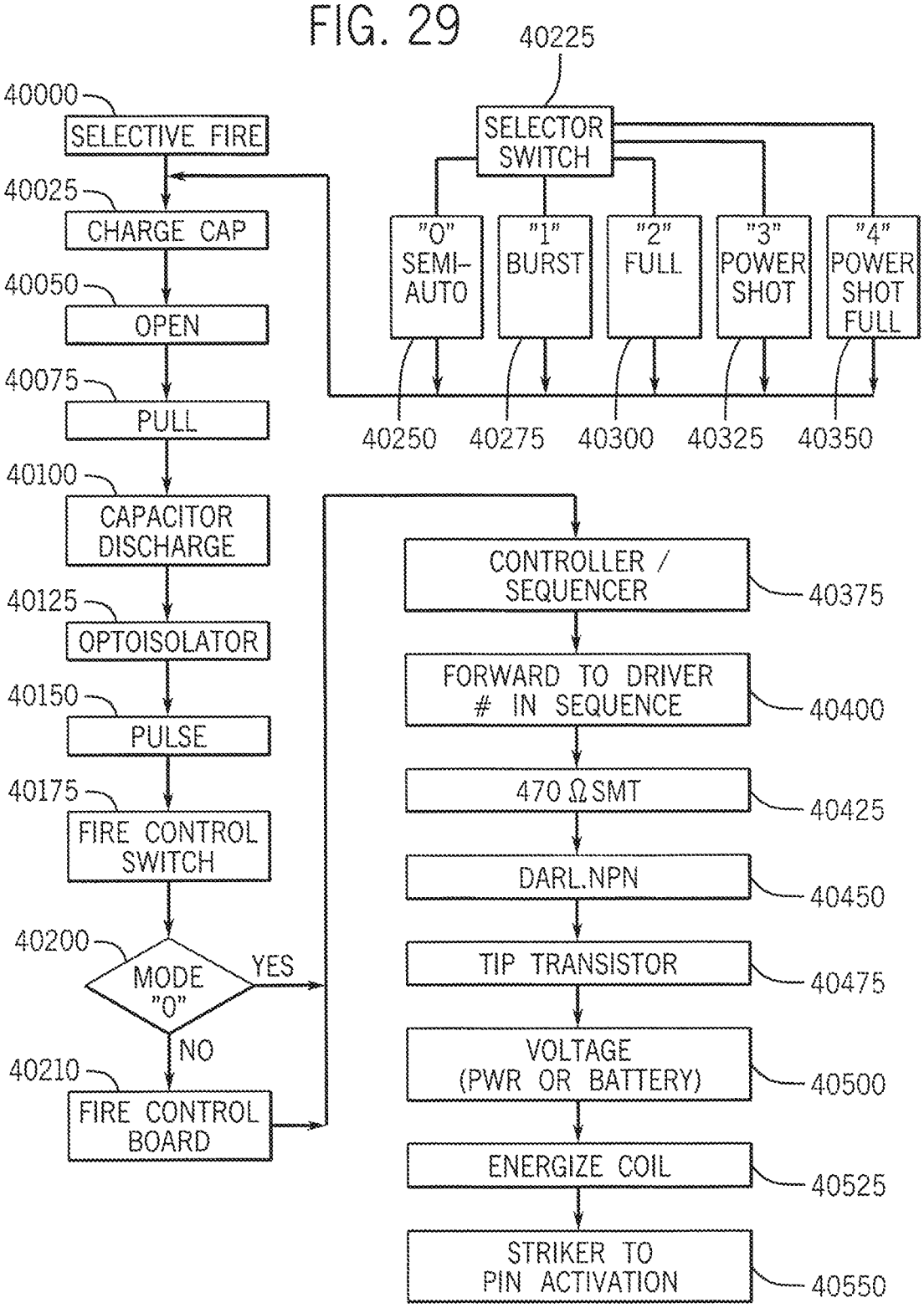
FIG. 29 illustrates a selective fire operational process of the firearm system of FIGS. 1-3 in accordance with some embodiments of the invention.

In some embodiments of the invention, the firearm system 10 can include at least one selective fire operation. For example, FIG. 29 illustrates a selective fire operational process of the firearm system 10 of FIGS. 1-3 in accordance with some embodiments of the invention. In some embodiments, the operator can utilize a selector switch step 40225 to select a firing mode of the firearm system 10. For example, in some embodiments, the operator can select a "O" position for semi-automatic fire. In some further embodiments, the operator can select a "1" position for a burst fire operation of the firearm system 10. In some other embodiments, the operator can select a "2" position for a fully automatic operation of the firearm system 10. Further, in some embodiments, the selector switch 40225 can also be used to select a "3" position for a power shot mode where the firearm system 10 can discharge a plurality of projectiles 9400 at substantially the same time. For example, in some embodiments, the firearm system 10 can discharge two or more projectiles 9400 that can be fired at substantially the same time. In some other embodiments, where the selector switch 40225 can be used to select a "4" position to enable the firearm system 10 to be operated in a power shot full mode. While in the power shot full mode, the firearm system 10 can discharge all projectiles 9400 from a charge block 9000 at substantially at the same time.

In some embodiments of the invention, after an operator selects a firing mode using the selector switch step 40225, the firearm system 10 can proceed with a selective fire process 40000. In some embodiments of the invention, the charge-cap process step 40025 can comprise charging of at least one firing capacitor. In some embodiments, following an open step 40050 and pull step 40075, the firearm system 10 can include a capacitor discharge step 40100. In some embodiments, following an optoisolator step 40125, the firearm system 10 can proceed with a pulse step 40150. Further, in some embodiments, after a fire control switch step 40175, and check for a selector switch step 40225 set to mode "0", the firearm system 10 can proceed to a fire control board step 40210 if the selector switch 40225 is not set to mode "0". Further, in some embodiments, the firearm system 10 can then proceed to a controller/sequencer step 40375, or the firearm system 10 can proceed directly to the controller/sequencer step 40375 if the selector switch 40225 is set to mode "0". In some embodiments, after a firing pulse is directed to forward to driver # in sequence step 40400, the firearm system 10 can proceed with steps through a 470 ohm-SMT step 40425, Darlington NPN step 40450, TIP transistor step 40475, and Voltage (pwr/batt) step 40500. In some embodiments, the firearm system 10 can then proceed to an energize coil step 40525, and finally a striker to firing pin step 40550.

Figure 30:
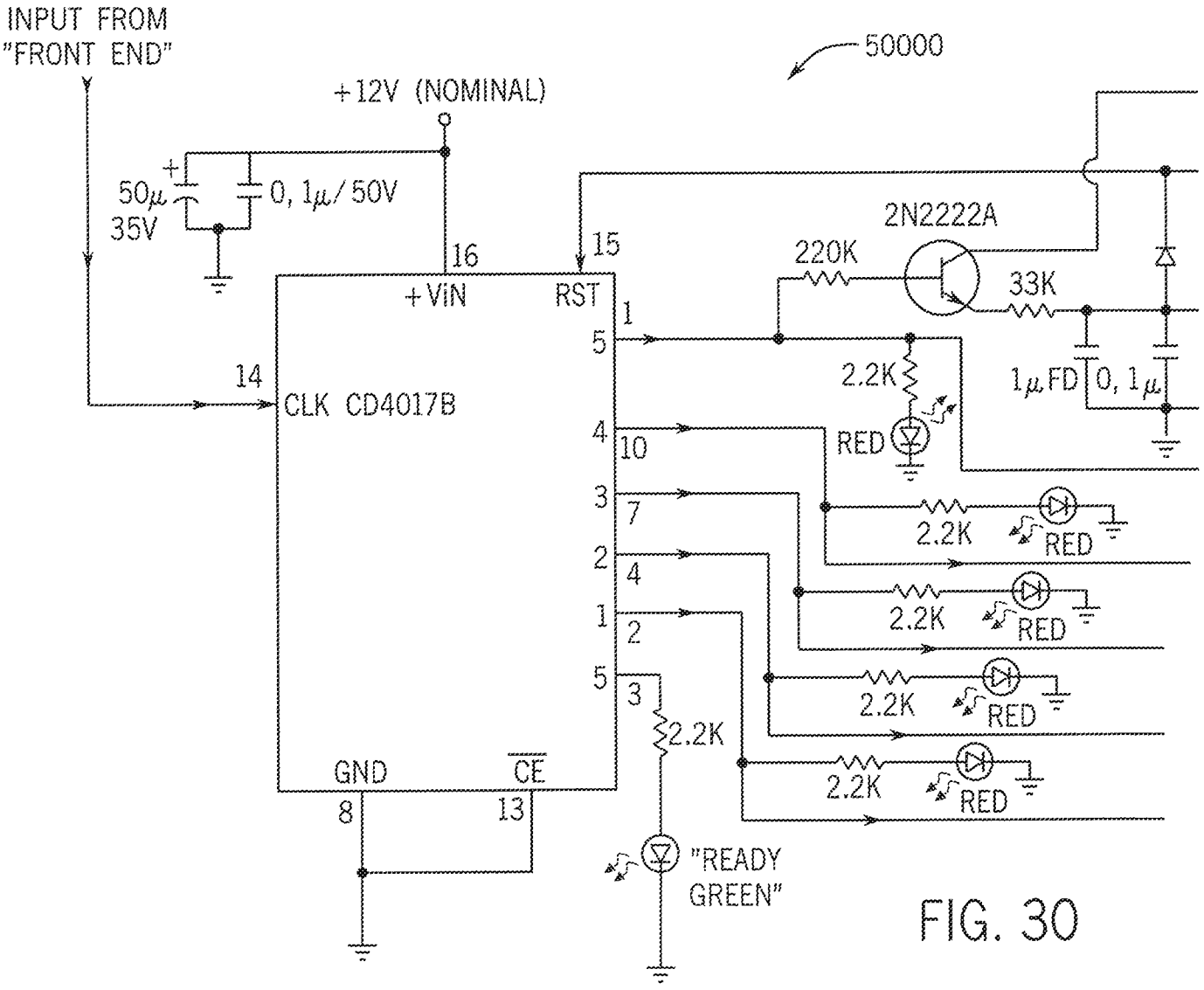
FIG. 30 illustrates a schematic of a logic control circuit of the firearm system of FIGS. 1-3 in accordance with some embodiments of the invention.
Figure 31:
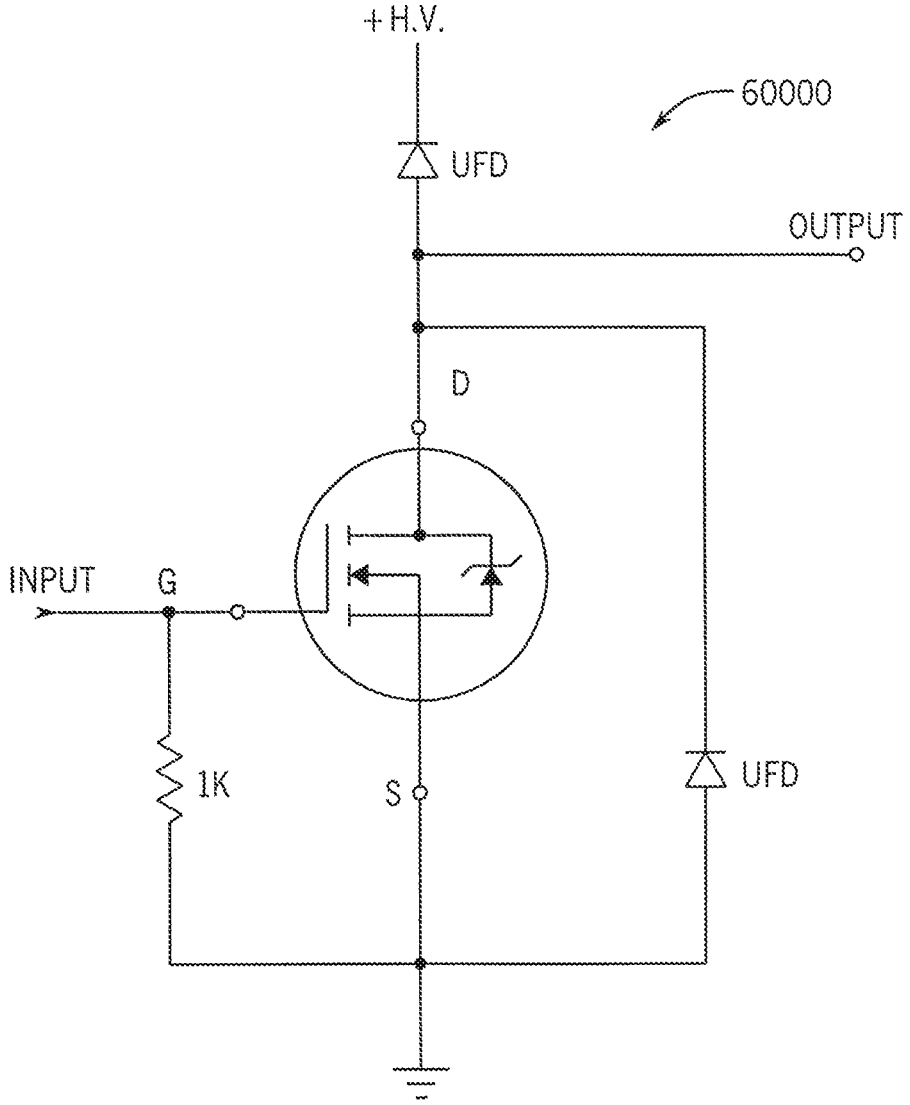
FIG. 31 illustrates a schematic of a solid-state relay control circuit of the firearm system of FIGS. 1-3 in accordance with some embodiments of the invention.
Figure 32:
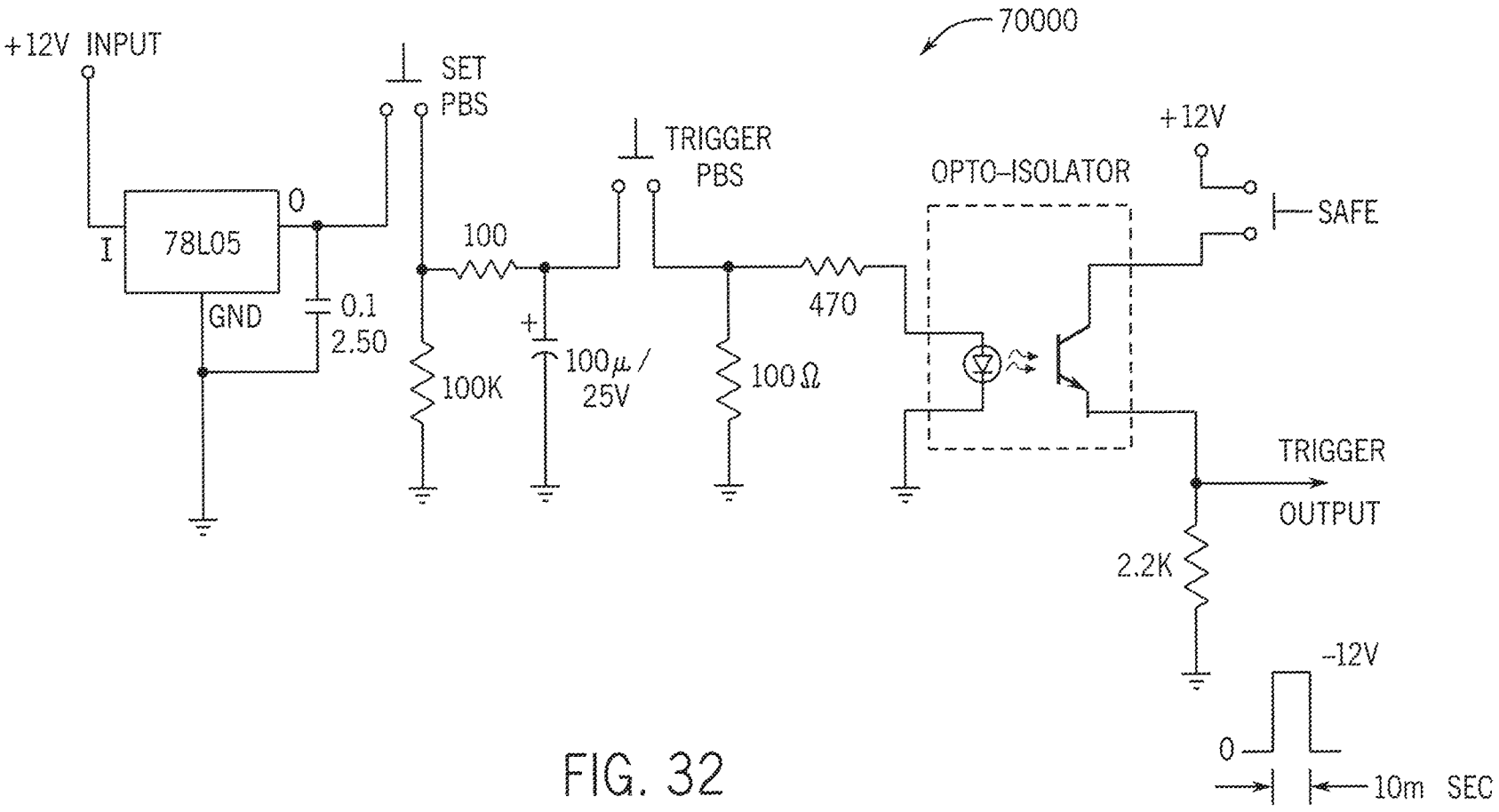
FIG. 32 illustrates a schematic of a trigger control circuit of the firearm system of FIGS. 1-3 in accordance with some embodiments of the invention.
Figure 33:
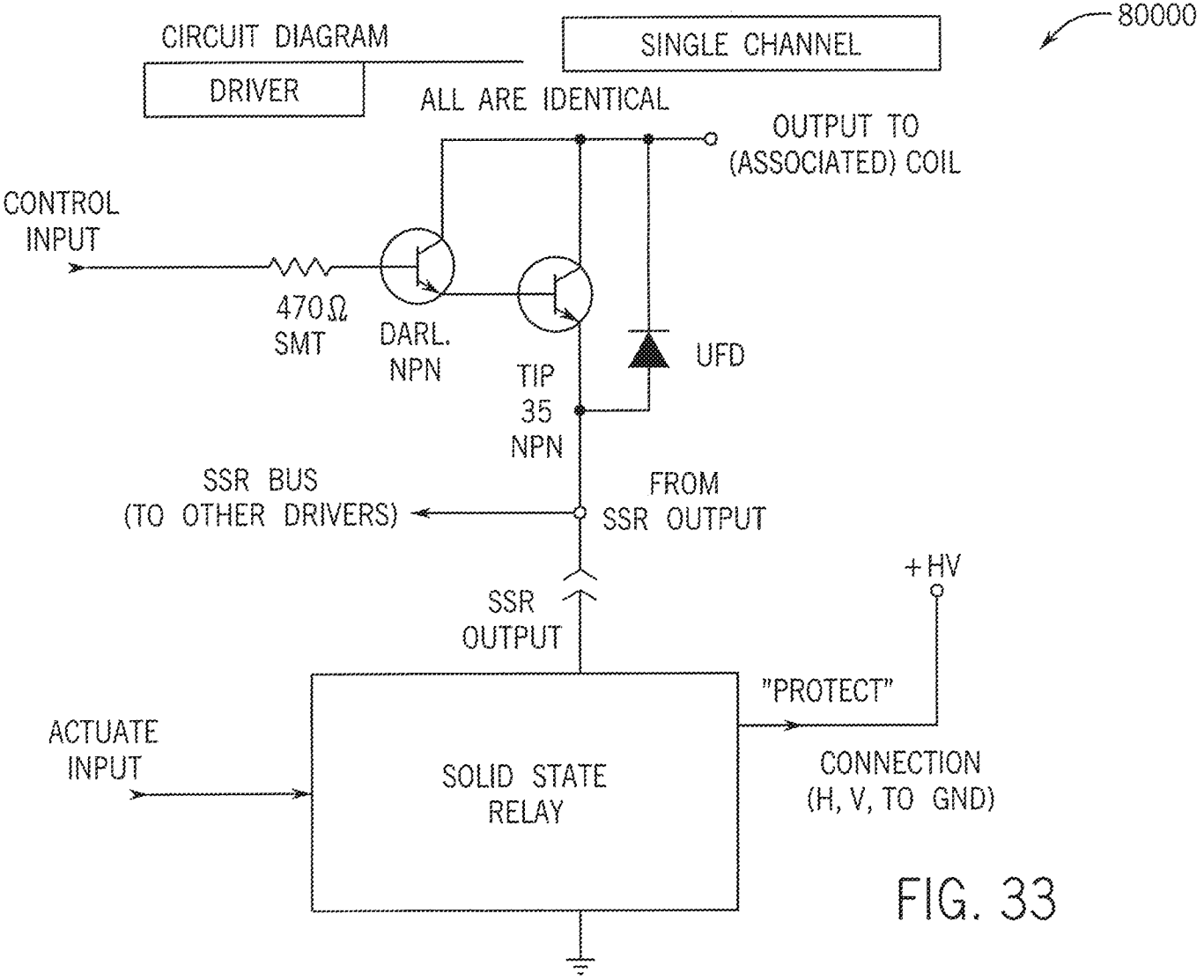
FIG. 33 illustrates a schematic of a driver control circuit of the firearm system of FIGS. 1-3 in accordance with some embodiments of the invention.

Some embodiments of the invention can comprise one or more controllers for operating and/or monitoring one or more components of the firearm system 10. In some embodiments, at least one controller can control and operate one or more firing pins within the firearm system 10. Further, for example, in some embodiments, at least one controller can control the firing and firing sequence of one or more charges within the charge block 9000. For example, FIGS. 30-33 illustrate various circuit diagrams that can operate to control at least one function of the firearm system 10. In some embodiments, one or more of the circuits shown in the circuit diagrams of FIGS. 30-33 can operate independently. In other embodiments, at least two or more of the circuits shown in the circuit diagrams of FIGS. 30-33 can operate together, either serially, or in parallel. For example, FIG. 30 illustrates a schematic of a logic control circuit of the firearm system 10 of FIGS. 1-3 in accordance with some embodiments of the invention. Further, FIG. 31 illustrates a schematic of a solid-state relay control circuit of the firearm system 10 of FIGS. 1-3 in accordance with some embodiments of the invention. Further, FIG. 32 illustrates a schematic of a trigger control circuit of the firearm system 10 of FIGS. 1-3 in accordance with some embodiments of the invention, and FIG. 33 illustrates a schematic of a driver control circuit of the firearm system 10 of FIGS. 1-3 in accordance with some embodiments of the invention.

Referring to FIG. 30, illustrating a schematic of a logic control circuit 50000, in some embodiments, the logic control circuit 50000 can be embodied in a 16 pin chip that functions as a counter divider. In some embodiments, the logic circuit can count up based on an input from the front end, and can pass a firing pulse, and illuminate an LED. The visual illumination can let an operator know which coil is getting ready to fire. In some embodiments, every time the logic control circuit 50000 receives a pulse, it can step up to the next position. In some embodiments, using this process, the firearm system 10 can enable an operator to progressively fire one, two, three, four, and five, where the five is the reset, and where the firearm system 10 can pass from a high state back to the reset which repeats the process to enable an operator to repeated progressively fire. In other embodiments, a more fully-featured operator interface such as a graphical user interface can be used.

Referring to FIG. 31, illustrating a schematic of a solid-state relay control circuit 60000 of the firearm system 10, in some embodiments of the invention, the relay control circuit 60000 can function as the primary heavy-current switching component of firearm system 10. Biased directly by the pulsed output of the trigger control circuit 70000, conduction can be enabled on the positive transition of the pulse and disabled on the negative transition. In some embodiments, wired in series with the high voltage DC power supply can be each drive transistor and its associated striker coil. Precisely timed heavy-current pulses can be directed to any of the various striker coils by the synchronous switching of the SSR and the driver connected to that particular coil. Both the SSR and the selected drive transistor can assume a conductive state on the positive transition of the pulse, but only the SSR assumes a non-conductive state on the negative transition of the pulse. In some embodiments, ultra-fast diodes are included to control voltage and current that occurs with the coil when the magnetic field collapses on the negative transition.

Referring to FIG. 32, illustrating a schematic of a trigger control circuit 70000 of the firearm system 10, in some embodiments, the trigger control circuit 70000 can function as a front end that can operate as a trigger that reliably produces a specific type of pulse only on demand and at no other time. In some embodiments, the trigger control circuit 70000 can be powered by 12 volt input (e.g., with a 78LL5 reducing to 5 volt). In some embodiments, an input switch can charge a capacitor when it is closed (e.g., a 100 microfarad, 25-volt capacitor) that can function as a trigger capacitor. In some embodiments, when the set switch is closed, this capacitor is being charged. In some embodiments, the trigger control circuit 70000 can also include resistors to positively assure a ground state when it is not active, and therefore can be used to avoid spurious signals. In some embodiments, when the set trigger is closed, the capacitor charges and is ready to discharge through the trigger. In some embodiments, when the trigger switch closes, the capacitor discharges through this resistor. In some embodiments, the resistor is tuned to the capacitor to produce a 10 millisecond pulse, and the value can be varied. In some embodiments, the optoisolator can be used as a way to electrically isolate the trigger circuit from the rest of the circuitry. In some embodiments, this can help to avoid any possibility of spurious signals, and prevent the firearm system 10 from discharging without operator input. In some embodiments, the opto-isolator performs this function by linking the two sides of the circuit with an LED, and a photo detector, so that when a pulse passes through the LED, the LED can illuminate for a length of time determined by a resistor. In some embodiments, the length of time can then be translated to essentially an output signal that can be 12 volts. In some embodiments of the invention, during operation, when the switch is in the forward position, and the operator's finger is not on the switch, the set switch can be closed, keeping the capacitor in a charged state. In some embodiments, when the operator starts to pull the trigger 600, these are both momentarily opened, and then one closes. In some embodiments, when it closes, the capacitor discharges through the resistor, and subsequently the opto-isolator. In some embodiments, this process can enable a reliable pulse comprising a square-wave pulse on the output.

Referring to FIG. 33, illustrating a schematic of a driver control circuit 80000 of the firearm system 10, in some embodiments, the drivers are tentative switches that can precisely switch heavy current from the battery pack to the coils. In some embodiments, using a control input that comprises small amplitude signals, a Darlington transistor can provide sufficient energy to switch the main drivers. In some embodiments, the main drivers can switch the heavy current from the battery pack to the coil, and the earlier described solid state relay operating connected in series and both in the on position in order for current to flow. The solid state relay ("SSR") is connected in series with the drivers, which are connected in parallel with each other. In this instance, each driver can independently provide a path to complete a circuit through the SSR and a striker coil to the batteries. In some embodiments, one SSR can include a common to five drivers, each in series with a coil, and the coils can share the other common.

In some embodiments of the invention, the energy needed to operate the firearm system 10 can comprise electric pulses that can actuate electric hammers (strikers 3160) and rotate a locking cam. In some embodiments, each pulse can fire one shot, and one pulse can unlock the action to replace each charge block 9000. In some embodiments, the electric pulses are controlled by an electronic sequencer. In some embodiments, a small battery pack (similar to those found in conventional power tools) can store and provide power to produce the pulses. Extensive lab testing of the strikers 3160 has established pulse wave profiles, and thus the resultant energy consumption rate.

In some embodiments, the use of battery power can prevent stoppages due to misfires. In some embodiments, the firearm system 10 can continue to process ammunition regardless of the occurrence of misfires. In some embodiments, an on-board power supply (such as a battery) can provide a standardized voltage power source for one or more electronic accessories. For example, in some embodiments, the power source can be used to power attached flashlights, night scopes, range finders, laser target designators, infrared illuminators, etc. In some embodiments, these devices can include standard mounting rails. In some embodiments, the battery pack can be disposable and/or exchanged for a spare battery pack.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A charge block assembly for a firearm system comprising:

a charge body including a plurality of side-by-side chambers;

a plurality of projectiles, each of the plurality of side-by-side chambers comprising at least one of the plurality of projectiles;

wherein the charge body is configured and arranged to be fed into a feedport of the firearm system to enable a discharge of the plurality of projectiles from all of the plurality of side-by-side chambers simultaneously; and wherein the charge body comprises coupled and/or integrated bobbins.

2. The charge block assembly of claim 1, wherein the charge body comprises a fiber reinforced epoxy composite.

3. The charge block assembly of claim 1, wherein the bobbins include a reinforcement cylinder comprising a wound continuous strand aramid and/or a carbon fiber epoxy composite.

4. The charge block assembly of claim 1, wherein each bobbin comprises at least one of the plurality of side-by-side chambers.

5. A charge block assembly for a firearm system comprising:

a bobbin comprising:

a bore, a propellant chamber, a projectile, and a propellant;

wherein the projectile is positioned within the bore;

wherein the projectile comprises a first end positioned adjacent to the propellant;

wherein at least a portion of the bobbin is wound with a winding; and wherein the winding is configured to form a reinforcement cylinder encasing the propellant chamber.

6. The charge block assembly of claim 5, the bobbin further comprising an alloy;

wherein the alloy is wound with the winding.

7. The charge block assembly of claim 5, wherein the winding is a continuous parallel orientation winding.

8. The charge block assembly of claim 5, wherein the winding is a filament comprising an aramid and/or a carbon fiber polymer composite.

9. The charge block assembly of claim 5, further comprising a charge block main body;

wherein the charge block main body comprises a plurality of the bobbins; and wherein the charge block main body comprises a wrapping comprising reinforcement bands.

10. The charge block assembly of claim 9, wherein the main body comprises a polymer; and wherein the polymer is between and around the plurality of the bobbins;

wherein the polymer forms a surface of the charge block main body.

* * * * *